US011698210B1

(12) United States Patent
Vaisman et al.

(10) Patent No.: US 11,698,210 B1
(45) Date of Patent: Jul. 11, 2023

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 217 days.

(21) Appl. No.: 17/178,380

(22) Filed: Feb. 18, 2021

Related U.S. Application Data

(60) Provisional application No. 62/994,965, filed on Mar. 26, 2020.

(51) Int. Cl.

| | |
|---|---|
| ***F25B 13/00*** | (2006.01) |
| ***F25B 39/00*** | (2006.01) |
| ***F25B 41/26*** | (2021.01) |
| ***F25B 49/02*** | (2006.01) |
| ***F25B 43/00*** | (2006.01) |

(52) U.S. Cl.
CPC ..... *F25B 13/00* (2013.01); *F25B 39/00* (2013.01); *F25B 41/26* (2021.01); *F25B 43/00* (2013.01); *F25B 49/02* (2013.01); *F25B 2313/02741* (2013.01); *F25B 2341/0015* (2013.01); *F25B 2400/0407* (2013.01); *F25B 2400/0411* (2013.01)

(58) Field of Classification Search
CPC ..... F25B 13/00; F25B 39/00; F25B 41/26; F25B 43/00; F25B 49/02; F25B 2313/02741; F25B 2341/0015; F25B 2400/0407; F25B 2400/0411
See application file for complete search history.

(56) References Cited

U.S. PATENT DOCUMENTS

| | | | | |
|---|---|---|---|---|
| 5,875,638 | A | 3/1999 | Tinsler | |
| 6,314,749 | B1 | 11/2001 | Van Steenburgh, Jr. | |
| 7,357,002 | B2 | 4/2008 | Yoshimi et al. | |
| 9,671,144 | B1 | 6/2017 | El-Shaarawi | |
| 9,989,074 | B2 * | 6/2018 | Nishijima | F25B 1/08 |

(Continued)

FOREIGN PATENT DOCUMENTS

| | | |
|---|---|---|
| EP | 1650509 | 4/2006 |
| EP | 1681523 | 7/2006 |
| WO | WO 2014/179032 | 11/2014 |

OTHER PUBLICATIONS

U.S. Appl. No. 10/746,440, filed Aug. 18, 2020, Donovan et al.
U.S. Appl. No. 17/178,378, filed Feb. 18, 2021, Vaisman et al.
U.S. Appl. No. 17/178,390, filed Feb. 18, 2021, Vaisman et al.

*Primary Examiner* — Henry T Crenshaw
(74) *Attorney, Agent, or Firm* — Fish & Richardson P.C.

(57) ABSTRACT

A thermal management system includes an integrated open-circuit refrigeration system and closed-circuit heat pump system. The thermal management system includes a receiver having a first receiver port and a second receiver port, the receiver configured to store a refrigerant fluid, an evaporator having a first evaporator port and a second evaporator port, the heat pump circuit having a closed-circuit fluid path with the receiver and the evaporator and an open-circuit refrigeration system configured to receive refrigerant from the receiver, with the open-circuit refrigeration system having an open-circuit fluid path that includes the receiver and the evaporator.

68 Claims, 21 Drawing Sheets

(56) References Cited

U.S. PATENT DOCUMENTS

| | | | | |
|---|---|---|---|---|
| 11,105,545 | B2 | 8/2021 | Ma et al. | |
| 2004/0255610 | A1* | 12/2004 | Nishijima | F25B 41/00 62/500 |
| 2006/0254308 | A1* | 11/2006 | Yokoyama | F25D 21/08 62/500 |
| 2007/0101759 | A1 | 5/2007 | Matsuoka et al. | |
| 2007/0113581 | A1 | 5/2007 | Yoshimi et al. | |
| 2010/0005831 | A1 | 1/2010 | Vaisman et al. | |
| 2014/0075984 | A1 | 3/2014 | Sugawara et al. | |
| 2015/0184924 | A1 | 7/2015 | Vie et al. | |
| 2016/0114260 | A1 | 4/2016 | Frick | |
| 2016/0175740 | A1 | 6/2016 | Stark et al. | |
| 2018/0066872 | A1 | 3/2018 | Hellmann | |
| 2021/0095901 | A1* | 4/2021 | Perez-Blanco | F25B 43/043 |
| 2021/0285700 | A1* | 9/2021 | Brillhart | F25B 15/006 |
| 2022/0205662 | A1 | 6/2022 | Ishimura et al. | |

* cited by examiner

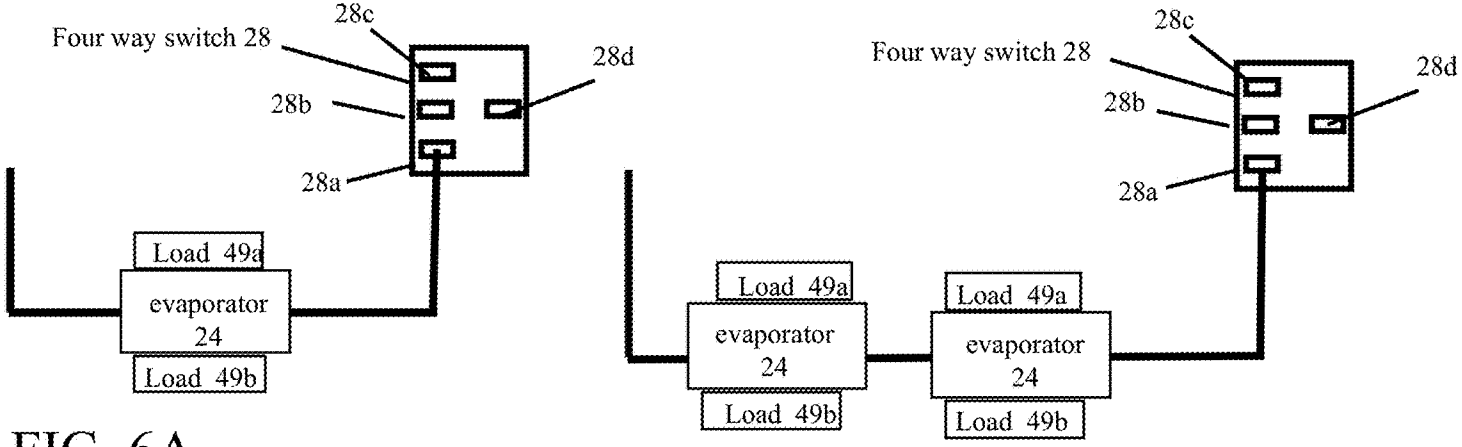
FIG. 6A
FIG. 6B
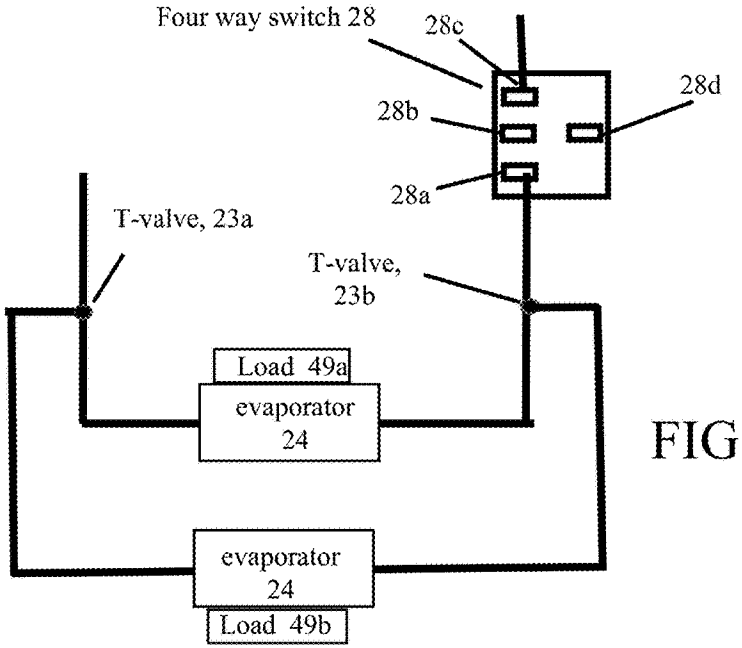
FIG. 6C

THERMAL MANAGEMENT SYSTEMS

CLAIM OF PRIORITY

This application claims priority under 35 USC § 119(e) to U.S. Provisional Patent Application Ser. No. 62/994,965, filed on Mar. 26, 2020, and entitled "THERMAL MANAGEMENT SYSTEMS," the entire contents of which are hereby incorporated by reference.

BACKGROUND

This disclosure relates to thermal management.

Refrigeration systems absorb thermal energy from heat sources operating at temperatures above the temperature of the surrounding environment, and discharge thermal energy into the surrounding environment.

Conventional refrigeration systems can include a compressor, a heat rejection exchanger (i.e., a condenser), a liquid refrigerant receiver, an expansion device, and a heat absorption exchanger (i.e., an evaporator). Such systems can be used to maintain operating temperature set points for a wide variety of cooled heat sources (e.g., loads, processes, equipment, systems) thermally interacting with the evaporator. Closed-circuit refrigeration systems may pump significant amounts of absorbed thermal energy from heat sources into the surrounding environment. In closed-circuit systems, compressors are used to compress vapor from the evaporation and condensers are used to condense the vapor to cool the vapor into a liquid. The combination of condensers and compressors can add significant amount of weight and can consume relatively large amounts of electrical power. In general, the larger the amount of absorbed thermal energy that the system is designed to handle, the heavier the refrigeration system and the larger the amount of power consumed during operation, even when cooling of a heat source occurs over relatively short time periods.

SUMMARY

According to an aspect, a thermal management system includes a receiver that has a first receiver port and a second receiver port and is configured to store refrigerant fluid, an ejector having a primary inlet, a secondary inlet and an outlet, an evaporator having a first evaporator port and a second evaporator port, a condenser device having a first port and a second port, a compressor having a compressor inlet and a compressor outlet, and a heat pump circuit having a closed-circuit fluid path with the receiver, the ejector, the evaporator, the condenser, and the compressor, and an open-circuit refrigeration system configured to receive refrigerant from the receiver, with the open-circuit refrigeration system having an open-circuit fluid path extending from the first receiver port to an exhaust line, and which includes the receiver, the ejector, the heat pump circuit, and the evaporator.

Embodiments of the thermal management systems may include any one or more of the following features or other features disclosed herein as may be specific to a particular one or more of the above aspects.

The refrigerant pressure in the evaporator depends at least in part on a secondary refrigerant flow that is entrained by a primary refrigerant flow through the ejector. The ejector acts as a pump to pump the secondary refrigerant flow using energy of the primary refrigerant flow.

The thermal management system further includes a liquid separator having an inlet, a vapor-side outlet and a liquid-side outlet, with the liquid-side outlet coupled to the secondary inlet port of the ejector, and with the ejector secondary inlet port configured to receive refrigerant liquid from the liquid-side outlet of the liquid separator. The thermal management system further includes a check valve disposed between the liquid-side outlet and the secondary inlet port of the ejector.

The thermal management system further includes a first by-passable expansion device that couples the first receiver port to the ejector, and a second by-passable expansion device that couples the second receiver port to the condenser device. The first and second by-passable expansion devices each include an expansion valve device, and a check valve coupled in shunt with the expansion valve device. The first by-passable expansion device is configurable to expand liquid refrigerant from the receiver to produce a mixed liquid-vapor refrigerant flow into the evaporator for a cooling mode of operation.

The liquid refrigerant fed to the secondary inlet is expanded at a constant entropy in the ejector and mixes with the mixed liquid-vapor refrigerant flow from the first by-passable expansion device to form a combined mixed liquid-vapor refrigerant that provides cooling duty to a heat load coupled to the evaporator, and which combined mixed refrigerant is discharged from the evaporator in a two-phase state having an exit vapor quality below a unit vapor quality.

The heat pump circuit includes a four-way valve disposed in both the closed-circuit fluid path and the open-circuit fluid path. The heat pump circuit further includes a by-passable expansion device that couples the condenser device to the second receiver port. The condenser device is a condenser and the by-passable expansion device is configurable to expand the liquid refrigerant to produce a mixed liquid vapor refrigerant flow into the condenser for a heating mode of operation.

The by-passable expansion device is a first by-passable expansion device and the system further includes a second by-passable expansion device that is configurable to expand the liquid refrigerant to produce a mixed liquid vapor refrigerant flow into the evaporator for a cooling mode of operation. The open-circuit fluid path includes a by-passable expansion device that expands the liquid refrigerant from the receiver to produce a mixed liquid vapor refrigerant flow into the evaporator for a cooling mode of operation, and a back-pressure regulator that is disposed in the open-circuit fluid path, with the open-circuit fluid path configured to discharge refrigerant vapor such that the discharged refrigerant vapor does not return to the receiver.

The thermal management system further includes a controller to control operation of the thermal management system with the controller includes one or more processor devices, and memory operatively coupled to the one or more processor devices, and storage storing executable computer instructions that configure the controller. The controller configures the thermal management system to turn off the open-circuit refrigeration system by closing the back-pressure regulator, and configures the heat pump circuit to operate in a cooling mode to transfer heat from an applied heat load. The controller configures the thermal management system in response to a set of control signals to turn off the open-circuit refrigeration system by closing the back-pressure regulator, and configures the heat pump circuit to operate in a heating mode to transfer heat to an applied heat load. The controller configures the thermal management system to turn on the open-circuit refrigeration system by opening the back-pressure regulator.

The ejector is a first ejector, with the thermal management system further includes a second ejector that has a primary inlet, a secondary inlet, and an outlet, with the closed-circuit fluid path further including the second ejector. The thermal management system is configurable to operate the heat pump circuit in a closed-circuit cooling mode to cool a heat load in proximity to the evaporator, a closed-circuit heating mode to heat a heat load in proximity to the evaporator, or an open-circuit cooling mode to cool a heat load in proximity to the evaporator.

The thermal management system further includes a liquid separator having an inlet, a vapor-side outlet and a liquid-side outlet, with the liquid-side outlet, a check valve that inhibits refrigerant flow in a first direction and allows refrigerant flow in a second direction, with the valve coupled between the secondary inlet of the first ejector and the liquid-side outlet of the liquid separator, with the secondary inlet of the first ejector configured to receive refrigerant liquid from the liquid-side outlet of the liquid separator through the check valve during a cooling mode.

The thermal management system further includes a first by-passable expansion device that couples the first receiver port to the ejector, and a second by-passable expansion device that couples the second receiver port to the primary inlet of the second ejector.

When operating in the closed-circuit heating mode, the second ejector pumps a secondary refrigerant flow from the liquid separator using energy of a primary refrigerant flow from the receiver.

The refrigerant pressure in the condenser device is dependent, at least in part, on a secondary recirculation refrigerant flow that is entrained by a primary refrigerant flow through the second ejector in the closed-circuit heating mode.

The thermal management system is configured to operate in a closed-circuit heating mode to apply heat to a heat load coupled to the evaporator.

The second by-passable expansion device expands liquid refrigerant from the receiver to produce a mixed liquid-vapor refrigerant flow into the second ejector during the heating mode of operation. The second by-passable expansion device couples the second receiver port to the second port of the condenser device when operating in the closed-circuit heating mode to deliver refrigerant liquid from the receiver to the primary inlet of the second ejector.

The heat pump circuit further includes a four-way valve disposed in both the closed-circuit fluid path and the open-circuit fluid path. The thermal management system further includes a first flow-control valve coupled to the secondary inlet of the first ejector, and a second flow-control valve coupled to the secondary inlet of the second ejector.

The inlet of the liquid separator is coupled to a first port of the four-way valve, the vapor side outlet of the liquid separator is coupled to a second port of the four-way valve, and the liquid-side outlet of the liquid separator is in fluid flow paths with inlet ports of the first and the second flow-control valves.

The liquid refrigerant fed to the secondary inlet of the first ejector is expanded at a constant entropy in the first ejector and mixes with the mixed liquid-vapor refrigerant flow from the first by-passable expansion device to form a combined mixed liquid-vapor refrigerant that provides cooling duty to a heat load coupled to the evaporator, and which combined mixed refrigerant is discharged from the evaporator in a two-phase state having an exit vapor quality below a unit vapor quality.

The thermal management system further includes a controller to control operation of the thermal management system with the controller includes one or more processor devices, memory operatively coupled to the one or more processor devices, and storage, storing computer instructions to configure the controller.

The thermal management system further includes a four-way valve disposed in both the closed-circuit fluid path and the open-circuit fluid path. The controller configures the thermal management system to operate in a first mode that is a closed-circuit heating mode, or a second mode that is a closed-circuit cooling mode, or a third mode that is a closed-circuit and open-circuit cooling mode.

The controller selects one mode from the first and second modes and causes the thermal management system to operate in the selected mode by configuring the four-way valve.

The thermal management system further includes a back-pressure regulator, and wherein the controller configures the thermal management system to turn off the open-circuit refrigeration system by closing the back-pressure regulator, and configures the heat pump circuit to operate in a cooling mode to transfer heat from an applied heat load.

The thermal management system further includes a back-pressure regulator, and wherein the controller configures the thermal management system to turn off the open-circuit refrigeration system by closing the back-pressure regulator, and configures the heat pump circuit to operate in a heating mode to transfer heat to an applied heat load.

The thermal management system further includes a back-pressure regulator, and wherein the controller configures the thermal management system to turn on the open-circuit refrigeration system by opening the back-pressure regulator. The refrigerant is ammonia.

According to an additional aspect, a thermal management method includes transporting a refrigerant fluid along a refrigerant fluid flow path that extends from a receiver that stores the refrigerant fluid and that has a first receiver port and a second receiver port, through an evaporator that has a first evaporator port and further has a second evaporator port, through an ejector that has a primary inlet coupled to the second receiver port, a secondary inlet and an outlet, through a heat pump circuit that includes a four-way valve, a liquid separator, a compressor, a condenser that has a first condenser port and a second condenser port, with the second condenser port coupled to the first receiver port, and a liquid separator, the refrigerant fluid flow path further including an exhaust line, and operating the refrigerant fluid path according to one of three operational modes.

Embodiments of the thermal management systems may include any one or more of the following features or other features disclosed herein as may be specific to a particular one or more of the above aspects.

The three operational modes are a closed-circuit cooling mode with ejector boost, a closed-circuit heating mode, and a combined closed-circuit cooling mode and open-circuit cooling mode, with ejector boost.

The method further includes regulating vapor pressure in the exhaust line with a back-pressure regulator that has a back-pressure regulator inlet, and a back-pressure regulator outlet that is coupled to the exhaust line. The four-way valve has a first port coupled to evaporator outlet, a second port coupled to the first port of the condenser, a third port coupled to the inlet of the liquid separator, and the fourth port coupled to the compressor outlet, the method further includes generating by a controller device, a control signal to control operation of the back pressure regulator and generating by the controller device control signals to control operation of the four-way valve.

The controller configures the heat pump circuit, and the method further includes operating the heat pump circuit to either extract heat to cool a heat load or apply heat to a heat load. The method further includes closing the back-pressure regulator so that the back-pressure regulator inhibits refrigerant flow to the exhaust line, and the controller is configured to operate the four-way valve for a cooling mode by coupling the first port and the third port to be coupled and coupling the second port and the fourth port, and transferring heat from the heat load to the ambient.

The method further includes receiving by the primary inlet refrigerant fluid from the second receiver port, entraining a secondary recirculation of the refrigerant fluid received at the secondary inlet of the ejector with the received refrigerant, and outputting a mixed primary and secondary refrigerant fluid to the evaporator inlet.

The controller configures the heat pump circuit and the method further includes closing the back-pressure regulator so that the back-pressure regulator inhibits refrigerant flow to the exhaust line, and the controller is configured to operate the four-way valve for a heating mode by coupling the first port and the fourth port and coupling the second port and the third port, and heating the heat load in thermal communication with the evaporator by transferring heat from heated refrigerant fluid flow to the heat load.

The method further includes receiving by the second evaporator port refrigerant fluid from the first port of the four-way valve, outputting the refrigerant fluid received at the second port of the evaporator to a check valve to by-pass the ejector primary inlet, and receiving at the second receiver port the refrigerant fluid that by-passed the ejector.

The ejector is a first by-passable ejector, and further includes a second, by-passible ejector configured to couple the second receiver port and the second port of the condenser.

During a heating mode, the method further includes receiving by a primary ejector inlet of the second ejector refrigerant fluid from the second port of the receiver, entraining a secondary recirculation of refrigerant flow received at a secondary inlet of the second ejector from the liquid-side outlet of the liquid separator, and outputting at an outlet port of the second ejector, a mixed primary and secondary refrigerant fluid.

The second ejector is bypassed during cooling mode.

The method further includes exhausting refrigerant fluid vapor into the exhaust line, so that the refrigerant vapor that is exhausted is not returned to the refrigerant fluid flow path. The method further includes regulating vapor pressure in the exhaust line with a back-pressure regulator that has an inlet coupled to the exhaust line.

The refrigerant is ammonia.

One or more of the above aspects may include one or more of the following advantages.

The system/method enables cooling of large loads and high heat flux loads that are also highly temperature sensitive that overcome issues presented by more conventional closed-circuit refrigeration systems. Such conventional cooling of large and high heat flux loads typically involves circulating refrigerant fluid at a relatively high mass flow rate. The closed-circuit system components required by such systems include relatively large and heavy compressors to compress vapor at a low pressure to vapor at a high pressure and relatively large and heavy condensers to remove heat from the compressed vapor. In addition to being large and heavy, these components typically consume significant amounts of electrical power.

As a result, many closed-circuit systems are not well suited for deployment in mobile platforms—such as on small vehicles or in space—where size and weight constraints may make the use of large compressors and condensers impractical. Some examples of temperature sensitive loads such as electronic components and devices may require temperature regulation within a relatively narrow range of operating temperatures.

The thermal management system (TMS) described herein includes an open-circuit refrigeration system that is integrated with a closed-circuit heat pump system. More specifically the open-circuit refrigeration system is an open-circuit refrigeration system, with ejector boost that is integrated with the closed-circuit heat pump system. The presence of the open-circuit refrigeration system with ejector boost allows the ejector to pump liquid refrigerant by entraining a secondary flow of the liquid refrigerant though a primary flow through the ejector. This permits the thermal management system to maintain a temperature of a high heat load within a relatively small tolerance of a temperature set point. The TMS enables operation in a refrigeration, i.e., cooling mode, for different kinds of thermal loads such as high heat and low heat loads. High heat loads being relative to the low heat loads are loads that have high heat fluxes and that are highly temperature sensitive components, and which are operative for short periods of time. Low heat loads, relative to the high heat thermal loads, are operative continuously or for relatively long periods relative to the high heat thermal loads and are less temperature sensitive and have lower heat flux cooling requirements.

Directed energy systems that are mounted to mobile vehicles such as trucks, or exist in space, may be ideal candidates for cooling by the thermal management system presented, as such systems may include high heat flux, temperature sensitive components that require precise cooling during operation in a relatively short time. The thermal management systems disclosed herein, while generally applicable to the cooling of a wide variety of thermal loads, are particularly well suited for operation with such directed energy systems.

The disclosed TMS may be specified to cool different kinds of thermal loads—high heat thermal loads (high heat flux, highly temperature sensitive components) operative for short periods of time and low heat thermal loads (relative to the high heat thermal loads) operative continuously or for relatively long periods (relative to the high heat thermal loads). The TMS avoids the need for a relatively large and heavy refrigeration system with a concomitant need for a large and heavy power system to sustain operation of the refrigeration system), as the closed-circuit heat pump system can be sized to cool the low heat loads, which requires smaller compressors and condensers than a size needed to also accommodate the cooling requirements of the high heat loads as well, with the heat load of the high heat load being accommodated by the use of the open circuit refrigeration system with ejector boost.

In addition, the disclosed TMS may be specified to manage heating characteristics of other systems/devices to provide the disclosed TMS a heating capability for those applications in which it is necessary to bring a cold plate (or other cooling apparatus such as an evaporator) up to a proper operating temperature. The TMS integrates open-circuit refrigeration system and a closed-circuit heat pump system enabling operation in a heating mode to heat components to their proper operating temperature.

The details of one or more embodiments are set forth in the accompanying drawings and the description below.

Other features and advantages will be apparent from the description, drawings, and claims.

DESCRIPTION OF DRAWINGS

FIGS. 6A-6C are schematic diagrams showing alternative configurations for arrangement of evaporators/loads on the integrated open-circuit/closed-circuit refrigeration system, generally applicable to described embodiments.

DETAILED DESCRIPTION

I. General Introduction

Figure 1:
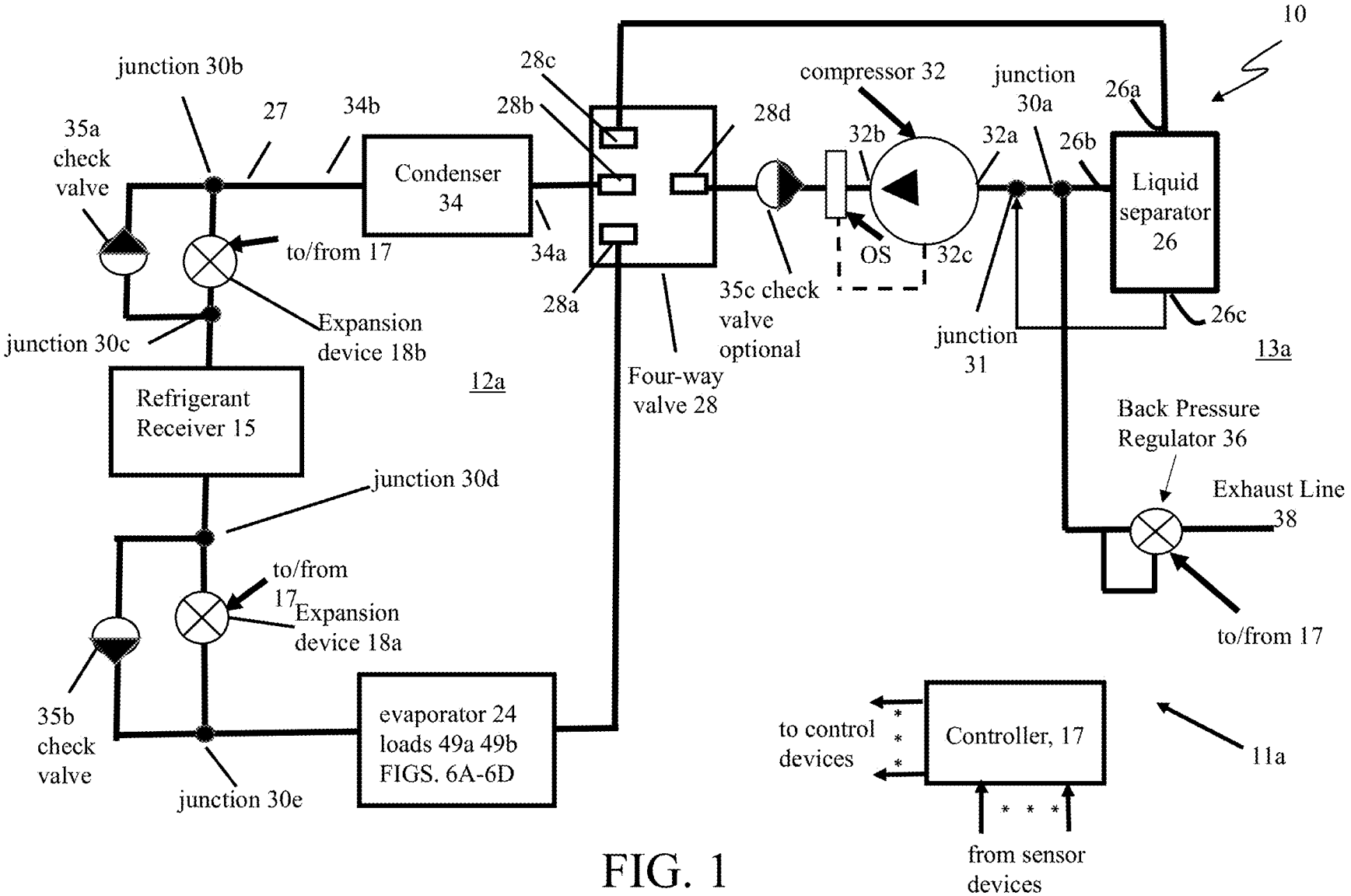
FIG. 1 is a schematic diagram of an example of a thermal management system (TMS) that includes a closed-circuit heat pump system (CCHPS) integrated with an open-circuit refrigeration system (OCRS).

Cooling of large loads and high heat flux loads that are also highly temperature sensitive can present a number of challenges. On one hand, such loads generate significant quantities of heat that is extracted during cooling. In conventional closed-circuit refrigeration systems, cooling high heat flux loads typically involves circulating refrigerant fluid at a relatively high mass flow rate. However, closed-circuit system components that are used for refrigerant fluid circulation—include large compressors to compress vapor at a low pressure to vapor at a high pressure and condensers to remove heat from the compressed vapor at the high pressure and convert to a liquid—are typically heavy and consume significant power. As a result, many closed-circuit systems are not well suited for deployment in mobile platforms—such as on small vehicles or in aerospace or outer space—where size and weight constraints may make the use of large compressors and condensers impractical. In addition, some temperature sensitive loads, such as electronic components, devices and systems, may require application of heat in order to bring such temperature sensitive loads up to a suitable operating temperature, especially upon initial start-up of such temperature sensitive loads.

On the other hand, during operation of such temperature sensitive loads, these loads may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load.

Directed energy systems that are mounted to mobile vehicles such as trucks, or exist in space, may present many of the foregoing operating challenges, as such systems may include high heat flux, temperature sensitive components that require precise cooling during operation in a relatively short time. The thermal management systems disclosed herein, while generally applicable to the cooling of a wide variety of thermal (heat) loads, are particularly well suited for operation with such directed energy systems.

In some cases, a thermal management system (TMS) may be specified to cool two different kinds of thermal loads—high heat loads (high heat flux, highly temperature sensitive components) operative for short periods of time and low heat loads (relative to the high heat loads) operative continuously or for relatively long periods (relative to the high heat loads). However, to specify a refrigeration system for the high heat load may result in a relatively large and heavy refrigeration system with a concomitant need for a large and heavy power system to sustain operation of the refrigeration system. In addition, some conventional refrigeration systems may not easily be adapted to also heating requirements those types of temperature sensitive loads that may require heating in order to bring such temperature sensitive loads up to a suitable operating temperature.

In addition, such conventional systems may not be acceptable for mobile applications. Also, start-up and/or transient processes may exceed the short period in which cooling duty is applied for the high heat loads that are operative for short periods of time. Transient operation of such conventional systems typically cannot provide precise temperature control. Therefore, thermal energy storage (TES) units are integrated with small refrigeration systems and recharging of such TES units are used instead. Still TES units may be too heavy and too large for mobile applications. In addition, such systems are complex devices and reliability may present problems especially for critical applications.

In particular, the thermal management systems and methods disclosed herein include a number of features that reduce both overall size and weight relative to conventional refrigeration systems, extract excess heat energy from both high heat flux, highly temperature sensitive components and relatively temperature insensitive components, to accurately match temperature set points for the components. In addition, these thermal management systems and methods disclosed herein easily adapt to heating requirements those types of temperature sensitive loads that may require heating in order to bring such temperature sensitive loads up to a suitable operating temperature.

At the same time, the disclosed thermal management systems that use the compressor would, in general, require less power than conventional closed-circuitry systems for a given amount of refrigeration over a specified period of operation. Whereas certain conventional refrigeration systems use closed-circuit refrigerant flow paths, the systems and methods disclosed herein use modified closed-circuit refrigerant flow paths in combination with open-circuit refrigerant flow paths to handle a variety of heat loads. Depending upon the nature of the refrigerant fluid, exhaust refrigerant fluid may be incinerated as fuel, chemically treated, and/or simply discharged at the end of the flow path.

II. Thermal Management Systems with Closed-Circuit Heat Pump Systems Integrated with Open-Circuit Refrigeration Systems Referring to FIG. 1, a thermal management system (TMS) 10 includes a closed-circuit heat pump system (CCHPS) that is integrated with an open-circuit refrigeration system (OCRS), i.e., a "CCHPOCRS" 11*a*, as shown. The CCHPOCRS 11*a* includes a CCHPS (CCHP) 12*a* and an OCRS 13*a*. The TMS 10 provides closed-circuit refrigeration for low heat loads 49*a* over long time intervals and open-circuit refrigeration for refrigeration of high heat loads 49*b* over short time intervals (relative to the interval of refrigeration of low heat load 49*a*) and at times a heating capacity to bring a cooling apparatus or a load up to a proper operating temperature.

CCHPS 12*a* includes a receiver 15 (i.e., a refrigerant receiver that is configured to store a refrigerant fluid), an optional solenoid valve (not shown), control devices 18*a* and 18*b* (e.g., expansion valve devices 18*a*, 18*b*), an evaporator arrangement 24 (evaporator 24) with detailed examples shown in FIGS. 6A-6C, and a liquid separator 26, (e.g., a suction accumulator) having an inlet 26*a*, a vapor-side outlet 26*b* and a liquid-side outlet 26*c*. The optional solenoid valve would be coupled between the expansion device 18*a* and an outlet 15*b* (not shown) of the refrigerant receiver 15. Another optional solenoid valve could be coupled between the expansion device 18*b* and an inlet 15*a* (not shown) of the refrigerant receiver 15.

Figure 1A:
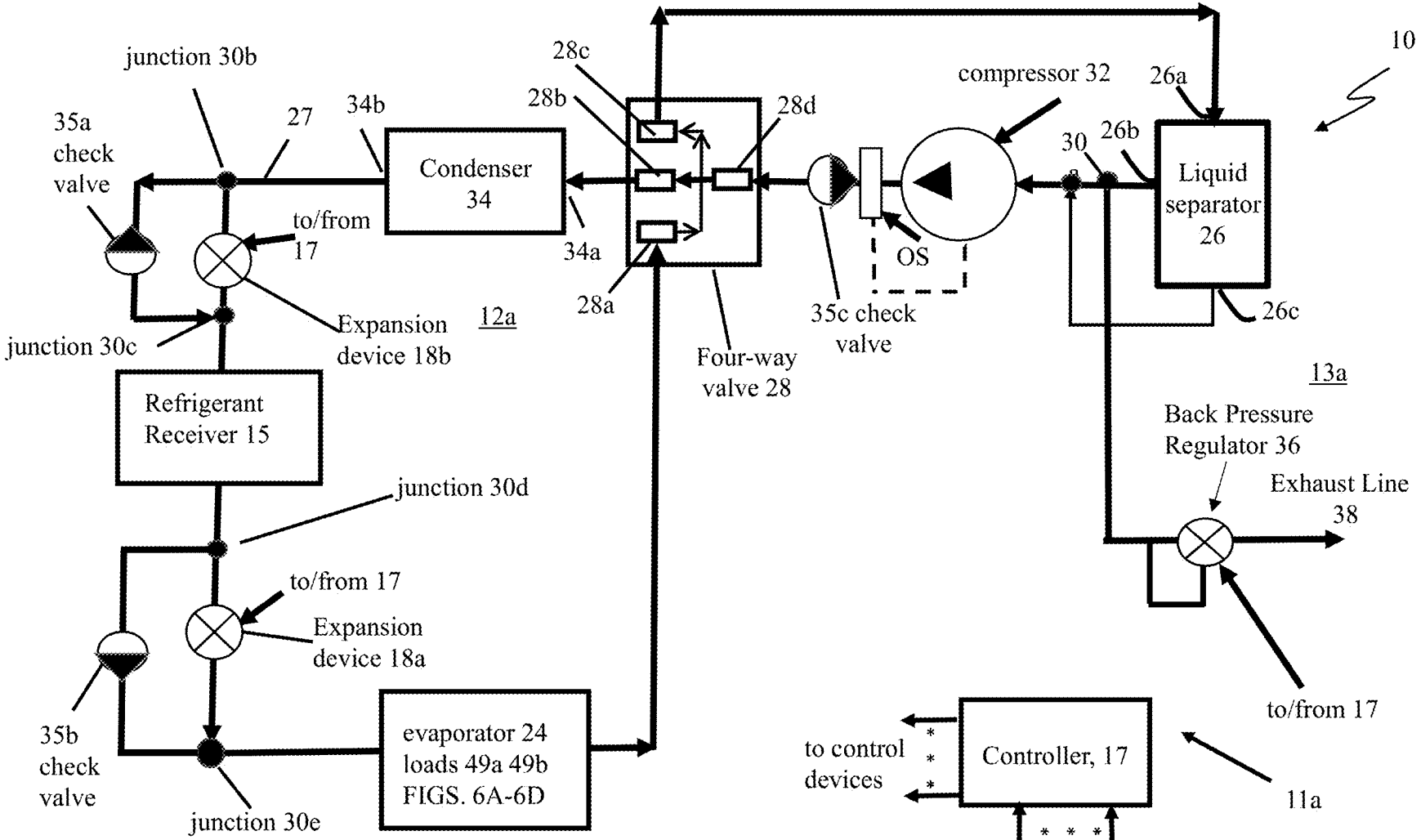
FIGS. 1A-1C are schematic diagrams showing the TMS of FIG. 1 in a closed-circuit cooling mode, a closed-circuit heating mode, and a closed-circuit/open-circuit cooling mode, respectively.
Figure 1B:
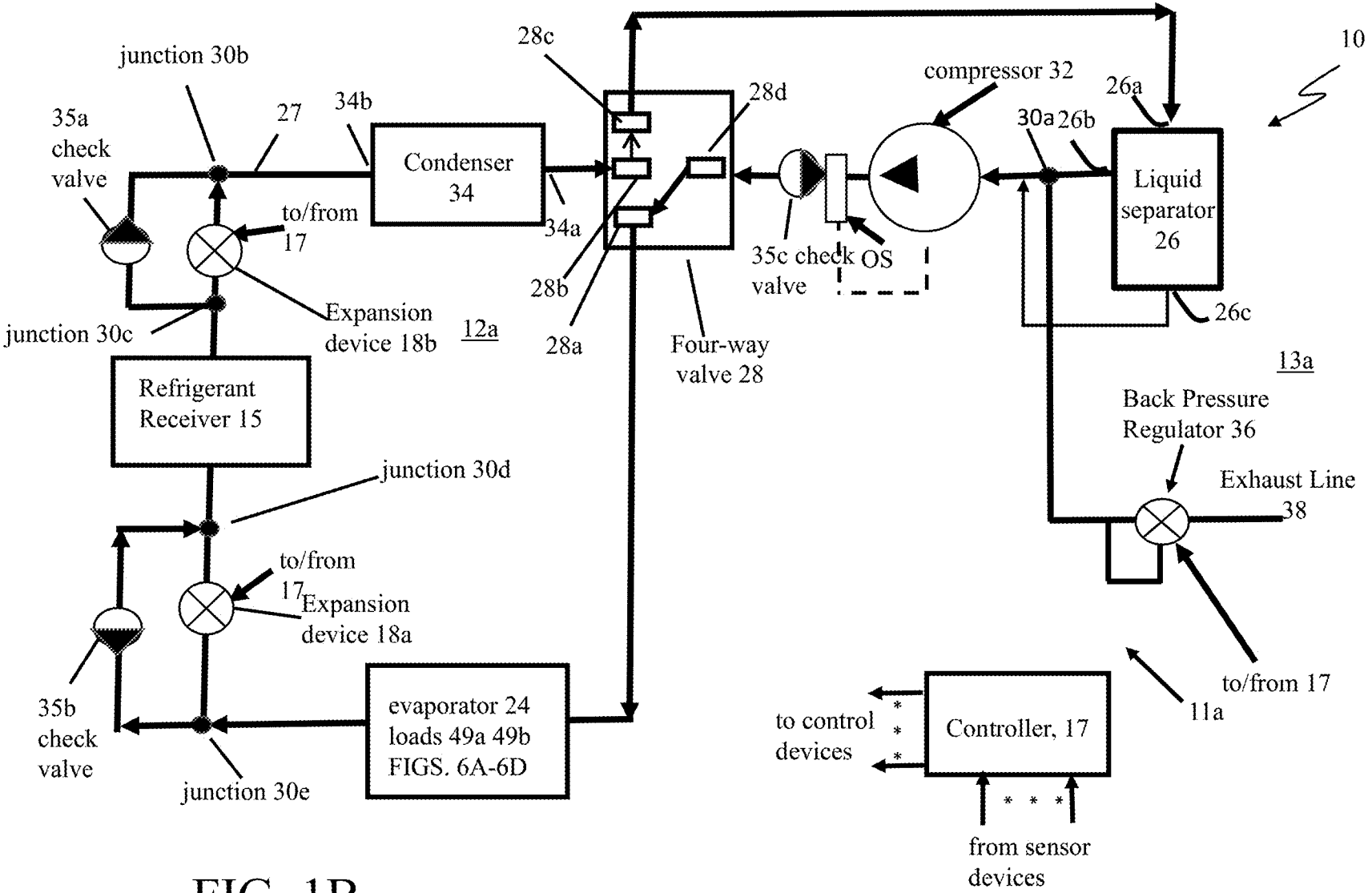
Figure 1C:
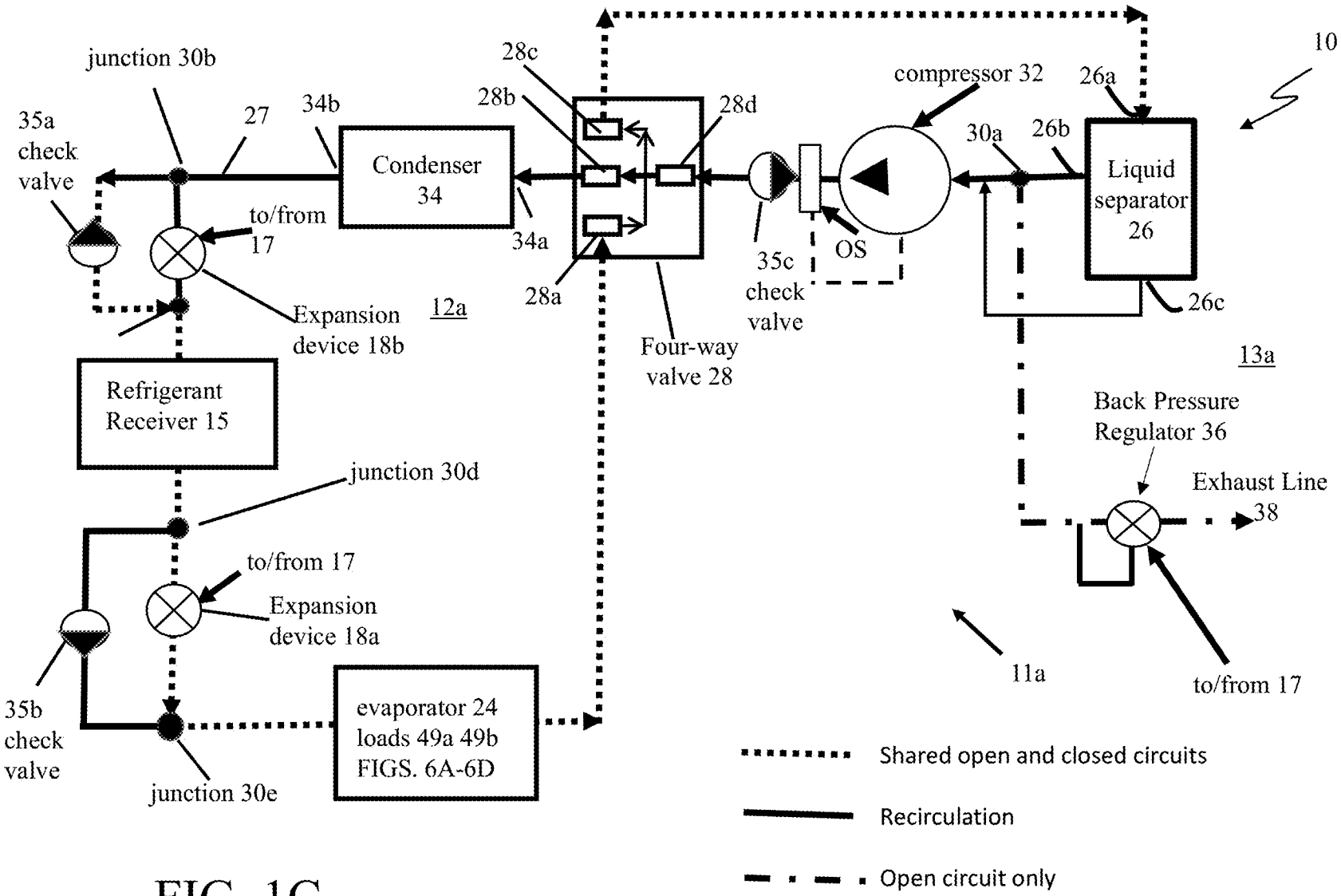
Figure 1D:
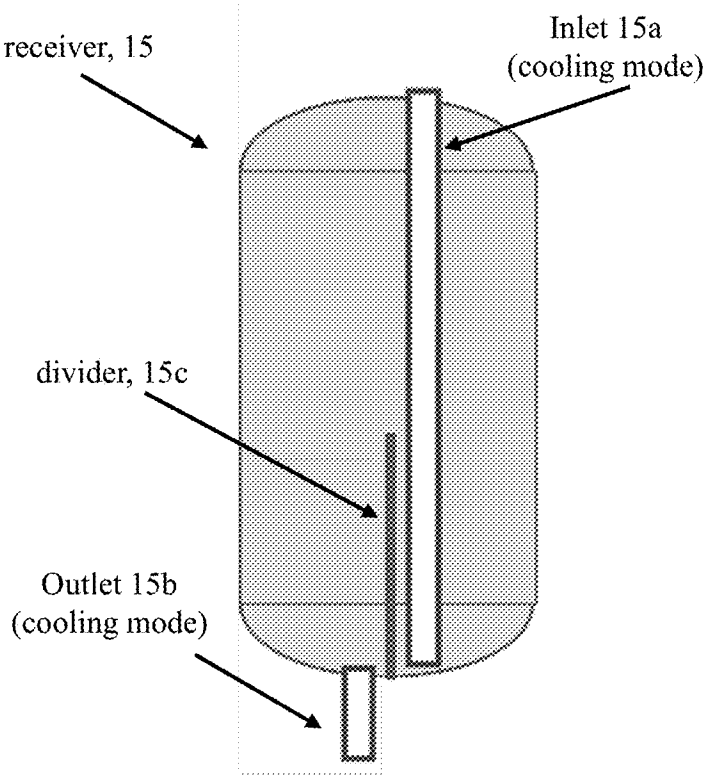
FIG. 1D is a schematic of a receiver.

FIG. 1D shows that the receiver 15 may be configured to allow exit of the liquid phase in both, cooling and heating modes. That is, a tube entering from the top (inlet 15*a* in the cooling mode and outlet 15*b* in the warming mode) is extended to the receiver bottom and does not interfere with a tube attached to the bottom (outlet 15*b* in the cooling mode and inlet 15*a* in the warming mode). This can be achieved, for example, by installation of a vertical divider 15*c* between the inlet 15*a* and the outlet 15*b*. The divider 15*c* may have orifices/perforation or a gap between edges and the receiver sides or another approach to equalize the liquid level in the receiver 15.

Referring again to FIG. 1, the CCHPS 12*a* also includes junction devices 30*a*-30*e*, a compressor 32 and a condenser 34 (or a suitable heat rejection exchanger for use in a trans-critical refrigeration system) having a first port 34*a* and a second port 34*b*, all of which are coupled via conduits (generally 27). A solenoid valve (not shown) can be used when the expansion devices 18*a*, 18*b* are not configured to completely stop refrigerant flow according to the system 10 operational state.

The CCHPS 12*a* also includes a four-way valve (reversing valve) 28 having ports 28*a*-28*d*. The four-way valve 28 is configurable to permit some of the ports 28*a*-28*d* to couple to others of the ports 28*a*-28*d*. In particular, the four-way valve 28 acts to change the direction of a refrigerant flow. The CCHPS 12*a* also includes check valves 35*a*-35*c*. The check valves 35*a*-35*c* are unidirectional valves, meaning that a fluid can flow in one direction (enters at the end that is solid black) through the valve, but is blocked from flowing in the opposite direction (blocked at the end that is solid white). The check valves 35*a*-35*b* allow bypass of the expansion valves 18*a*, 18*b* when refrigerant flows reverse direction. The first expansion device 18*a* and first check valve 35*a* may be referred to as a first by-passable expansion device. Similarly, the second expansion device 18*b* and the second check valve 35*b* may be referred to as a second by-passable expansion device. The check valve 35*c* is optional; it does not have a material impact on switching operators but instead is present to prevent back flow of liquid into the compressor outlet.

For those compressors that have built in inlet and outlet check valves, the built-in outlet check value can be used in lieu of check valve 35*c*. For a compressor that had a check valve at the outlet, the presence of two check valves may cause a conflict, and thus the check valve 35*c* would not be used. Also, a check valve can be integrated with an oil separator mechanism (discussed below). This valve does not have an impact on switching operation from cooling to heating. In the figures, the convention used to denote fluid flow is that the dark solid portion of the valve is the port of the valve that permits intake of fluid, i.e., the inlet port, with the other port outputting fluid, i.e., the outlet port, but not permitting intake of fluid. The combination of the expansion valves 18*a*, 18*b*, junctions, and check valves 35*a*, 35*b* provide by-passable expansion valve arrangements.

The OCRS 13*a* includes the receiver 15, the control device 18*a* (e.g., expansion valve device 18*a*), the evaporator 24, the four-way valve 28, the liquid separator 26, and a back-pressure regulator 36 coupled to an exhaust line 38. All of the components are coupled via conduits (generally 27).

In some implementations of the CCHPS 12*a*, an oil is used for lubrication of the compressor 32, and the oil travels with the refrigerant in the closed-circuit portion of the CCHPOCRS 11*a*. The oil can be trapped within the liquid separator 26. Therefore, the system 10 has a mechanism to return oil from the liquid separator 26, particularly, from the bottom of the liquid separator 26 to the compressor 32. An oil separator can be installed at the compressor discharge to remove oil from the refrigerant and return to the oil to the compressor 32. If an oil separator is not installed, the oil travels through the system, but the system is provided as a non-oil-pocket configuration (meaning without any significant oil accumulation regions) to enable oil to return to the compressor 32.

One mechanism to return oil is shown where the CCHPS 12*a* includes an oil separator (denoted as OS). As shown in FIG. 1, the OS is disposed in an oil return path (denoted by phantom, i.e., dashed, lines). If an oil separator is used, the check valve 35*c* is installed downstream from the oil separator. The oil return path includes conduit (not referenced) that connects, e.g., at the outlet 32*b* of the compressor 32. The OS has an inlet that receives refrigerant and oil from the outlet 32*b* of the compressor 32. The OS allows the refrigerant to pass through via OS outlet (not referenced) to an inlet (not referenced) of the check valve 35*c*. The OS also has another outlet (not referenced) to allow oil to return to an oil return inlet 32*c* of the compressor 32. The liquid-side outlet 26*c* of the liquid separator 26 has an oil return path (conduit not referenced) that can feed oil into the refrigerant path to the inlet 32*a* to the compressor 32. This oil return mechanism, although not illustrated in the remaining figures, could be used for all of the other embodiments discussed herein. Other arrangements could be used.

TMS 10 includes the CCHPOCRS 11*a* to cool heat loads 49*a*, 49*b* (shown with the evaporator 24). The heat load 49*a* is a low heat load that operates over long (or continuous) time intervals and is cooled by the CCRS 12*a*, whereas the heat load 49*b* is a high heat thermal load that operates short time intervals of time relative to the operating interval of the low heat load 49*a* and is cooled by the OCRS 13*a*.

Figure 15:
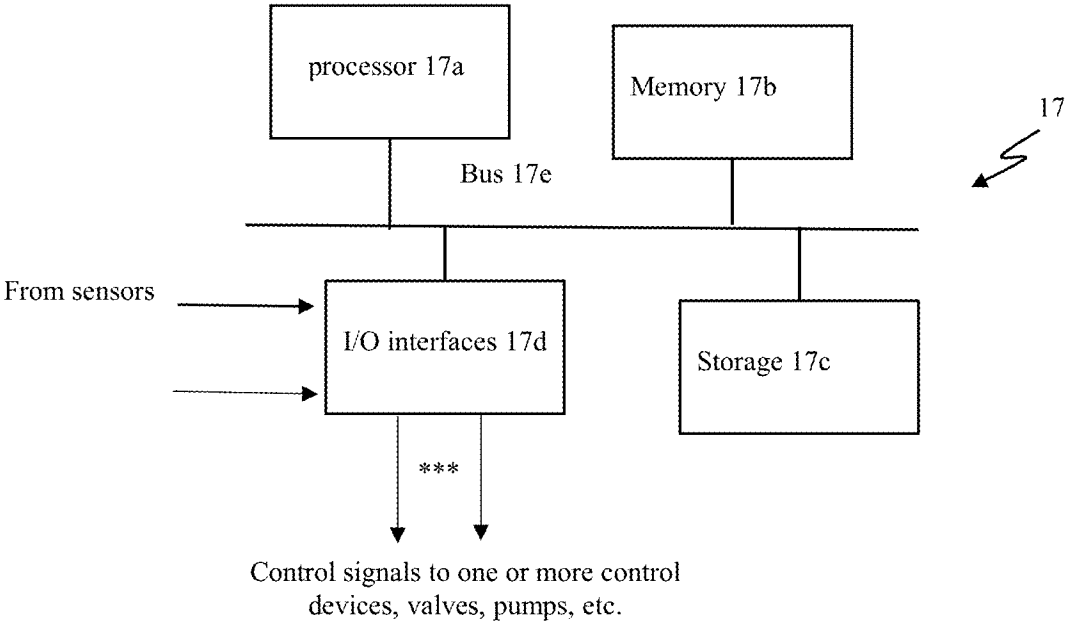
FIG. 15 is a block diagram of a controller.

In the implementations depicted herein some or all of the devices such as valves, compressor, etc. are controlled by control signals produced by a controller 17 (see FIG. 15 for an exemplary embodiment).

FIGS. 6A-6C (discussed below) illustrate specific configurations for the evaporator 24 (also referred to herein as evaporator 24) and heat loads 49*a*, 49*b*. Each of these specific configurations are generally applicable to the various embodiments discussed herein.

In the CCHPOCRS 11*a*, there are two different modes of operation of the CCHPS 12*a*. One mode is shown in FIG. 1A and the other mode is shown in FIG. 1B (where arrows in each of FIGS. 1A and 1B depict refrigerant fluid flow directions). FIG. 1A shows a cooling mode for low heat loads that operate over long time intervals. FIG. 1B shows a heating mode for low heat loads. Open-circuit refrigeration for cooling of high heat loads over short time intervals (relative to the interval of refrigeration of low heat load) occurs as a third mode of operation, as discussed below.

When describing the embodiments included herein, the ports of the various parts may be named differently based on the mode of operation (cooling vs. warming). For example, the receiver ports 15*a* and 15*b* may also be referred to a first receiver port (e.g., an inlet in either mode of operation) and a second receiver port (e.g., an outlet in either mode of operation). Similarly, the evaporator inlet and outlet ports may be referred to as first and second evaporator ports, respectively.

A. Closed-Circuit Heat Pump Operation

Cooling Mode Low Heat Loads

Referring now to FIG. 1A, in particular, the CCHPS 12*a* in a cooling mode is shown. When the CCHPS 12*a* is switched into a first cooling mode, the CCHPS 12*a* provides cooling functionality to the evaporator 24 to cool the low heat load 49*a*. In this instance, controller 17 produces signals to cause the back-pressure regulator 36 to be placed in an OFF state (i.e., closed). With the back-pressure regulator 36 closed, the CCHPS 12*a* provides cooling duty to handle the low load 49*a*.

In the cooling mode, the CCHPS 12*a* has the compressor 32 forcing a high pressure, high temperature refrigerant vapor received via the junction 30*a* from the vapor outlet 26*b*, i.e., the vapor-side of the liquid separator 26, through the check valve 35*c* and into port 28*d* of the four-way valve 28. The controller 17 (or other mechanism) causes the four-way valve 28 to deliver the high pressure, high temperature refrigerant vapor flow from port 28*d* out of port 28*b* of the four-way valve 28 and to the first port 34*a* acting as an inlet of the condenser 34. A fan or other mechanism (not shown) is used to transport ambient air or other cooling media across the condenser 34. This air will be at a cooler temperature than the vapor so that the air carries away thermal energy (heat) from the high pressure, high temperature refrigerant vapor flow. The high pressure, high temperature refrigerant vapor flow condenses as it loses its thermal energy and leaves the condenser 34 as a high pressure, lower temperature liquid refrigerant.

The high pressure, lower temperature liquid refrigerant is fed into the junction device 30*b* towards the expansion device 18*b* that is in a closed state. This high pressure, lower temperature liquid refrigerant, therefore, bypasses the expansion device 18*b* and flows through the check valve 35*a* that is positioned to allow fluid flow. The high pressure, lower temperature liquid refrigerant from the check valve 35*a* is fed into an inlet of the receiver 15, via the connection of the check valve 35*a* with the junction device 30*c*.

From the outlet of the receiver 15 liquid refrigerant flows into the junction 30*d*, the check valve 35*b* is in a position that blocks or checks fluid flow, and the expansion device 18*a* is placed in an "on state," so that the liquid refrigerant from the receiver 15 passes through the junction 30*d* and into the expansion device 18*a*. As the liquid refrigerant from the receiver 15 passes through the expansion device 18*a*, the refrigerant changes to a part liquid, part vapor refrigerant fluid mixture, which causes a drop in pressure and temperature of the refrigerant fluid. This part liquid, part vapor refrigerant fluid mixture passed through junction 30*e* and is fed to an inlet of the evaporator 24, where the refrigerant at the lower pressure and temperature causes a heat transfer from the heat load 49*a* into the refrigerant fluid, causing the refrigerant fluid to boil, and remove heat from the heat load 49*a*. The refrigerant fluid now mostly vapor leaves the evaporator 24 at evaporating pressure, preferably with a superheat, and flows into port 28*a* of the four-way valve 28. The four-way valve 28 diverts this refrigerant fluid flow into port 28*c* of the four-way valve 28. This diverted flow is fed to the inlet 26*a* of the liquid separator 26, and from the liquid separator 26 refrigerant fluid vapor is fed back into the compressor 32 to repeat the cycle.

When the high load is engaged (see discussion below), the back-pressure regulator 36 opens to prevent the evaporating pressure from rising and engages the OCRS 13*a*. In this case, usually the evaporator exit vapor quality is below the critical vapor quality as discussed below.

Heating Mode

FIG. 1B shows the CCHPS 12*a* in a heating mode. At times, the TMS 10 may have components that need to have heat applied for operation, e.g., need the capability to bring a cold plate (or other cooling apparatus such as an evaporator) up to a proper operating temperature. The CCHPS 12*a* enables operation in a heating mode, as well.

When the CCHPS 12*a* is switched into the heating mode, the CCHPS 12*a* provides heating functionality to the evaporator 24. With the low heat load 49*a* applied, the TMS 10 is configured to have the CCHPS 12*a* provide heat to the low heat load 49*a* through the evaporator 24. In this instance, controller 17 produces signals to cause the back-pressure regulator 36 to be placed in an OFF state (i.e., closed). With the back-pressure regulator 36 closed, the CCHPS 12*a* provides heating duty to handle the low load 49*a*.

In the heating mode, the CCHPS 12*a* has the compressor 32 forcing a high pressure, high temperature refrigerant vapor received, via the junction 30*a*, from the vapor-side outlet 26*b* of the liquid separator 26, through the check valve 35*c* and into port 28*d* of the four-way valve 28, i.e., the "reversing valve." The four-way valve 28 feeds the high pressure, high temperature refrigerant vapor flow from port 28*d* out of port 28*a* of the four-way valve 28 to the evaporator 24, operating as a condenser. The high pressure, high temperature refrigerant vapor transfers heat to a plate holding at least the heat load 49*a* or to another item that needs to be heated. The refrigerant leaves the evaporator 24, as a high pressure, lower temperature state and flows into the junction 30*e* and through the check valve 35*b* that is positioned in a direction to allow refrigerant flow, while the expansion device 18*a* is in a closed state, which causes the refrigerant flow to bypass the expansion device 18*a*. The refrigerant is fed into the receiver 15, via the junction 30*d*.

The check valve 35*a* is positioned in a direction that blocks or checks fluid flow, causing liquid refrigerant received from the receiver 15 to pass through the expansion valve 18*b*, via junction 30*c*, and enter the second port 34*b* acting as the inlet of the condenser 34 (during the heating mode), via junction 30*b*, and which condenser 34 is operating as an evaporator. The fan or other transport mechanism (not shown) used to transport ambient air across the condenser 34 is on in this mode. The refrigerant passes through the condenser 34 into port 28*b* of the four-way valve 28. The four-way valve 28 diverts this refrigerant flow into port 28*c* of the four-way valve 28. This diverted flow is fed to the liquid separator 26 and from the liquid separator 26 back into the compressor 32 to repeat the cycle.

Normally, the heating mode does not engage the OCRS 13*a*, however, it is possible to do engage the OCRS with this system arrangement.

B. Open/Closed-Circuit Refrigeration Operation

On the other hand, when a high heat load 49*b* is applied, a mechanism such as the controller 17 causes the CCHPOCRS 11*a* to operate in both a closed-circuit refrigeration and open-circuit refrigeration configuration.

FIG. 1C shows flow paths in the OCRS 13*a*. Depicted are portions that are recirculation of refrigerant into the receiver 15 (denoted by solid lines), shared open and closed refrigeration portions out of the receiver 15 (denoted by dotted lines), and open-circuit operation only (denoted by dotted-dash lines).

The closed-circuit, cooling portion is similar to that described above for the cooling mode, except that the evaporator 24 in this case may operate within a threshold of a vapor quality, (e.g., the evaporator may operate with a superheat provided that the liquid separator 26 captures incidental non-evaporated liquid), the liquid separator 26 receives a two-phase mixture, and the compressor 32 receives saturated vapor from the liquid separator 26.

When the CCHPOCRS 11*a* operates as open-circuit, this causes the controller 17 to cause the back-pressure regulator 36 to be placed in an ON position, opening the back-pressure regulator 36 to permit the back-pressure regulator 36 to exhaust vapor through the exhaust line 38. The back-pressure regulator 36 maintains a back-pressure at an inlet to the back-pressure regulator 36, according to a set point pressure, while allowing the back-pressure regulator 36 to exhaust refrigerant vapor through the exhaust line 38.

The OCRS 13*a* operates like a TES system, increasing cooling capacity of the TMS 10 when a pulsing heat load is activated, but without a duty cycle cooling penalty commonly encountered with TES systems. The cooling duty is executed without the concomitant penalty of conventional TES systems provided that the receiver 15 has enough refrigerant charge and the refrigerant flow rate flowing through the evaporator 24 matches the rate needed by the high load 49*b*. The back-pressure regulator 36 exhausts the refrigerant vapor less the refrigerant vapor recirculated by the compressor 32. The rate of exhaust of the refrigerant vapor through the exhaust line 38 is governed by the set point pressure used at the input to the back-pressure regulator 36.

When the high heat load 49*b* is no longer in use or its temperature is reduced, this occurrence is sensed by a sensor (not shown) and a signal from the sensor (or otherwise, such as communicated directly by the high heat thermal load) is sent to the controller 17. The controller 17 is configured to partially or completely close the back-pressure regulator 36 by changing the set point pressure (or otherwise), partially or totally closing the exhaust line 38 to reduce or cut off exhaust refrigerant flow through the exhaust line 38. When the high heat load 49*b* reaches a desired temperature or is no longer being used, the back-pressure regulator 36 is placed in the OFF status and is thus closed, and CCHPS 12*a* continues to operate as needed.

The CCHPS 12*a* helps to reduce amount of exhausted refrigerant. Generally, the system 10 uses the compressor 32 to save ammonia, and it would not be desired to shut the compressor 32 off. On the other hand, in some embodiments, the CCHPOCRS 11*a* could be configured to operate in modes where the compressor is turned off and the CCHPOCRS 11*a* operates in open-circuit mode only (such as in fault conditions in the circuit or cooling requirements).

The CCHPOCRS 11*a* would generally also include the controller 17 that produces control signals (based on sensed thermodynamic properties) to control operation of various ones of devices, such as, the expansion devices 18*a* and 18*b*, the four-way valve 28, the back-pressure regulator 36, as needed, as well as the compressor 32, etc. Controller 17 may receive signals, process received signals and send signals (as appropriate) from/to the expansion devices 18*a*, 18*b*, and a motor of the compressor 32, changing its speed, shutting it off, or starting it, for example.

As used herein a compressor is, in general, a device that increases the pressure of a gas by reducing the gas' volume. Usually the term compressor refers to devices operating at and above ambient pressure, (some refrigerant compressors may operate inducing refrigerant at pressures below ambient pressure, e.g., desalination vapor compression systems employ compressors with suction and discharge pressures below ambient pressure).

Solenoid control valves (not shown) can be used to stop refrigerant flow as on/off valves, if the expansion valves 18*a*, 18*b* cannot shut off fluid flow, robustly, and in which case the controller 17 would also control such solenoid control valves.

Expansion valves/devices 18*a*, 18*b* function as a flow-control devices and, in particular, as refrigerant expansion devices. In general, expansion valves 18*a*, 18*b* can be implemented as any one or more of a variety of different mechanical and/or electronic devices. For example, in some embodiments, expansion valves 18*a*, 18*b* can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow-control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb transfers the pressure in the bulb through the chamber to the diaphragm, and moves the diaphragm and the seat to close or to open the orifice.

Typical electrically controlled expansion valves include an orifice, a moving seat, a motor or actuator that changes the position of the seat with respect to the orifice, a controller, and pressure and temperature sensors at the evaporator exit.

Examples of suitable commercially available expansion valves that can function as expansion valve 18 include, but are not limited to, thermostatic expansion valves available from the Sporlan Division of Parker Hannifin Corporation (Washington, Mo.) and from Danfoss (Syddanmark, Denmark).

Examples of suitable commercially available expansion valves that can function as expansion valve device 18*a* include, but are not limited to, valves that are available from Robert Shaw Itasca, Ill.; Danfoss Cooling and Heating Baltimore, Md.; and other suppliers.

The controller 17 calculates the superheat for the expanded refrigerant fluid based on pressure and temperature measurements at the evaporator exit. If the superheat is above a set-point value, the seat moves to increase the cross-sectional area and the refrigerant fluid volume and mass flow rates to match the superheat set-point value. If the superheat is below the set-point value, the seat moves to decrease the cross-sectional area and the refrigerant fluid flow rates. The controller 17 may be configured to control vapor quality at the evaporator exit as disclosed below.

Described herein are several alternative types of thermal management systems with closed-circuit heat pump systems integrated with open-circuit refrigeration systems CCHPOCRS. These alternatives include ejector assisted types (FIGS. 2A-3B) and pump assisted types (FIGS. 4A-5B).

Figure 11:
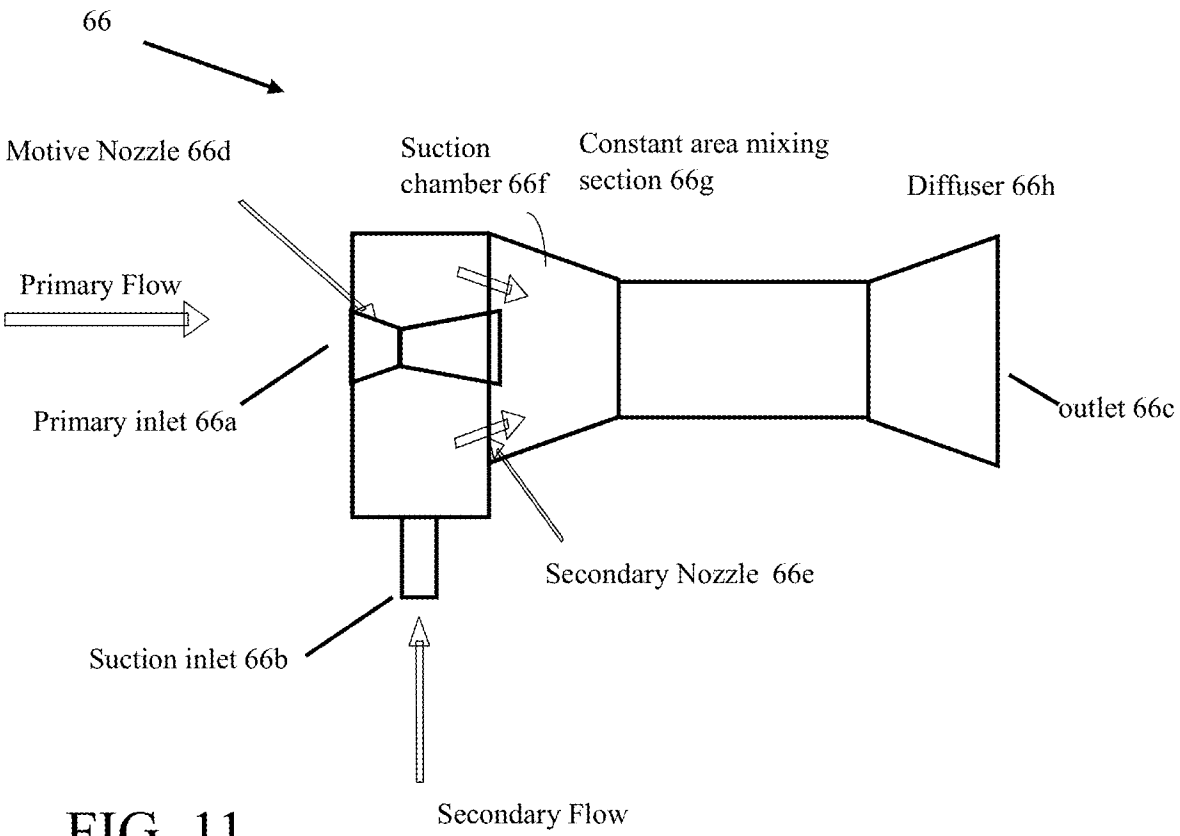
FIG. 11 is a schematic diagram of an ejector.

III. Thermal Management Systems with CCHPS Integrated with an OCRS with Ejector Assist Referring to FIG. 2A, another example of a TMS 10 includes a CCHPS 12*b* integrated with an OCRS with ejector assist 13*b*, i.e., "CCHPOCRS-EA" 11*b* is shown. The TMS 10 provides closed-circuit refrigeration for low heat loads 49*a* over long time intervals and open-circuit refrigeration for refrigeration of high heat loads 49*b* over short time intervals (relative to the interval of refrigeration of low heat loads), and at times a heating capacity to bring a cooling apparatus up to a proper operating temperature. (FIG. 11 shows a diagram of an ejector.)

Features illustrated, but not mentioned below, are mentioned in FIGS. 1 and 1A, above and in general will function in a similar manner, unless otherwise noted.

The CCHPS 12*b* includes the receiver 15, optional solenoid valves (not shown), the control devices 18*a* and 18*b* (e.g., expansion valve devices 18*a*, 18*b*), the evaporator arrangement 24 (evaporator 24) with detailed examples shown in FIGS. 6A-6C, and a liquid separator 26, having an inlet 26*a*, a vapor-side outlet 26*b* and a liquid-side outlet 26*c*. The CCHPS 12*b* also includes junction devices 30*a*-30*e*, the compressor 32, the four-way valve 28, and the condenser 34, all of which are coupled via conduits (generally 27).

The CCHPS 12*b* also includes an ejector 66 that has a primary inlet 66*a*, a secondary inlet 66*b* and an outlet 66*c*. The primary inlet 66*a* is coupled to an outlet of the expansion device 18*a* and the secondary inlet 66*b* is coupled to an outlet of a check valve 35*d*. The outlet 66*c* is coupled to the inlet of the evaporator 24 and inlet to check valve 35*b* via junction 30*e*. An inlet of the check valve 35*d* is coupled to the liquid-side outlet 26*c* of the liquid separator 26.

OCRS 11*b* includes the receiver 15, the control device 18*a* (e.g., expansion valve device 18*a*), the evaporator 24, the four-way valve 28, the liquid separator 26, the back-pressure regulator 36, and the ejector 66, all of which are coupled via conduits (generally 27).

TMS 10 includes the CCHPOCRS-EA 11*b* and heat loads 49*a*, 49*b* (shown with the evaporator 24). FIGS. 6A-6C (discussed below) illustrate specific configurations for the evaporator 24 and heat loads 49*a*, 49*b*. Each of these specific configurations are generally applicable to all of the various embodiments discussed herein. Some implementations have some or all of the devices such as valves, compressor, etc. controlled by control signals produced by the controller 17.

Figure 2A:
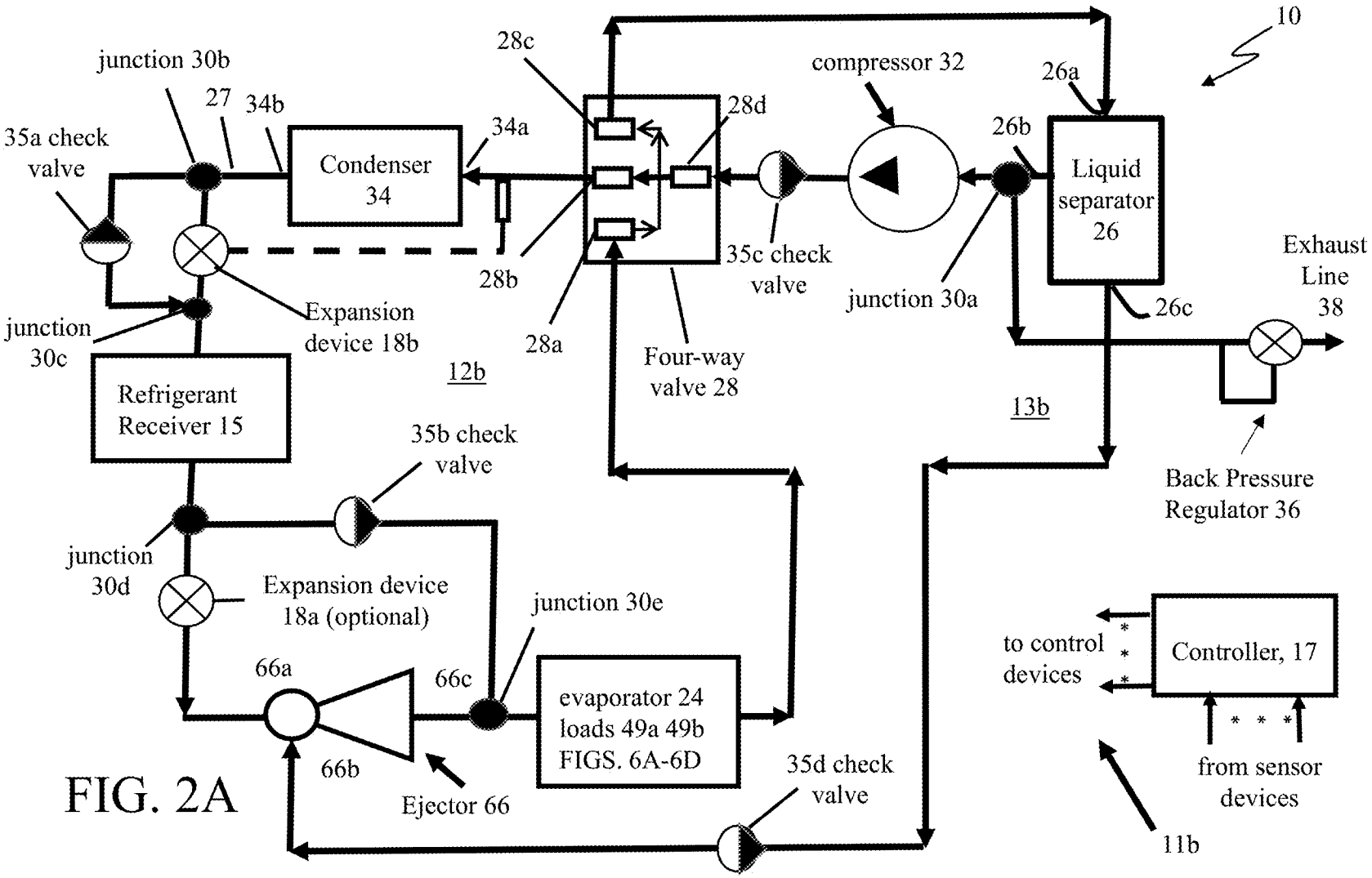
FIGS. 2A and 2B are schematic diagrams showing an alternative integrated CCHPS integrated with an OCRS with an ejector boost, in a cooling mode and heating mode respectively.
Figure 2B:
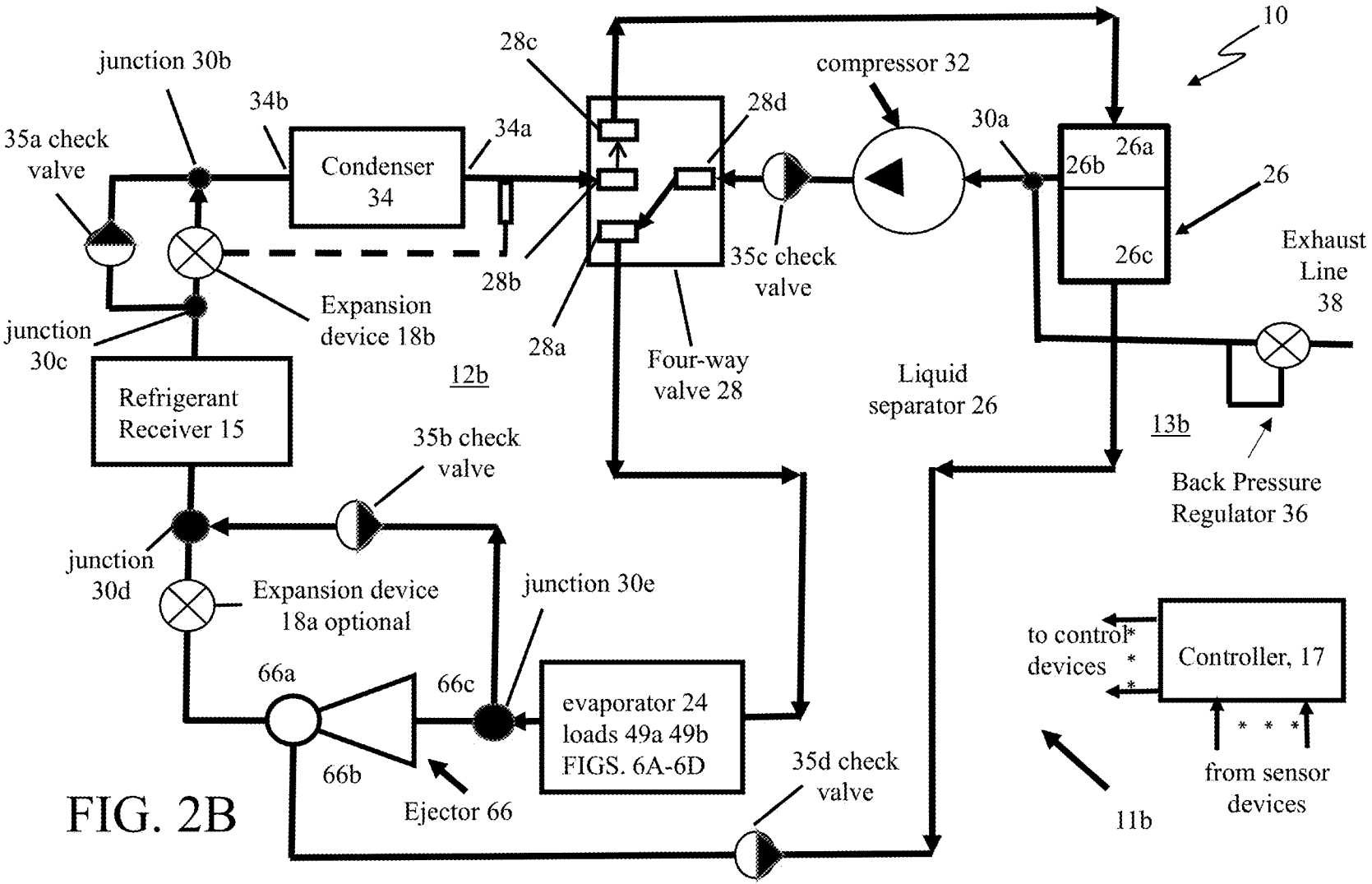

In the CCHPOCRS-EA 11*b*, there are two different modes of operation of the CCRS 12*b*. One mode is a cooling mode as shown in FIG. 2A, which has two sub-modes of operation, closed and closed/open refrigeration. The other mode is a heating mode, as shown in FIG. 2B. Arrows in each of FIGS. 2A and 2B depict refrigerant fluid flow directions.

A. Closed-Circuit Heat Pump with Ejector Operation Cooling Mode Low Heat Loads FIG. 2A, in particular, shows the CCHPS 12*b* in a cooling mode to cool the low heat load 49*a*. The controller 17 (see FIG. 15 for an exemplary embodiment) produces signals to cause the back-pressure regulator 36 to be placed in an OFF state (i.e., closed) and the CCHPS 12*b* provides cooling functionality to the evaporator 24.

In the cooling mode, the CCHPS 12*b* has the compressor 32 forcing a high pressure, high temperature refrigerant vapor received, via junction 30*a*, from the vapor-side outlet 26*b* of the liquid separator 26, through the check valve 35*c* and into port 28*d* of the four-way valve 28, as discussed in FIG. 1A. The controller 17 (or other mechanism) causes the four-way valve 28 to deliver compressed high temperature refrigerant vapor flow out of port 28*b* of the four-way valve 28 to the first port 34*a* of the condenser 34. A fan or other mechanism (not shown) is used to transport ambient air or other cooling media across the condenser 34. This air will be at a cooler temperature than the vapor so the air carries away thermal energy (heat) from the compressed high temperature refrigerant vapor. The compressed high temperature refrigerant vapor condenses as it loses its thermal energy and leaves the condenser 34 as a high pressure, lower temperature liquid refrigerant.

The high pressure, lower temperature liquid refrigerant is fed, via junction 30*b*, towards the expansion device 18*b* that is in a closed state. The high pressure, lower temperature liquid refrigerant bypasses the expansion device 18*b* due to the presence of the check valve 35*a* that is positioned in a direction to allow fluid flow. The high pressure, lower temperature liquid refrigerant from the check valve 35*a* is fed, via junction 30*c*, into the inlet of the receiver 15.

At the outlet side of the receiver 15, the check valve 35*b* is positioned to block or check fluid flow, while the expansion device 18*a* is in an 'on' state. Thus, the liquid refrigerant from the receiver 15 passes through the expansion device 18*a*, via junction 30*d*. As the liquid refrigerant from the receiver 15, via junction 30*d*, passes through the expansion device 18*a* that is in the open state, the refrigerant changes to a part liquid, part vapor refrigerant fluid mixture which causes a drop in pressure and temperature of the refrigerant fluid. This part liquid, part vapor refrigerant fluid mixture from the expansion device 18*a* is fed to the ejector primary inlet 66*b*. The liquid-side outlet 26*c* of the liquid separator 26 is coupled to the secondary inlet 66*b* (low-pressure inlet) of the ejector 66.

The pressure in the evaporator 24 depends on the evaporating temperature, which is lower than the thermal load temperature, and is defined during design of the system, as well as subsequent recirculation of refrigerant from the check valve 35*d*, which secondary flow is entrained by the primary flow. The system 10 is operational in the open-circuit configuration as long as the receiver-to-evaporator pressure difference is sufficient to drive adequate refrigerant fluid flow through the ejector 26.

In this configuration, the ejector 66 acts as a "pump," to "pump" a secondary fluid flow, e.g., liquid from the liquid-side outlet 26*c* of the liquid separator 26, which passes through check valve 35*d* using energy of the primary refrigerant flow at the primary inlet and which originates from the expansion device 18*a*. The liquid refrigerant fed to the ejector 66 is expanded at a constant entropy in the ejector 66 (in an ideal case; in reality the nozzle is characterized by the ejector isentropic efficiency), and turns into a two-phase (liquid/vapor) state. The refrigerant in the two-phase state exits the ejector outlet 66*c* and enters the evaporator 24 via junction 30*e*. The evaporator 24 provides cooling duty and discharges the refrigerant in a two-phase state at an exit vapor quality (fraction of vapor to liquid) below a unit vapor quality ("1").

In the evaporator 24, the refrigerant is at the lower pressure and temperature, and captures heat from the heat load 49*a* causing a heat transfer from the heat load 49*a* into the refrigerant fluid that boils and thus removes heat from the heat load. The refrigerant fluid, now mostly vapor, leaves the evaporator 24 as a low pressure, lower temperature vapor, at a vapor quality at almost 1 (the critical vapor quality, discussed below), and flows into port 28*a* of the four-way valve 28. The four-way valve 28 diverts this refrigerant fluid flow into port 28*c* of the four-way valve 28. This diverted flow is fed to the liquid separator 26, and from the liquid separator 26 refrigerant fluid vapor is fed back into the compressor 32 to repeat the cycle.

Heating Mode

FIG. 2B shows the CCHPS 12*b* in a heating mode. At times, the TMS 10 may have components that need to have heat applied for operation, as explained above. In a heating mode, the CCHPS 12*b* is configured to provide heat to the low heat load 49*a* through the evaporator 24. In this mode, the evaporator 24 operates as a condenser at a high (discharge or condensing) pressure. In this instance, controller 17 produces signals to cause the back-pressure regulator 36 to be placed in an OFF state (i.e., closed).

The CCHPS 12*b* has the compressor 32 forcing a high pressure, high temperature refrigerant vapor from the vapor-side 26*b* of the liquid separator 26 through the check valve 35*c*, and into port 28*d* of the four-way valve 28, i.e., "reversing valve." The four-way valve 28 feeds the high pressure, high temperature refrigerant vapor flow out of port 28*a* of the four-way valve 28 to the evaporator 24. The evaporator 24 operates as a condenser in this heating mode, by condensing the high pressure refrigerant and rejecting heat to the heat load 49*a* that requires heating. That is, the high pressure, high temperature refrigerant vapor transfers heat to the heat load 49*a*.

The refrigerant leaves the evaporator 24 in a high pressure, lower temperature state and flows into junction 30*e*, into the check valve 35*b* that is positioned in a direction to allow refrigerant flow, while the expansion device 18*a* is in a closed state, which causes the refrigerant flow to bypass the expansion device 18*a* and the ejector 66. The refrigerant is fed to the receiver 15, via junction 30*d*. The check valve 35*a* is positioned in a direction that blocks or checks fluid flow, causing liquid refrigerant from the receiver 15 to pass through the expansion valve 18*b*, via junction 30*c* and into the condenser 34, via junction 30*b*.

Liquid at the high pressure is expanded in the expansion device 18*b* at a constant enthalpy, and turns into liquid and vapor mixture at the low pressure, and the mixture fills the condenser 34. In the condenser 34, operating as an evaporator, the refrigerant evaporates at a low pressure. Port 28*b* of the four-way valve 28 receives the refrigerant from the condenser 34. The four-way valve 28 diverts this refrigerant from port 28*b* to port 28*c* of the four-way valve 28. This diverted refrigerant is fed to the inlet 26*a* of the liquid separator 26, and from the vapor-side outlet 26*b* of the liquid separator 26 into the compressor 32 to repeat the cycle.

In this mode, the condenser 34 operates as an evaporator, and a low (suction or evaporation) pressure (relative to the high pressure at the evaporator 24) is maintained from the expansion device 18*b* port connected to the condenser 34 to the compressor suction (port 26*a* of the liquid separator 26). The expansion valve 18*b* controls expansion of the refrigerant to provide a superheat at the inlet to the condenser 34 (which in this heating mode acts as the evaporator exit) to avoid accumulation of liquid in the liquid separator 26 during the heating mode. When closed, the solenoid valve (or check valve) 35*d* separates high and low pressure zones.

B. Open/Closed-Circuit Refrigeration Operation

On the other hand, when a high heat load 49*b* is applied, a mechanism such as the controller 17 causes the CCHPS 12*b* to operate in both a closed and open-circuit configuration.

The closed-circuit portion 12*b* is similar to that described above for the cooling cycle, except that the evaporator 24 in this case may operate within a threshold of a vapor quality, (e.g., the evaporator may operate with a superheat provided that the liquid separator 26 captures incidental non-evaporated liquid), the liquid separator 26 receives a two-phase mixture, and the compressor 32 receives saturated vapor from the liquid separator 26.

When the CCHPOCRS-EA 11*b* operates with the OCRS 13*b*, this causes the controller 17 to cause the back-pressure regulator 36 to be placed in an ON position, opening the back-pressure regulator 36 to permit the back-pressure regulator 36 to exhaust vapor through the exhaust line 38. The back-pressure regulator 36 maintains a back-pressure at an inlet to the back-pressure regulator 36, according to a set point pressure, while allowing the back-pressure regulator 36 to exhaust refrigerant vapor through the exhaust line 38. The ejector 66 provides "pumping" of liquid back to the evaporator 24 inlet.

The CCHPOCRS-EA 12*b* operates like a TES system, increasing cooling capacity of the TMS 10 when pulsing thermal load is activated, but without a duty cycle cooling penalty commonly encountered with TES systems, as discussed above. Otherwise, the operation of the CCHPOCRS-EA 12*b* is similar to that of CCHPOCRS 11*a*, as discussed above.

The CCHPS 12*b* helps to reduce the amount of exhausted refrigerant, while the ejector 66 "pumps" liquid refrigerant. Generally, the system 10 uses the compressor 32 to save ammonia, and it would not be desired to shut the compressor 32 off. On the other hand, in some embodiments, the system 12*b* could be configured to operate in modes where the compressor 32 is turned off and the system 12*b* operates in open-circuit mode only (such as in fault conditions in the circuit or cooling requirements).

IV. Thermal Management Systems with CCHPS Integrated with an OCRS with Dual Elector Assists Referring to FIG. 3A, an example of a TMS 10 that includes an CCHPS 12*c* integrated with an OCRS 13*c* with dual ejector assist, i.e., "CCHPOCRS-D-EA" 11*c* is shown. The TMS 10 provides closed-circuit refrigeration for low heat loads over long time intervals and open-circuit refrigeration for refrigeration of high heat loads over short time intervals (relative to the interval of refrigeration of low heat load) and at times a heating capacity to bring a cooling apparatus up to a proper operating temperature.

Features illustrated but not mentioned below are mentioned in FIGS. 1 and 1A, above and in general will function in a similar manner, unless otherwise noted.

The CCHPS 12*c* includes the receiver 15, optional solenoid valve (not shown), the control devices 18*a* and 18*b* (e.g., expansion valve devices 18*a*, 18*b*), the evaporator arrangement 24 (evaporator 24) with detailed examples shown in FIGS. 6A-6C, and the liquid separator 26. The CCHPS 12*c* also includes junction devices 30*a*-30*e*, the compressor 32, the four-way valve 28, and the condenser 34, all of which are coupled via conduits (generally 27).

The CCHPS 12*c* includes the ejector 66 having the primary inlet 66*a*, secondary inlet 66*b* and outlet 66*c*. The primary inlet 66*a* is coupled to the expansion device 18*a* outlet, the secondary inlet 66*b* is coupled to a flow-control valve, such as a solenoid control valve 77*a*, and the outlet is coupled to the check valve 35*b* and the inlet of the evaporator 24, as discussed for FIGS. 2A and 2B. During heating the ejector 66 and the optional expansion device 18*a* are bypassed, whereas the expansion device 18*b* and the ejector 76 are engaged in the process. That is, as in FIG. 2B, the check valve 35*d* bypasses the ejector 66 and the expansion device 18*a* when refrigerant flow is reversed for a heating operation, as illustrated in FIG. 3B.

The CCHPS 12*c* also includes a junction device 30*f*. One port (acting as an outlet) of the junction device 30*f* is coupled to an inlet of a solenoid control valve 77*a*, with an outlet of the solenoid control valve 77*a* coupled to the secondary inlet 66*b* of the ejector 66 to allow refrigerant liquid to flow from the liquid-side outlet 26*c* of the liquid separator 26 to the secondary inlet of the ejector 66. The primary inlet 66*a* of the second ejector 66 is fed by the outlet of the expansion device 18*b* during a heating operation.

The CCHPS 12*c* also includes a second ejector 76 having a primary inlet 76*a*, a secondary inlet 76*b*, and an outlet 76*c*. Another port (acting as an outlet) of the junction device 30*f* is coupled an inlet of another flow-control valve, such as another solenoid control valve 77*b*, that has an outlet coupled to the secondary inlet 76*b* of the second ejector 76, to allow liquid flow from the liquid-side outlet 26*c* of the liquid separator 26 to the secondary inlet 76*b* of the ejector 76. (The primary inlet 76*fa* of the second ejector 76 is fed by the outlet of the expansion device 18*b* during a heating operation.) The check valve 35*a* bypasses the ejector 76 and the expansion device 18*b* during a cooling mode of operation, as in FIG. 2A.

The OCRS 13*c* includes the receiver 15, the control device 18*a* (e.g., expansion valve device 18*a*), the evaporator 24, the four-way valve 28, the liquid separator 26, the back-pressure regulator 36, and the ejector 66, all of which are coupled via conduits (generally 27).

In some implementations, some or all of the devices such as valves, compressor, etc. are controlled by control signals produced by a controller 17.

In the CCHPOCRS-D-EA 11*c*, there are two different modes of operation of the CCRS 11*a*. One mode is a cooling mode shown in FIG. 3A, which has two sub-modes, and the other mode, heating mode, is shown in FIG. 3B (where arrows in each of FIGS. 3A and 3B depict refrigerant fluid flow directions).

A. Closed-Circuit Heat Pump Operation with Two Ejectors

Cooling Mode, Low Heat Loads

Figure 3A:
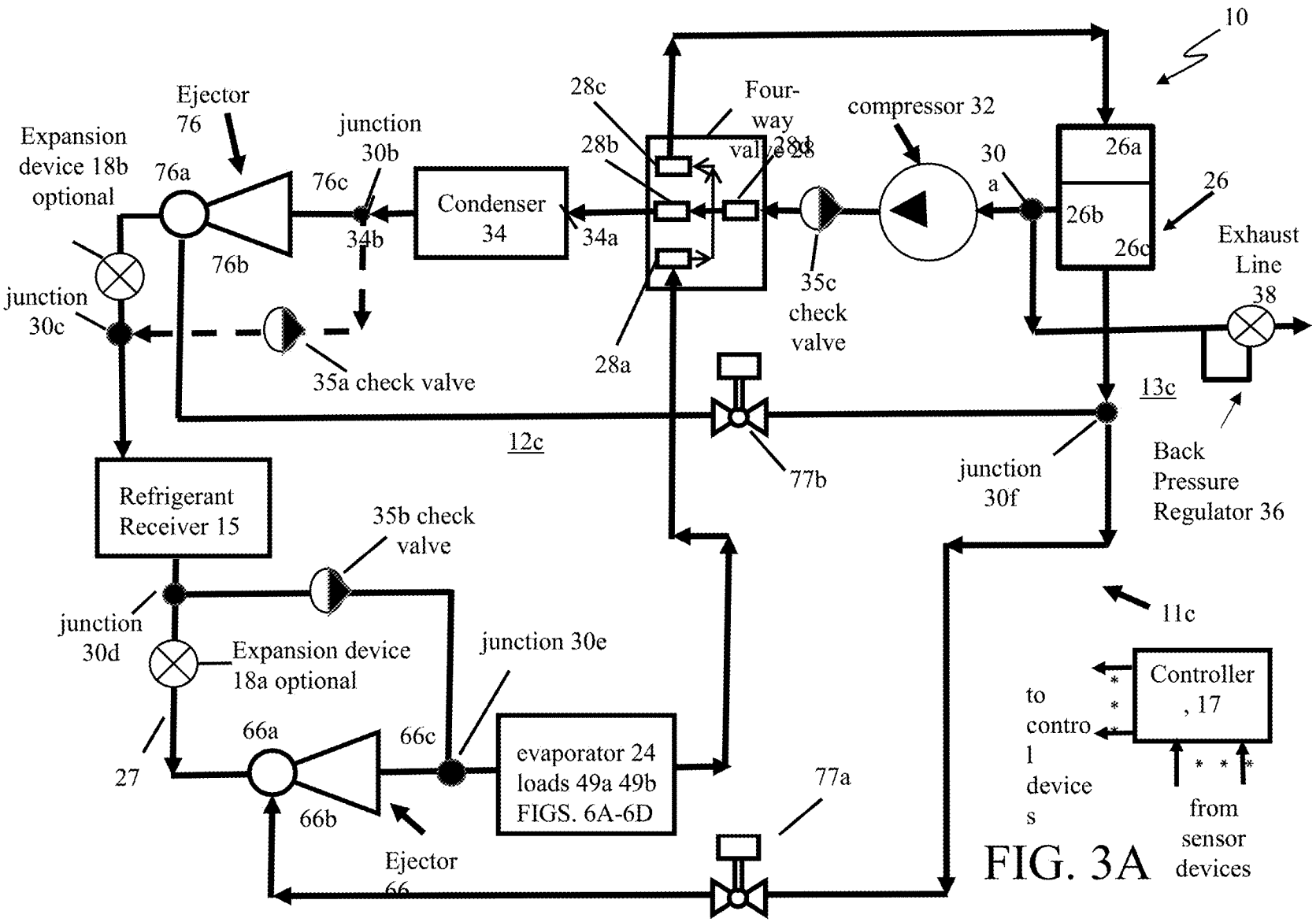
FIGS. 3A and 3B are schematic diagrams showing an alternative integrated CCHPS integrated with an OCRS with multiple ejectors in a cooling mode and a heating mode, respectively.
Figure 3B:
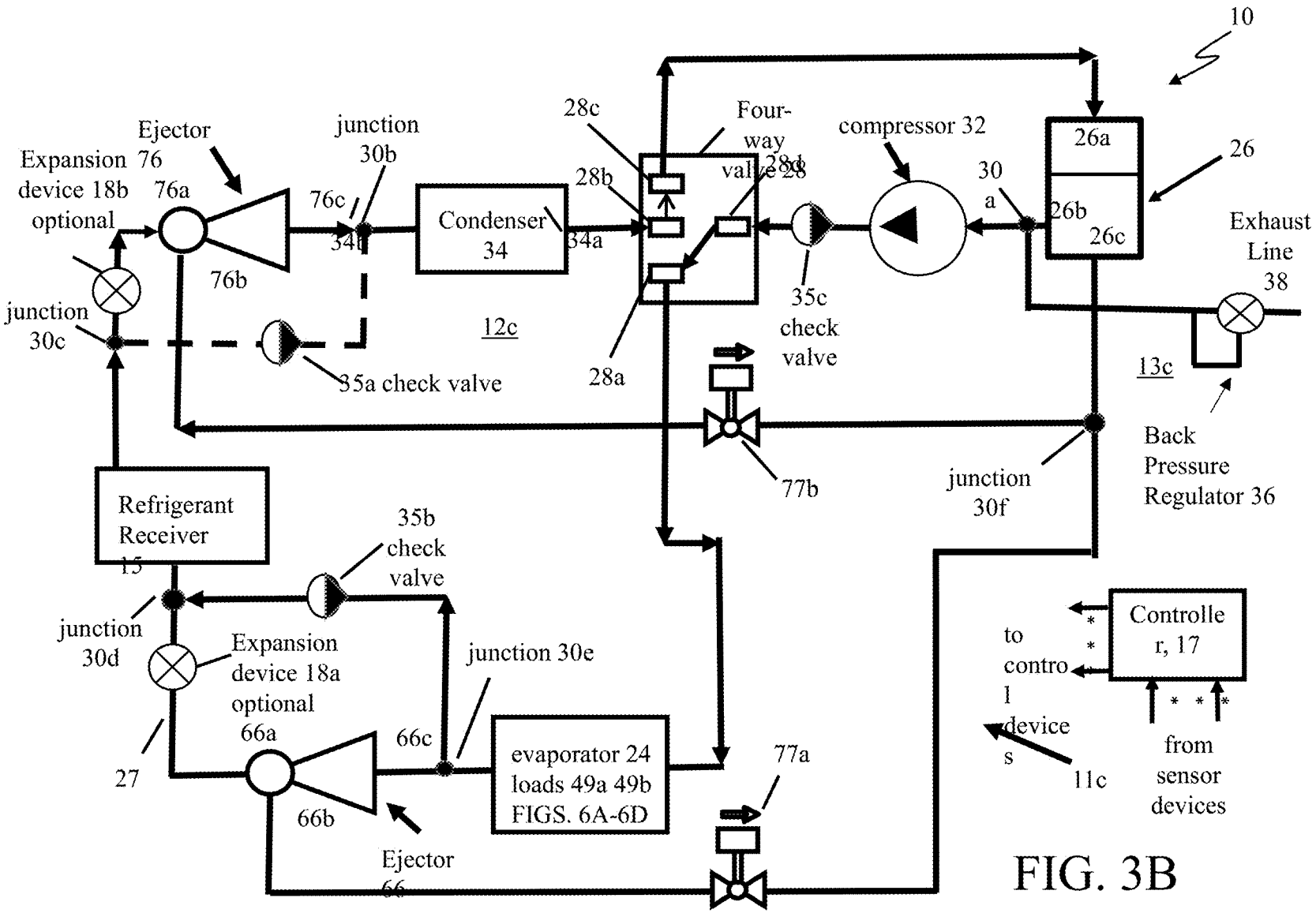

FIG. 3A, in particular, shows the CCHPS 12*c* in a cooling mode to cool the low heat load 49*a*, as discussed above. The controller 17 produces signals to cause the back-pressure regulator 36 to be placed in an OFF state (i.e., closed) and the CCHPS 12*c* provides cooling functionality to the evaporator 24. In the cooling mode, the CCHPS 12*c* has the compressor 32 forcing a high pressure, high temperature refrigerant vapor received from the vapor outlet 26*b*, i.e., the vapor-side of the liquid separator 26 through the check valve 35*c* and into port 28*d* of the four-way valve 28, as discussed in FIG. 1A, above.

The controller 17 (or other mechanism) causes the four-way valve 28 to deliver the high pressure, high temperature refrigerant vapor flow out of port 28*b* of the four-way valve 28 to the first port 34*a* of the condenser 34. A fan or other mechanism (not shown) is used to transport ambient air or other cooling media across the condenser 34. This air will be at a cooler temperature than the vapor so the air carries away thermal energy (heat) from the high pressure, high temperature refrigerant vapor flow. The high pressure, high temperature refrigerant vapor flow condenses as it loses its thermal energy and leaves the condenser 34 as a high pressure, lower temperature liquid refrigerant.

The high pressure, lower temperature liquid refrigerant is fed towards the expansion device 18*b* that is in a closed state. The high pressure, lower temperature liquid refrigerant bypasses the expansion device 18*b* and the ejector 76, due to the presence of the check valve 35*a*. In this state the solenoid control valve 77*b* is in a closed state. The high pressure, lower temperature liquid refrigerant from the check valve 35*a* is fed into the inlet of the receiver 15.

At the outlet of the receiver 15, the check valve 35*b* is in a position that blocks or checks fluid flow, while the expansion device 18*a* is in an open state, so that now liquid refrigerant from the receiver 15 passes through the expansion device 18*a*, and in the expansion device 18*a*, expands and changes to a part liquid, part vapor refrigerant fluid mixture, which causes a drop in pressure and temperature of the refrigerant fluid. This part liquid, part vapor refrigerant fluid mixture is fed to primary inlet 66*a* of the ejector 66. The liquid-side outlet 26*c* of the liquid separator 26 is coupled to the secondary inlet 66*b* (low-pressure inlet) of the ejector 66 via the solenoid control valve 77*a*.

In this configuration, the ejector 66 acts as a "pump," to "pump" a secondary fluid flow, e.g., the liquid from the liquid-side outlet 26*c* of the liquid separator 26, (with the solenoid valve 77*a* in the open state), by using energy of the primary refrigerant flow from the expansion device 18*a*. The liquid refrigerant fed to the ejector 66 is expanded at a constant entropy in the ejector 66 (in an ideal case; in reality the nozzle is characterized by the ejector isentropic efficiency), and turns into a two-phase (liquid/vapor) state. The refrigerant in the two-phase state enters the evaporator 24 that provides cooling duty and discharges the refrigerant in a two-phase state at an exit vapor quality (fraction of vapor to liquid) below a unit vapor quality ("1").

In the evaporator 24, the refrigerant at the lower pressure and temperature captures heat from the low heat load 49*a* causing a heat transfer from the low heat load 49*a* into the refrigerant fluid, causing the refrigerant fluid to boil and remove heat from the low heat load 49*a*. The refrigerant fluid now mostly vapor leaves the evaporator 24 as a low pressure, lower temperature, at a vapor quality at almost 1 (the critical vapor quality, discussed below), and flows into port 28*a* of the four-way valve 28. The four-way valve 28 diverts this refrigerant fluid flow into port 28*c* of the four-way valve 28. This diverted flow is fed to the liquid separator 26, and from the liquid separator 26 refrigerant fluid vapor is fed back into the compressor 32 to repeat the cycle.

Heating Mode

FIG. 3B shows the CCHPS 12*c* in a heating mode. At times, the TMS 10 may have components that need to have heat applied for operation, as explained above. In a heating mode, the CCHPS 12*c* is configured to have the CCHPS 12*c* provide heat to the low heat load 49*a* through the evaporator 24. The evaporator 24 operates as a condenser at a high (discharge or condensing) pressure that is maintained from the compressor discharge at the outlet to the expansion device 18*b*. In this mode, controller 17 produces signals to cause the back-pressure regulator 36 to be placed in an OFF state (i.e., closed).

The CCHPS 12*c* has the compressor 32 forcing a high pressure, high temperature refrigerant vapor from the vapor-side outlet 26*b* of the liquid separator 26 through the check valve 35*c*, and into port 28*d* of the four-way valve 28. The four-way valve 28 feeds the high pressure, high temperature refrigerant vapor flow out of port 28*a* of the four-way valve 28 to the evaporator 24. The evaporator 24 operates in this mode as a condenser by condensing the high pressure refrigerant and rejecting heat to the low heat load 49*a* that requires heating. That is, the high pressure, high temperature refrigerant vapor transfers heat to the low heat load 49*a*.

The refrigerant leaves the evaporator 24, as a high pressure, lower temperature state and flows into junction 30*e*, to the check valve 35*b* that is positioned in a direction to allow refrigerant flow, while the expansion device 18*a* is in a closed state, which causes the refrigerant flow to bypass the expansion device 18*a* and the ejector 66. The refrigerant is fed to the receiver 15. The solenoid valve 77*a* is closed and separates high pressure and the low pressure zones, with the arrow above the solenoid valve 77*a* showing the flow stop direction.

The check valve 35*a* is positioned in a direction that blocks or checks fluid flow, causing liquid refrigerant from the receiver 15 to pass through the expansion valve 18*b* into the primary inlet 76*a* of the ejector 76 and from the outlet 76*c* of the ejector 76 into the second port 34*b* of the condenser 34. The condenser 34 in this mode operates as an evaporator and low pressure is maintained from the expansion device 18*b* outlet coupled, via ejector 76, to the condenser 34 to the compressor suction inlet. The solenoid valve 77*b* is open and the flow direction is against the flow stop direction, indicated by the arrow. Liquid from receiver 15 flows to the secondary inlet 76*b* of the ejector 76. Check valves may be used instead of solenoid valves 77*a*, 77*b*. The expansion device 18*b* should control a superheat at the inlet to the condenser 34 (which in this heating mode acts as an evaporator) to avoid accumulation of liquid in the liquid separator 26 during the heating mode.

Liquid at the high pressure is expanded in the expansion device 18*b* at a constant enthalpy, turns into a liquid and vapor mixture at the low pressure, and the mixture is received at the primary inlet 76*a* of the ejector 76. Also received at the secondary inlet 76*b* of the ejector 76 is liquid from the liquid separator 26, via the solenoid valve 77*b*, that is placed in the open state, as indicated above. This mixture fills the condenser 34, and in the condenser 34, operating as an evaporator, the refrigerant evaporates at low pressure. Port 28*b* of the four-way valve 28 receives the refrigerant flow. The four-way valve 28 diverts this refrigerant flow from port 28*b* to port 28*c* of the four-way valve 28. This diverted flow is fed to the inlet 26*a* of the liquid separator 26, and from the vapor-side outlet 26*b* of the liquid separator 26 into the compressor 32 inlet to repeat the cycle.

In this mode, the condenser 34 operates as an evaporator and a low (suction or evaporation) pressure (relative to the high pressure at the evaporator 24) is maintained from the expansion device 18*b* port connected to the condenser 34 to the compressor suction (inlet 26*a* of the liquid separator 26). The expansion device 18*b* should control expansion to provide a superheat at the condenser inlet (which in this heating mode is the evaporator 24 exit) to avoid accumulation of liquid in the liquid separator 26 during the heating mode. When closed, the solenoid valves (or check valves) 77*a*, 77*b* separate high and low pressure zones.

B. Open/Closed-Circuit Refrigeration Operation

On the other hand, when a high heat thermal load 49*b* is applied, a mechanism such as the controller 17 causes the CCHPOCRS-D-EA 11*c* to operate in both a closed and open-circuit configuration.

The closed-circuit refrigeration operation is similar to that described above for the cooling cycle (FIG. 3A), except that the evaporator 24 in this case may operate within a threshold of a vapor quality, (e.g., the evaporator may operate with a superheat provided that the liquid separator 26 captures incidental non-evaporated liquid), the liquid separator 26 receives a two-phase mixture, and the compressor 32 receives saturated vapor from the liquid separator 26. When the CCHPOCRS-D-EA 11*c* operates with the open-circuit, this causes the controller 17 to cause the back-pressure regulator 36 to be placed in an ON position, opening the back-pressure regulator 36 to permit the back-pressure regulator 36 to exhaust vapor through the exhaust line 38. The back-pressure regulator 36 maintains a back-pressure at an inlet to the back-pressure regulator 36, according to a set point pressure, while allowing the back-pressure regulator 36 to exhaust refrigerant vapor through the exhaust line 38.

The CCHPOCRS-D-EA 11*c* also operates like a TES system, increasing cooling capacity of the TMS 10 when a pulsing thermal load is activated, but without a duty cycle cooling penalty commonly encountered with TES systems, as discussed above. Operation of the CCHPOCRS-D-EA 11*c* is otherwise similar to that of CCHPOCRS 11*a*, as discussed above.

The CCHPS 12*c* helps to reduce amount of exhausted refrigerant. Generally, TMS 10 uses the compressor 32 to save ammonia, and it would not be desired to shut the compressor 32 off. On the other hand, in some embodiments TMS 10 could be configured to operate in modes where the compressor is turned off and TMS 10 operates in open-circuit mode only (such as in fault conditions in the circuit or cooling requirements).

V. Thermal Management Systems with CCHPS Integrated with an OCRS with Pump Assist Referring to FIG. 4A, an example of TMS 10 that includes an CCHPS 12*d* integrated with an OCRS with pump overfeed 13*d*, i.e., "CCHPOCRS-PA" 11*d* is shown. The TMS 10 provides closed-circuit refrigeration operation for low heat loads over long time intervals and open-circuit refrigeration operation for high heat loads over short time intervals (relative to the interval of refrigeration of low heat load) and at times a heating capacity to bring a cooling apparatus up to a proper operating temperature.

Figure 4A:
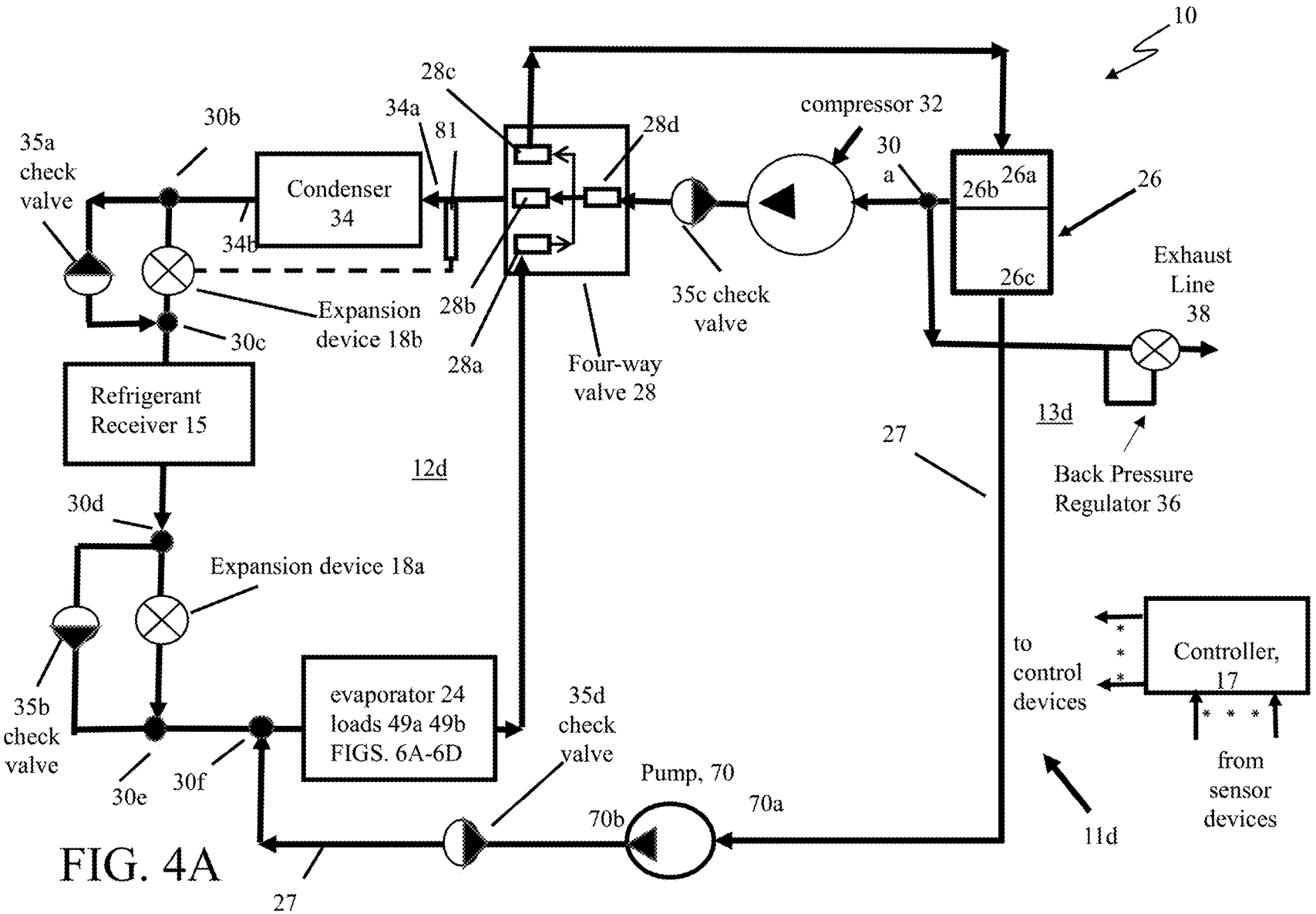
FIGS. 4A and 4B are schematic diagrams showing another alternative integrated CCHPS integrated with an OCRS with pump assist in a cooling mode and a heating mode, respectively.

Features illustrated but not mentioned below are mentioned in FIGS. 1 and 1A, above and in general will function in a similar manner, unless otherwise noted. FIG. 4A illustrates the CCHPOCRS-PA 11*d* in a cooling mode (closed-circuit).

The CCHPS 12*d* includes the receiver 15, optional solenoid valve (not shown), the control devices 18*a* and 18*b* (e.g., expansion valve devices 18*a*, 18*b*), the evaporator arrangement 24 (evaporator 24) with detailed examples shown in FIGS. 6A-6C, and a liquid separator 26, having an inlet 26*a*, a vapor-side outlet 26*b* and a liquid-side outlet 26*c*. The CCHPS 12*d* also includes junction devices 30*a*-30*f*, the compressor 32, the four-way valve 28, and the condenser 34, all of which are coupled via conduits (generally 27). The CCHPS 12*d* also includes a pump 70 that has an inlet 70*a* that pumps liquid from the liquid-side outlet 26*c* of the liquid separator 26. The pump 70 has an outlet 70*b* coupled to a check valve 35*d* that has an outlet coupled to a port of the junction device 30*f*. The junction device 30*f* is coupled to another junction device 30*e* that is coupled to an outlet of the expansion device 18*a* and an inlet side of a check valve 35*b*. The junction device 30*f* is coupled to the inlet of the evaporator 24. The check valve 35*b* bypasses the expansion device 18*a* when refrigerant flow is reversed for a heating operation. A sensor 81 is disposed at the condenser 34 inlet to measure a thermodynamic property of the refrigerant fluid flow between the condenser 34 and the four-way valve 28.

The OCRS 13*d* includes the receiver 15, the control device 18*a* (e.g., expansion valve device 18*a*), the evaporator 24, the four-way valve 28, the liquid separator 26, the back-pressure regulator 36, and the pump 70, all of which are coupled via conduits (generally 27). The control devices 18*a*, 18*b*, valve 28, compressor 32, pump 70, etc., may be controlled by controller 17.

Figure 4B:
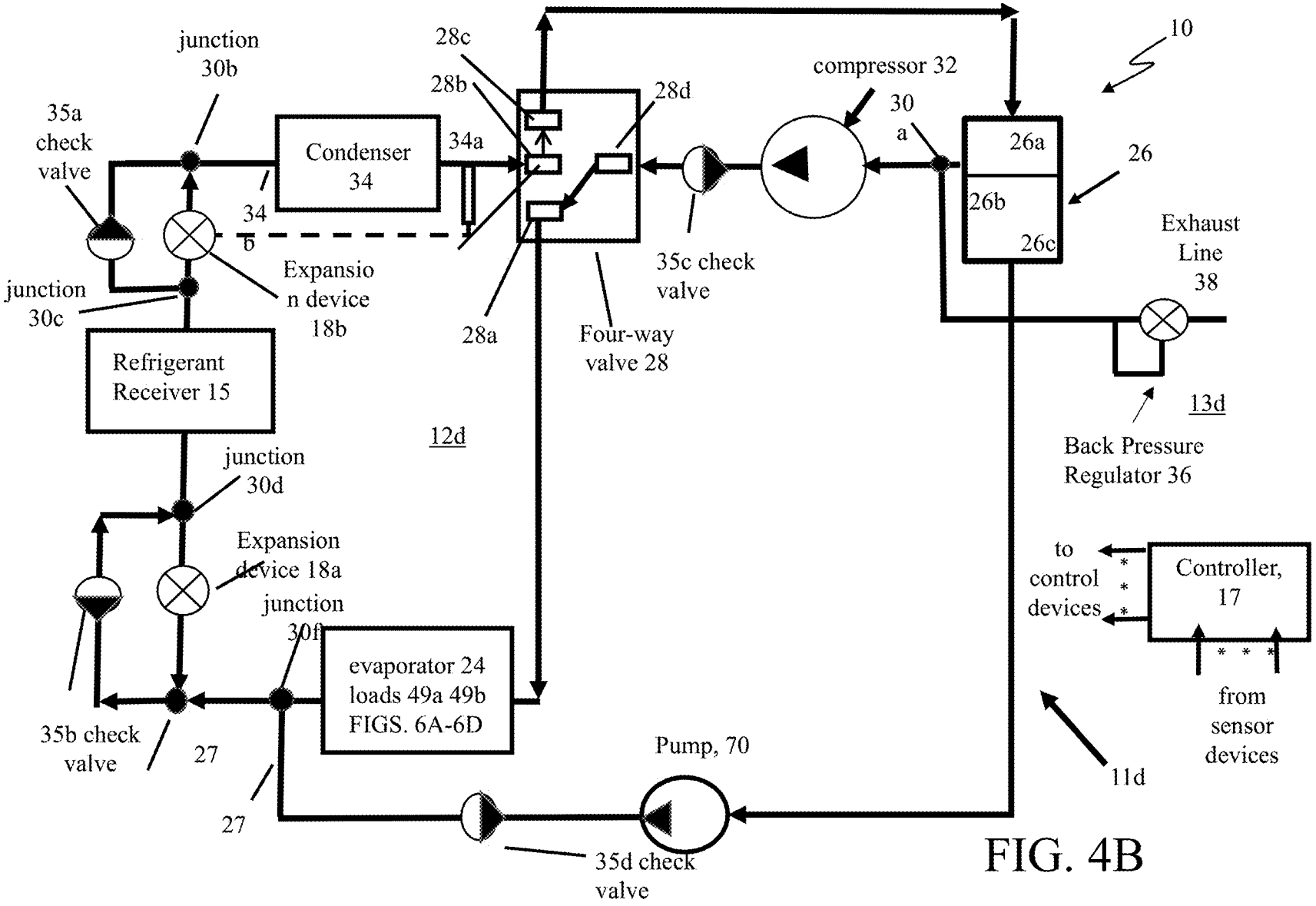

FIG. 4B illustrates the CCHPOCRS-PA 11*d* in a heating mode (closed-circuit). In CCHPOCRS-PA 11*d*, the pump 70 can operate across a reduced pressure differential (pressure difference between inlet and outlet of the pump 70). In the context of open-circuit refrigeration systems, the use of the pump 70 allows for some recirculation of liquid refrigerant from the liquid separator 26 to enable operation at reduced vapor quality at the evaporator 24 outlet, that also avoids discharging remaining liquid out of the system at less than the separation efficiency of the liquid separator 26 allows. This recirculation reduces the required amount of refrigerant needed for a given amount of cooling over a given period of operation. The configuration above reduces the vapor quality at the evaporator 24 inlet and thus may improve refrigerant distribution (of the two phase mixture) in the evaporator 24.

During start-up CCHPOCRS-PA 11*d* needs to charge the evaporator 24 with liquid refrigerant. By placing the evaporator 24 between the outlet of the expansion device 18*a* and the inlet 26*a* of the liquid separator 26, this configuration necessitates having liquid refrigerant first pass through the liquid separator 26 during the initial charging of the evaporator 24 with the liquid refrigerant. At the same time, liquid refrigerant that is trapped in the liquid separator 26 may be wasted after the CCHPOCRS-PA 11*d* shuts down.

Various types of pumps can be used for pump 70. Exemplary types include gear, centrifugal, or rotary vane, types, etc. When choosing a pump, the pump should be capable to withstand the expected fluid flows, including criteria such as temperature ranges for the fluids, and materials of the pump should be compatible with the properties of the fluid. A subcooled refrigerant can be provided at the pump 70 outlet to avoid cavitation. To do that a certain liquid level in the liquid separator 26 may provide hydrostatic pressure corresponding to that sub-cooling.

A. Closed-Circuit Refrigeration Operation with Pump

Cooling Mode Low Heat Loads

FIG. 4A, in particular, shows the CCHPOCRS-PA 11*d* in a cooling mode to cool the low heat load 49*a*. The controller 17 produces signals to cause the back-pressure regulator 36 to be placed in an OFF state (i.e., closed) and the CCHPS 12*d* provides cooling functionality to the evaporator 24. In the cooling mode, the CCHPS 12*d* has the compressor 32 forcing a high pressure, high temperature refrigerant vapor received from the vapor-side outlet 26*b* of the liquid separator 26, via junction 30*a*, through the check valve 35*c* and into port 28*d* of the four-way valve 28, as discussed in FIG. 1A, above. The controller 17 (or other mechanism) causes the four-way valve 28 to deliver the high pressure, high temperature refrigerant vapor flow out of port 28*b* of the four-way valve 28 to the first port 34*a*, acting as the inlet of the condenser 34. A fan or other mechanism (not shown) is used to transport ambient air or other cooling media across the condenser 34. This air will be at a cooler temperature than the vapor so the air carries away thermal energy (heat) from the high pressure, high temperature refrigerant vapor flow. The high pressure, high temperature refrigerant vapor flow condenses as it loses its thermal energy and leaves the condenser 34 as a high pressure, lower temperature liquid refrigerant.

The high pressure, lower temperature liquid refrigerant is fed towards the expansion device 18*b* that is in a closed state. The high pressure, lower temperature liquid refrigerant bypasses the expansion device 18*b* due to the presence of the check valve 35*a*. The high pressure, lower temperature liquid refrigerant from the check valve 35*a* is fed into the inlet of the receiver 15, via junction 30*c*.

At the receiver 15 outlet, the check valve 35*b* is in a position that blocks or checks fluid flow, and the expansion device 18*a* is in an open state, so liquid refrigerant from the receiver 15 passes through junction 30*d* to the expansion device 18*a* and is expanded at a constant enthalpy, turning the liquid refrigerant into a two-phase (liquid/vapor) mixture. This two-phase liquid/vapor refrigerant is fed to junction devices 30*e* and 30*f* and mixed in junction 30*f* with refrigerant flow pumped by the pump 70. This mixed flow enters the evaporator 24. This mixed flow provides cooling duty of a low heat load 49*a* and discharges the refrigerant in a two-phase state at a relatively high exit vapor quality (fraction of vapor to liquid). The discharged refrigerant from evaporate 24 exits the evaporator 24 and is fed to the port 28*a* of the four-way valve 28. Operation of the four-way valve 28 couples refrigerant flow from port 28*a* to port 28*c* of the four-way valve 28. Port 28*c* is coupled to the inlet 26*a* of the liquid separator 26. The liquid separator 26 thus receives the discharge refrigerant from the four-way valve 28 and separates the discharge refrigerant with only or substantially only liquid exiting the liquid separator at outlet 26*c* (liquid-side outlet) to be pumped by pump 70, and only or substantially only vapor exiting the separator 26 at the vapor-side outlet 26*b* to be compressed by the compressor 32, repeating the cycle.

Heating Mode

FIG. 4B shows the CCHPS 12*d* in a heating mode. In this instance, controller 17 produces signals to cause the back-pressure regulator 36 to be placed in an OFF state (i.e., closed). In a heating mode, the CCHPS 12*d* is configured, e.g., by the controller 17 to have the CCHPS 12*d* provide heat to the low heat load 49*a* through the evaporator 24. In this mode, the evaporator 24 operates as a condenser at a high (discharge or condensing) pressure that is maintained from the compressor discharge at the outlet to the expansion device/valve 18*b*.

The CCHPS 12*d* has the compressor 32 forcing the high pressure, high temperature refrigerant vapor from the vapor-side outlet 26*b* of the liquid separator 26 through the check valve 35*c*, and into port 28*d* of the four-way valve 28, i.e., "reversing valve." The four-way valve 28 feeds the high pressure, high temperature refrigerant vapor flow out of port 28*a* of the four-way valve 28 to the evaporator 24. The evaporator 24 operates as a condenser in this heating mode, by condensing the high pressure refrigerant and rejecting heat to the low heat load 49*a* that requires heating. That is, the high pressure, high temperature refrigerant vapor in the evaporator 24, transfers heat to the low heat load 49*a*.

The refrigerant leaves the evaporator 24 in a high pressure, lower temperature state and flows into junctions 30*e* and 30*f*, through the check valve 35*b* that is positioned in a direction to allow refrigerant flow, while the expansion device 18*a* is in a closed state. Thus, the refrigerant flow bypasses the expansion device 18*a*. Check valve 35*d* prevents backflow of refrigerant from the junction 30*f* into the outlet of the pump 70. The refrigerant from the check valve 35*b* is fed to the receiver 15, via junction 30*d*.

The check valve 35*a* is positioned in a direction that blocks or checks fluid flow, causing liquid refrigerant from the receiver 15 to pass through junction 30*c* to the expansion device 18*b* and into the condenser 34, via junction 30*b*. The condenser 34 in this mode operates as an evaporator and low pressure is maintained from the expansion device 18*b* outlet connected to the condenser 34 to the compressor suction inlet. The expansion device 18*b* should control a superheat, either directly or indirectly via the sensor 81, that senses a thermodynamic property at the inlet to the condenser 34 (which in this heating mode act as an evaporator such that the liquid flows into the outlet and out of the inlet) to avoid accumulation of liquid in the liquid separator 26 during the heating mode.

Liquid at the high pressure is expanded in the expansion device 18*b* at a constant enthalpy, turns into liquid and vapor mixture at the low pressure, and the mixture is received at the inlet condenser 34 (acting as an evaporator). In the condenser 34 (operating as an evaporator), the refrigerant evaporates at low pressure. Port 28*b* of the four-way valve 28 receives the refrigerant flow, and the four-way valve 28 diverts this refrigerant flow from port 28*b* to port 28*c* of the four-way valve 28. This diverted flow is fed to the liquid separator 26, and from the liquid separator 26 into the compressor 32 to repeat the cycle.

In this mode, the condenser 34 operates as an evaporator and at low (suction or evaporation) pressure (relative to the high pressure at the evaporator 24) is maintained from the expansion device 18*b* port connected to the condenser 34 to the compressor suction (port 26*a* of the liquid separator 26). The expansion device 18*b* should control expansion to control a superheat at the condenser 34 inlet (which in this heating mode is the evaporator exit) to avoid accumulation of liquid in the liquid separator 26 during the heating mode.

B. Open/Closed-Circuit Refrigeration Operation with Pump

On the other hand, when a high heat load 49*b* is applied, a mechanism such as the controller 17 causes the CCHPOCRS-PA 11*d* to operate in both a closed and open-circuit configuration. The closed-circuit portion would be similar to that described above under the heading "Closed-circuit Refrigeration Operation with Pump."

The OCRS 13*d* has the controller 17 configured to cause the back-pressure regulator 36 to be placed in an ON position, opening the back-pressure regulator 36 to permit the back-pressure regulator 36 to exhaust vapor through the exhaust line 38. The back-pressure regulator 36 maintains a back-pressure at an inlet to the back-pressure regulator 36, according to a set point pressure, while allowing the back-pressure regulator 36 to exhaust refrigerant vapor to the exhaust line 38.

V. Thermal Management Systems with CCHPS Integrated with an OCRS with Pump Assist Via Plural Pump Lines Referring to FIG. 5A, an example of TMS 10 that includes an CCHPS 12*e* and an OCRS 13*e*, with pump assist and multiple pump lines, i.e., "CCHPOCRS-PA-DL" 11*e* is shown. The TMS 10 provides closed-circuit refrigeration operation for refrigeration of low heat loads over long time intervals and open-circuit refrigeration operation for refrigeration of high heat loads over short time intervals (relative to the interval of refrigeration of low heat load) and at times a heating capacity to bring a cooling apparatus up to a proper operating temperature.

Features illustrated but not mentioned below are mentioned in FIGS. 1 to 4B, above and in general will function in a similar manner, unless otherwise noted.

Figure 5A:
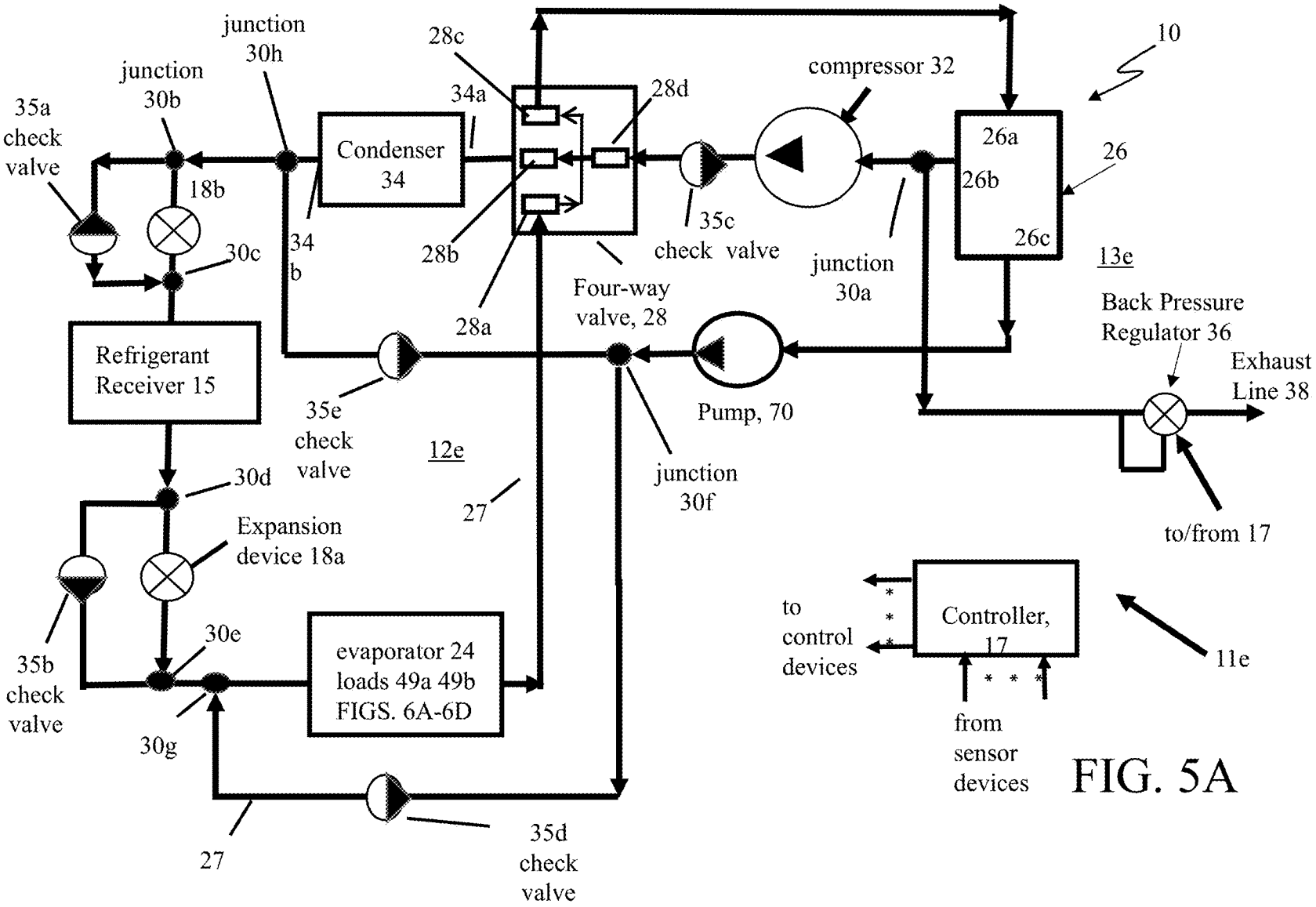
FIGS. 5A and 5B are schematic diagrams showing another alternative integrated CCHPS integrated with an OCRS having multiple pumping lines in a cooling mode and a heating mode, respectively.

FIG. 5A illustrates the CCHPOCRS-PA-DL 11*e* in a closed-circuit cooling mode. The CCHPOCRS-PA-DL 11*e* includes a CCHPS 12*e* and an OCRS 13*e*. The CCHPS 12*e* includes the receiver 15, optional solenoid valve(s) (not shown), the expansion devices 18*a* and 18*b*, the evaporator arrangement 24 (evaporator 24) with detailed examples shown in FIGS. 6A-6C, the liquid separator 26, junction devices 30*a*-30*h*, the compressor 32, the four-way valve 28, the condenser 34, check valves 35*a*-35*e*, and the pump 70, all of which are coupled via conduits (generally 27). These devices are coupled as set out in FIGS. 4A and 4B above and operate in a similar manner.

Figure 5B:
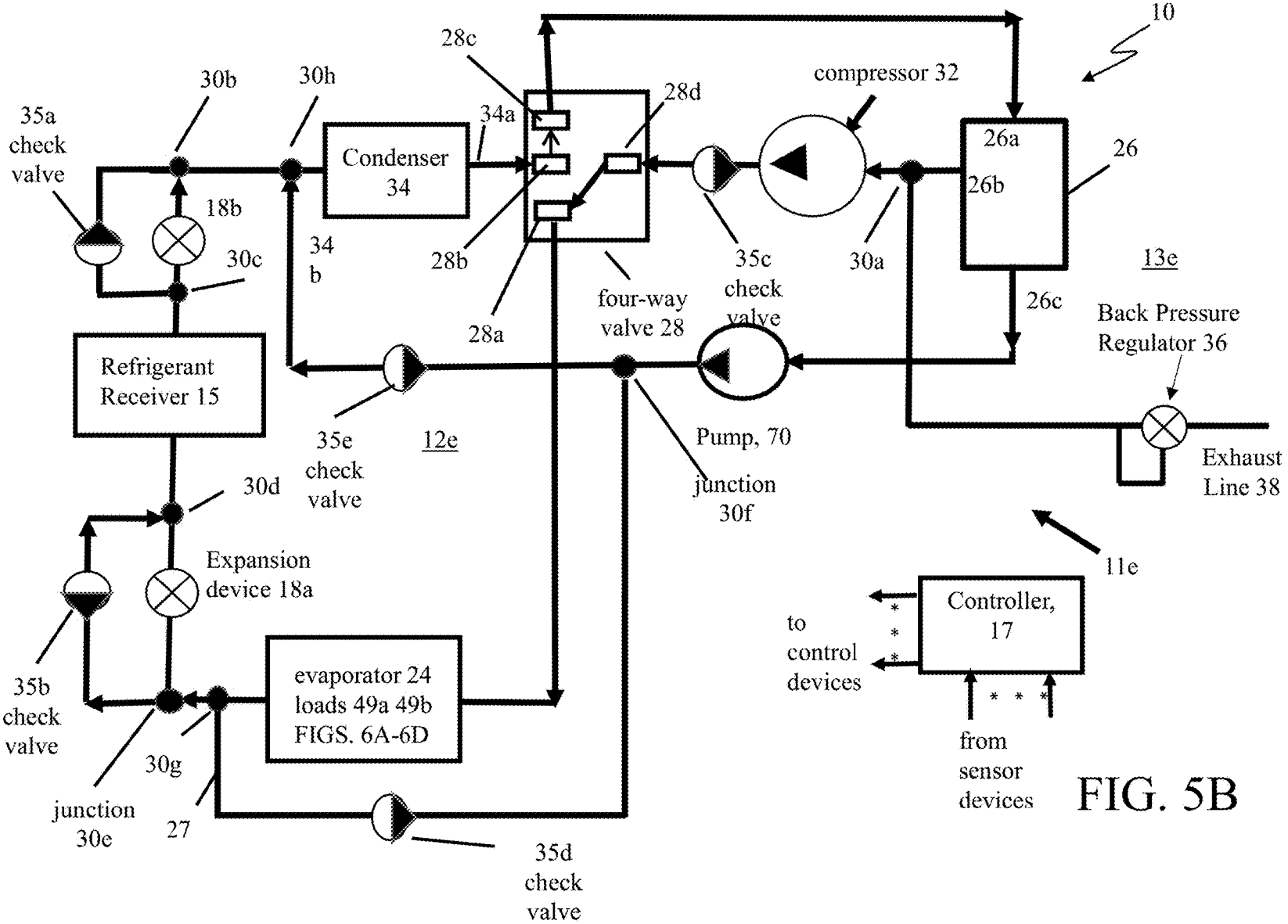

FIG. 5A and FIG. 5B show the connection of the pump 70 to the check valve 35*d* and junction 30*g* at the inlet of the evaporator 24 as comprising a first pump line. FIGS. 5A and 5B also include in addition to that first pump line, a second pump line comprised of the check valve 35*e* and the junction 30*h* which are coupled to the second port 34*b* of the condenser 34. FIG. 5B illustrates the "CCHPOCRS-PA-DL 11*e* in a heating mode (closed-circuit).

In FIGS. 5A and 5B, the pump 70 can operate across a reduced pressure differential (pressure difference between inlet and outlet of the pump 70). In the context of open-circuit refrigeration systems, the use of the pump 70 allows for some recirculation of liquid refrigerant from the liquid separator 26 to enable operation at reduced vapor quality at the evaporator 24 outlet, that also avoids discharging remaining liquid out of the system at less than the separation efficiency of the liquid separator 26 allows. This recirculation reduces the required amount of refrigerant needed for a given amount of cooling over a given period of operation. The configuration above reduces the vapor quality at the evaporator 24 inlet and thus may improve refrigerant distribution (of the two phase mixture) in the evaporator 24.

In FIGS. 5A and 5B, the provision of two pump lines can cause the condenser 34 to operate either as a condenser or an evaporator, as discussed below, and can cause the evaporator 24 to operate either as an evaporator or a condenser across a reduced pressure differential.

As in FIGS. 4A and 4B, various types of pumps can be used for pump 70 and the CCHPOCRS-PA-DL 11*e* needs to charge the evaporator 24 with liquid refrigerant and liquid refrigerant that is trapped in the liquid separator 26 may be wasted after the CCHPOCRS-PA-DL 11*e* shuts down.

Figure 5C:
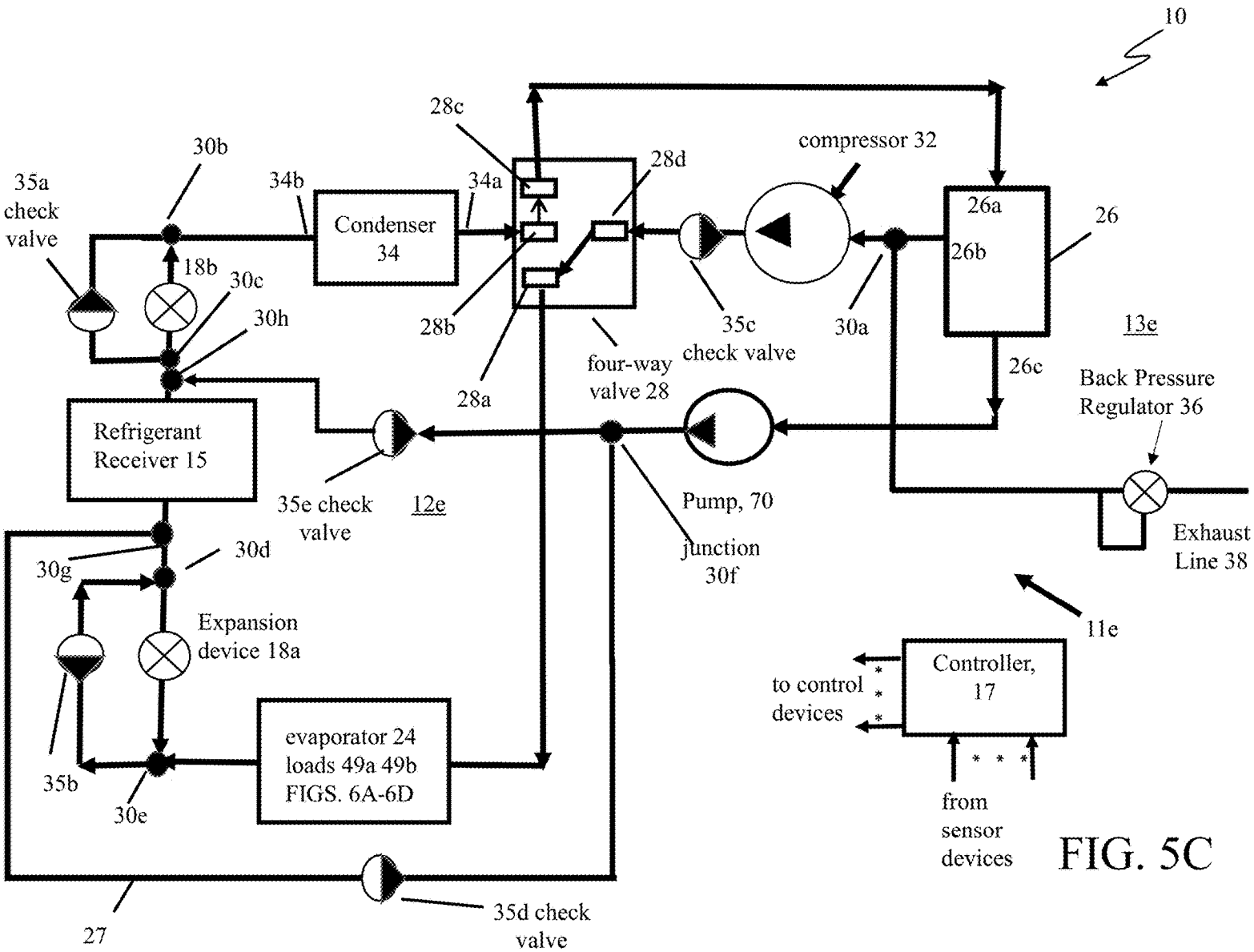
FIG. 5C shows alternative locations for two junction devices in the embodiments of FIGS. 5A and 5B.

Referring momentarily to FIG. 5C, this figure shows the system in a heating mode (as in FIG. 5B), but with alternative locations for junctions 30*g* and 30*h* being adjacent to the receiver 15. The remaining features of the system shown in FIG. 5C are discussed in FIGS. 5A and 5B, depending on operational mode. The line with the check valve 35*e* and the line with the check valve 35*d* are two parallel lines operating equally in both, heating and cooling modes and, therefore, one of them can be deleted. The receiver must be configured to allow exit of liquid in cooling and heating modes as described above.

A. Closed-Circuit Refrigeration Operation with Pump and Plural Pump Lines

Cooling Mode Low Heat Loads

FIG. 5A, in particular, shows the CCHPOCRS-PA-DL 11*e* operates in a cooling mode, to cool the low heat load 49*a* similar to that of FIG. 4A, discussed above. The controller 17 produces signals to cause the back-pressure regulator 36 to be placed in an OFF state (i.e., closed). Operation in this mode is similar to that discussed in FIG. 4A.

Also, as described in FIG. 4A, the controller 17 (or other mechanism) causes the four-way valve 28 to deliver the high pressure, high temperature refrigerant vapor flow out of port 28*b* of the four-way valve 28 to the first port 34*a* of the condenser 34. However, the check valve 35*e* blocks or checks fluid flow from the condenser 34 into the outlet of the pump 70. A fan or other mechanism (not shown) is used to transport ambient air or other cooling media across the condenser 34.

Heating Mode

FIG. 5B shows the CCHPS 12*e* in a heating mode. In this instance, controller 17 produces signals to cause the back-pressure regulator 36 to be placed in an OFF state (i.e., closed). In a heating mode, the CCHPS 12*e* is configured, e.g., by the controller 17 to have the CCHPS 12*e* provide heat to the low heat load 49*a* through the evaporator 24. In this mode, the evaporator 24 operates as a condenser at a high (discharge or condensing) pressure that is maintained from the compressor 34 discharge at the outlet to the expansion device 18*b*.

The CCHPS 12*e* has the compressor 32 forcing the high pressure, high temperature refrigerant vapor from the vapor-side 26*b* of the liquid separator 26 through the check valve 35*c*, and into port 28*d* of the four-way valve 28, i.e., "reversing valve." The four-way valve 28 feeds the high pressure, high temperature refrigerant vapor flow out of port 28*a* of the four-way valve 28 to the evaporator 24. The evaporator 24 operates as a condenser in this heating mode, by condensing the high pressure refrigerant and rejecting heat to the low heat load 49*a* requiring heating. That is, the high pressure, high temperature refrigerant vapor in the evaporator 24, transfers heat to the low heat load 49*a*.

The refrigerant leaves the evaporator 24 in a high pressure, lower temperature state and flows into junction 30*e*. The check valve 35*d* checks or blocks this refrigerant flow leaving the evaporator 24 from entering the outlet of the pump 70. The refrigerant flow leaving the evaporator 24 passes through the check valve 35*b* that is positioned in a direction to allow refrigerant flow, while the expansion device 18*a* is in a closed state. Thus, the refrigerant flow bypasses the expansion device 18*a*. The refrigerant from the check valve 35*b* is fed to the receiver 15, via junction 30*d*.

The check valve 35*a* is positioned in a direction that blocks or checks fluid flow, causing liquid refrigerant from the receiver 15 to pass through the expansion device 18*b*, be expanded in a liquid vapor and fed to junction 30*b* and 30*h*. In junction 30*h*, refrigerant liquid from the pump 70 is mixed with the refrigerant from the expansion device 18*b*, and this mixed liquid and vapor refrigerant is delivered to the condenser 34. The condenser 34 in this mode operates as an evaporator and low pressure is maintained from the expansion device 18*b* outlet connected to the condenser 34 to the compressor suction inlet. The expansion device 18*b* should control a superheat at the inlet to the condenser 34 (which in this heating mode act as an evaporator) to avoid accumulation of liquid in the liquid separator 26 during the heating mode.

Liquid at the high pressure is expanded in the expansion device 18*b* at a constant enthalpy, turns into liquid and vapor mixture at the low pressure, and the mixture is received at the second port 34*a*, acting as the inlet of the condenser 34 (acting as an evaporator). In the condenser 34 (operating as an evaporator), the refrigerant evaporates at low pressure. Port 28*b* of the four-way valve 28 receives the refrigerant flow, and the four-way valve 28 diverts this refrigerant flow from port 28*b* to port 28*c* of the four-way valve 28. This diverted flow is fed to the liquid separator 26, and from the liquid separator 26 into the compressor 32 to repeat the cycle.

B. Open/Closed-Circuit Refrigeration Operation with Pump and Plural Pump Lines

On the other hand, when a high heat load 49*b* is applied, a mechanism such as the controller 17 causes the CCHPOCRS-PA-DL 11*e* to operate in both a closed and open-circuit configuration. The closed-circuit portion would be similar to that described above under the heading "Closed-circuit Refrigeration Operation with Pump."

The OCRS 14*a* has the controller 17 configured to cause the back-pressure regulator 36 to be placed in an ON position, opening the back-pressure regulator 36 to permit the back-pressure regulator 36 to exhaust vapor through the exhaust line 38. The back-pressure regulator 36 maintains a back-pressure at an inlet to the back-pressure regulator 36, according to a set point pressure, while allowing the back-pressure regulator 36 to exhaust refrigerant vapor to the exhaust line 38.

Referring now to FIGS. 6A-6C additional evaporators that are alternative configurations of the evaporator 24 and heat loads 49*a*, 49*b* are shown. These configurations are shown coupled to the four-way switch 28, at port 28*a*, and without direction of refrigerant fluid flow, which would be governed according to the mode of operation of the various embodiments of the TMS 10.

In the configuration of FIG. 6A, both the low heat load 49*a* and the high heat load 49*b* are coupled to (or are in proximity to) a single, i.e., the same evaporator 24.

In the configuration of FIG. 6B, each of a pair of evaporators (generally 24) have the low heat load 49*a* and the high heat load 49*b* coupled or proximate thereto. In an alternative configuration of FIG. 2B, (not shown), the low heat load 49*a* would be coupled (or proximate) to a first one of the pair of evaporators (generally 24) and the high heat load 49*b* would be coupled (or proximate) to a second one of pair of evaporators (generally 24).

In the configurations of FIG. 6C, the low heat load 49*a* and the high heat load 49*b* are coupled to (or are in proximity to) corresponding ones of the pair of evaporators (generally 24). In the configuration of FIG. 6C, a T-valve 23*a* (passive or active), as shown, splits refrigerant flow from the receiver 15, into two paths that feed two evaporators (generally 24). One of these evaporators 24 is coupled (or proximate to) the low heat load 49*a* and the other of these evaporators is coupled (or proximate to) the high heat load 49*b*.

In the configuration of FIG. 6C, the outputs of the evaporators (generally 24) are coupled to a second T-valve 23*b* (active or passive) via conduits (generally 27). The second T-valve 23*b* has an output that feeds the port 28*a* of the four-way valve 28.

Evaporator

Figure 7A:
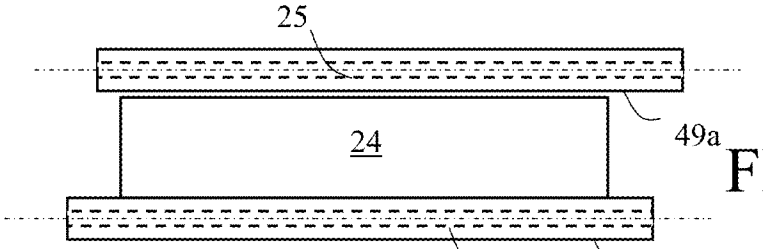
FIGS. 7A and 7B are schematic diagrams showing side and end views, respectively, of an example of an evaporator with the heat load that includes refrigerant fluid channels.
Figure 7B:
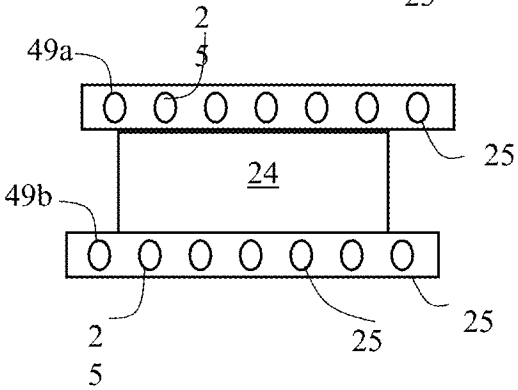

Referring to FIGS. 7A and 7B, the evaporator 24 can be implemented in a variety of ways. In general, evaporator 24 functions as a heat exchanger, providing thermal contact between the refrigerant fluid and heat loads 49*a*, 49*b*. Typically, evaporator 24 includes one or more flow channels extending internally between an inlet and an outlet of the evaporator 24, allowing refrigerant fluid to flow through the evaporator 24 and absorb heat from heat load 49*a* and/or 49*b*.

A variety of different evaporators can be used in TMS 10. In general, any cold plate may function as the evaporator 24 of the open-circuit refrigeration systems disclosed herein. Evaporator 24 can accommodate any refrigerant fluid channels 25 (including mini/micro-channel tubes), blocks of printed circuit heat exchanging structures, or more generally, any heat exchanging structures that are used to transport single-phase or two-phase fluids. The evaporator 24 and/or components thereof, such as fluid transport channels 25, can be attached to the heat load 49*a* and/or 49*b* mechanically, or can be welded, brazed, or bonded to the heat load in any manner.

In some embodiments, evaporator 24 (or certain components thereof) can be fabricated as part of heat load 49*a* and/or 49*b* or otherwise integrated into one or more of the heat load 49*a* and/or 49*b*, as is generally shown in FIGS. 7A and 7B, in which heat load 49*b* has one or more integrated refrigerant fluid channels 25. The portion of heat load 49*b* with the refrigerant fluid channel(s) 25 effectively functions as the evaporator 24 for the system 11. The evaporator 24 can be implemented as plurality of evaporators connected in parallel and/or in series or as individual evaporators, as shown for evaporator 24 for heat load 49*b* (FIG. 3B).

Receiver

Figure 8:
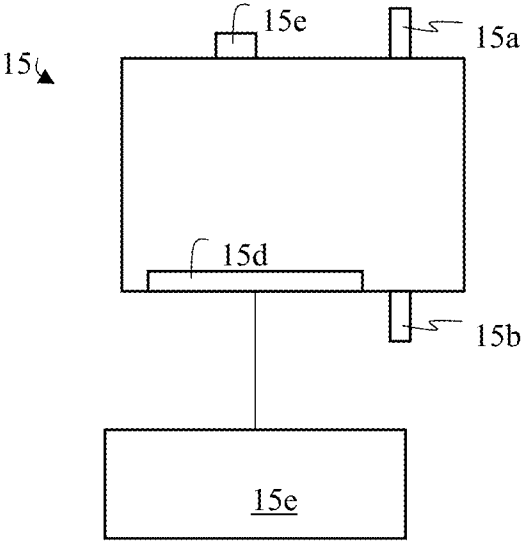
FIG. 8 is a schematic diagram of an example of a receiver for refrigerant fluid in the thermal management system.

FIG. 8 shows an example of the receiver 15. Receiver 15 includes an inlet port 15*a*, an outlet port 15*b*, and an optional pressure relief valve 15*e*. To charge receiver 15, refrigerant fluid is typically introduced into receiver 15 via the inlet port 15*a*, and this can be done, for example, at service locations. Operating in the field the refrigerant exits receiver 15 through outlet port 15*b* that is connected to conduit. In case of emergency, if the fluid pressure within receiver 15 exceeds a pressure limit value, pressure relief valve 15*c* opens to allow a portion of the refrigerant fluid to escape through valve 15*c* to reduce the fluid pressure within receiver 15. Receiver 15 is typically implemented as an insulated vessel that stores a refrigerant fluid at relatively high pressure. Receiver 15 can also include insulation (not shown in FIG. 8) applied around the receiver to reduce thermal losses and a heater 15*d* that is controlled by controller 15*e* (e.g., controller 17).

In general, receiver 15 can have a variety of different shapes. In some embodiments, for example, the receiver is cylindrical. Examples of other possible shapes include, but are not limited to, rectangular prismatic, cubic, and conical. In certain embodiments, receiver 15 can be oriented such that outlet port 15*b* is positioned at the bottom of the receiver. In this manner, the liquid portion of the refrigerant fluid within receiver 15 is discharged first through outlet port 15*b*, prior to discharge of refrigerant vapor. In certain embodiments, the refrigerant fluid can be an ammonia-based mixture that includes ammonia and one or more other substances. For example, mixtures can include one or more additives that facilitate ammonia absorption or ammonia burning.

While, in the CCHPOCRS 11, the compressor 32 consumes power, the discharge pressure can be lower than the discharge pressure of an equivalent closed-circuit refrigeration system to handle both heat loads 49*a*, 49*b* and, therefore, the power consumed by the compressor 32 can be less than the power consumed by a compressor of the equivalent closed-circuit refrigerant system.

Figure 9:
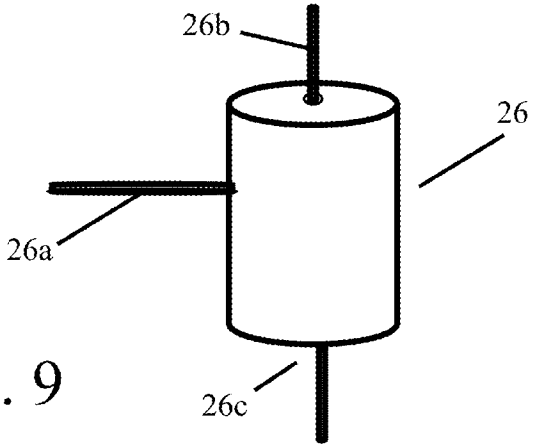
FIG. 9 is diagrammatical views of a three-port liquid separator.

FIG. 9 depicts a configuration for the liquid separator 26 (implemented as a coalescing liquid separator or a flash drum, for example), which has the input port 26*a*, the vapor-side outlet port 26*b* and the liquid-side outlet port 26*c* that would be coupled to conduits (generally 27). Other conventional details such as membranes, coalescing filters, or meshes, etc. are not shown.

Figure 10:
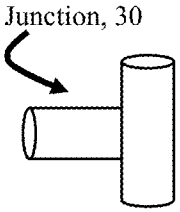
FIG. 10 is a diagram of a junction device.

FIG. 10 shows a diagrammatical view of the junction device 30 having at least three ports any of which could be inlets or outlets. Generally, in the configurations below two of the ports would be inlets and one would be an outlet and refrigerant flows from the two ports acting as inlets would be combined and exit the outlet.

Referring now also to FIG. 11, a typical configuration for the ejector 66 is shown. This exemplary ejector 66 includes the primary inlet 66*a*, the secondary or suction inlet 66*b* and the outlet 66*c*. The primary inlet 66*a* feeds a motive nozzle 66*d*, the secondary or suction inlet 66*b* feeds one or more secondary nozzles 66*e* that are coupled to a suction chamber 66*f* A mixing chamber 66*g* of a constant area receives the primary flow of refrigerant and secondary flow of refrigerant and mixes these flows. A diffuser 66*h* diffuses the flow to deliver an expanded flow at the outlet 66*c*.

Liquid refrigerant from the receiver 15 is the primary flow. In the motive nozzle 66*d* potential energy of the primary flow at the inlet 66*a* is converted into kinetic energy reducing the potential energy (the established static pressure) of the primary flow. The secondary flow at the secondary inlet 66*b* from the outlet of the evaporator 32 has a pressure that is higher than an established static pressure in the suction chamber 66*f*, and thus the secondary flow is entrained through the suction inlet (secondary inlet 66*b*) and the secondary nozzles 66*e* internal to the ejector 66. The two streams (primary flow and secondary flow) mix together in the mixing section 66*g*. In the diffuser section 66*h*, the kinetic energy of the mixed streams is converted into potential energy elevating the pressure of the mixed flow liquid/vapor refrigerant that leaves the ejector outlet 66*c* and is fed to the liquid separator 28.

In the context of the ejector assisted open-circuit refrigeration configurations (FIGS. 2A-3B discussed above), the use of the ejector 66 allows for recirculation of liquid refrigerant captured by the liquid separator 26 to increase the efficiency of the system 10. That is, by allowing some passive recirculation of refrigerant liquid, apart from the operation of the compressor 32 and the condenser 34, as in conventional closed-circuit refrigeration system, this recirculation reduces the required amount of refrigerant needed for a given amount of cooling over a given period of operation and can also reduce both the power and size requirements for the compressor/vacuum pump 32 and condenser 34 for a given amount of cooling/heating capacity.

Figure 14:
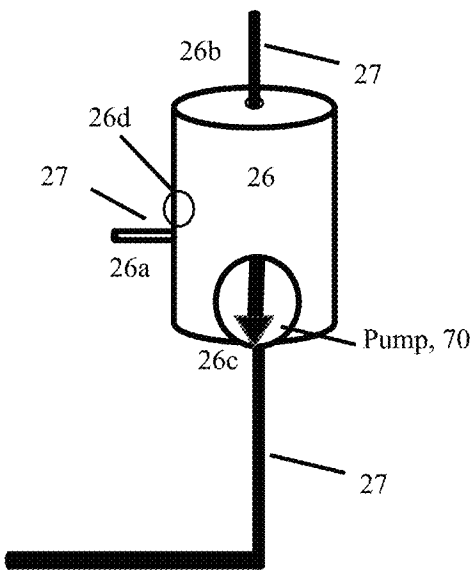
FIGS. 12-14 are diagrams of liquid separator configurations.
Figure 13:
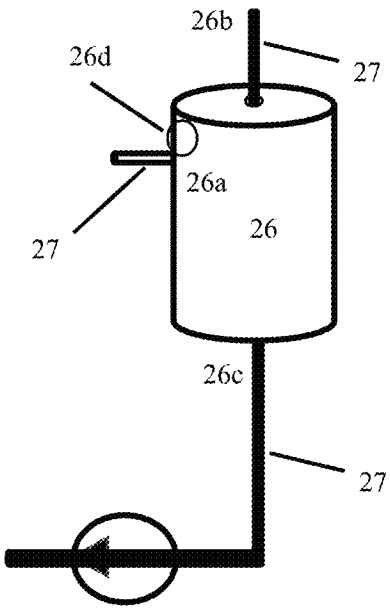
Figure 12:
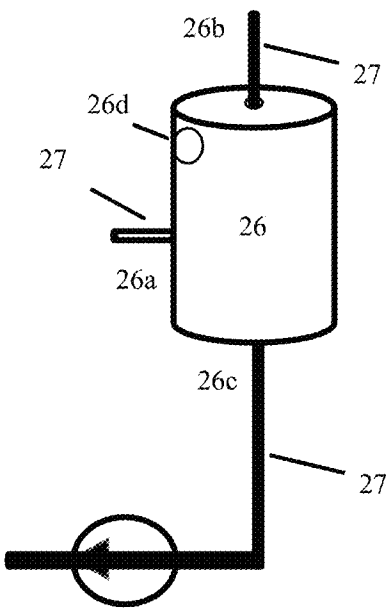

For liquid pump configurations (FIGS. 4A-5C), FIGS. 12-14 depict alternative configurations of the liquid separator 26 (implemented as a flash drum for example).

In FIG. 12, the pump 70 is located distal from the liquid-side port 26*c*. This configuration potentially presents the possibility of cavitation. To minimize the possibility of cavitation one of the configurations of FIG. 13 or 14 (or their combination) can be used.

In FIG. 13, the pump 70 is located distal from the liquid-side port 26*c*, but the height at which the inlet 26*a* is located is higher than that of FIG. 11. This would result in an increase in liquid pressure at the liquid-side outlet 26*c*, and concomitant therewith an increase in liquid pressure at the inlet of the pump 70. Increasing the pressure at the inlet to the pump 70 should minimize any possibility of cavitation.

Another strategy is presented in FIG. 14, where the pump 70 is located proximate to or indeed, as shown, inside of the liquid-side port 26*c*. In addition, although not shown, the height at which the inlet is located can be adjusted to that of FIG. 13, rather than the height, as shown in FIG. 14. This would result in an increase in liquid pressure at the inlet of the pump 70 further minimizing the possibility of cavitation.

Another alternative strategy that can be used for any of the configurations depicted involves the use of a sensor 26*d* that produces a signal that is a measure of the height of a column of liquid in the liquid separator. The signal is sent to the controller 17 that will be used to start the pump 70, once a sufficient height of liquid is contained by the liquid separator 26.

Another alternative strategy that can be used for any of the configurations depicted involves the use of a heat exchanger. The heat exchanger is an evaporator, which brings in thermal contact two refrigerant streams. In the above systems, a first of the streams is the liquid stream leaving the liquid separator 26. A second stream is the liquid refrigerant expanded to a pressure lower than the evaporator pressure in the evaporator 24 and evaporating the related evaporating temperature lower than the liquid temperature at the liquid separator exit. Thus, the liquid from the liquid separator 26 exit is subcooled rejecting thermal energy to the second side of the heat exchanger. The second side absorbs the rejected thermal energy due to evaporating and superheating of the second refrigerant stream.

Various combinations of the sensors can be used to measure thermodynamic properties of the TMS 10 that are used to adjust the control devices or pumps discussed above and which signals are processed by the controller 17. Connections (wired or wireless) are provided between each of the sensors and controller 17. In many embodiments, system includes only certain combinations of the sensors (e.g., one, two, three, or four of the sensors) to provide suitable control signals for the control devices.

FIG. 15 shows the controller 17 that includes a processor 17*a*, memory 17*b*, storage 17*c*, and I/O interfaces 17*d*, all of which are connected/coupled together via a bus 17*e*. Any two of the optional devices, as pressure sensors upstream and downstream from a control device, can be configured to measure information about a pressure differential $p_r - p_e$ across the respective control device and to transmit electronic signals corresponding to the measured pressure from which a pressure difference information can be generated by the controller 17. Other sensors such as flow sensors and temperature sensors can be used as well. In certain embodiments, sensors can be replaced by a single pressure differential sensor, a first end of which is connected adjacent to an inlet and a second end of which is connected adjacent to an outlet of a device to which differential pressure is to be measured, such as the evaporator. The pressure differential sensor measures and transmits information about the refrigerant fluid pressure drop across the device, e.g., the evaporator 24.

Temperature sensors can be positioned adjacent to an inlet or an outlet of e.g., the evaporator 24 or between the inlet and the outlet. Such a temperature sensor measures temperature information for the refrigerant fluid within evaporator 24 (which represents the evaporating temperature) and transmits an electronic signal corresponding to the measured information. A temperature sensor can be attached to heat loads 49*a*, 49*b*, which measures temperature information for the load and transmits an electronic signal corresponding to the measured information. An optional temperature sensor can be adjacent to the outlet of evaporator 24 that measures and transmits information about the temperature of the refrigerant fluid as it emerges from evaporator 24.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the system 10 and the saturated vapor temperature of the refrigerant fluid defined by the refrigerant pressure at the measurement point in the TMS 10.

To determine the superheat associated with the refrigerant fluid, the system controller 17 (as described) receives information about the refrigerant fluid vapor pressure after emerging from a heat exchanger downstream from evaporator 24, and uses calibration information, a lookup table, a mathematical relationship, or other information to determine the saturated vapor temperature for the refrigerant fluid from the pressure information. The controller 17 also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in TMS 10. As one example, thermocouples and thermistors can function as temperature sensors in TMS 10. Examples of suitable commercially available temperature sensors for use in TMS 10 include, but are not limited to, the 88000 series thermocouple surface probes (available from OMEGA Engineering Inc., Norwalk, Conn.).

TMS 10 can include a vapor quality sensor that measures vapor quality of the refrigerant fluid emerging from evaporator 24. Typically, such a sensor is implemented as a capacitive sensor that measures a difference in capacitance between the liquid and vapor phases of the refrigerant fluid. The capacitance information can be used to directly determine the vapor quality of the refrigerant fluid (e.g., by system controller 17). Alternatively, sensor can determine the vapor quality directly based on the differential capacitance measurements and transmit an electronic signal that includes information about the refrigerant fluid vapor quality. Examples of commercially available vapor quality sensors that can be used in TMS 10 include, but are not limited to, HBX sensors (available from HB Products, Hasselager, Denmark).

It should generally be understood that the systems disclosed herein can include a variety of combinations of the various sensors described above, and controller 17 can receive measurement information periodically or aperiodically from any of the various sensors. Moreover, it should be understood any of the sensors described can operate autonomously, measuring information and transmitting the information to controller 17 (or directly to the first and/or second control device) or, alternatively, any of the sensors described above can measure information when activated by controller 17 via a suitable control signal, and measure and transmit information to controller 17 in response to the activating control signal.

To adjust a control device on a particular value of a measured system parameter value, controller 17 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 17 adjusts a respective control device to modify the operating state of the TMS 10. Certain set point values represent a minimum allowable value of a system parameter, and if the measured value is equal to the set point value (or differs from the set point value by 10% or less (e.g., 5% or less, 3% or less, 1% or less) of the set point value), controller 17 adjusts the respective control device to modify the operating state of the system 10, and increase the system parameter value. The controller 17 executes algorithms that use the measured sensor value(s) to provide signals that cause the various control devices to adjust refrigerant flow rates, etc.

Some set point values represent "target" values of system parameters. For such system parameters, if the measured parameter value differs from the set point value by 1% or more (e.g., 3% or more, 5% or more, 10% or more, 20% or more), controller 17 adjusts the respective control device to adjust the operating state of the system, so that the system parameter value more closely matches the set point value.

Optional pressure sensors are configured to measure information about the pressure differential $p_r - p_e$ across a control device and to transmit an electronic signal corresponding to the measured pressure difference information. Two sensors can effectively measure $p_r$, $p_e$. In certain embodiments two sensors can be replaced by a single pressure differential sensor. Where a pressure differential sensor is used, a first end of the sensor is connected upstream of a first control device and a second end of the sensor is connected downstream from first control device.

System also includes optional pressure sensors positioned at the inlet and outlet, respectively, of evaporator 24. A sensor measures and transmits information about the refrigerant fluid pressure upstream from evaporator 24, and a sensor measure and transmit information about the refrigerant fluid pressure downstream from evaporator 24. This information can be used (e.g., by a system controller) to calculate the refrigerant fluid pressure drop across evaporator 24. As above, in certain embodiments, sensors can be replaced by a single pressure differential sensor to measure and transmit the refrigerant fluid pressure drop across evaporator 24.

To measure the evaporating pressure ($p_e$) a sensor can be optionally positioned between the inlet and outlet of evaporator 24, i.e., internal to evaporator 24. In such a configuration, the sensor can provide a direct measurement of the evaporating pressure.

To measure refrigerant fluid pressure at other locations within the system, sensor can also optionally be positioned, for example, in-line along a conduit. Pressure sensors at each of these locations can be used to provide information about the refrigerant fluid pressure downstream from evaporator 24, or the pressure drop across evaporator 24.

It should be appreciated that, in the foregoing discussion, any one or various combinations of two sensors discussed in connection with the system can correspond to the first measurement device connected to a control device 18 (e.g., an expansion device), and any one or various combination of two sensors can correspond to the second measurement device. In general, as discussed previously, the first measurement device provides information corresponding to a first thermodynamic quantity to the first expansion device, and the second measurement device provides information corresponding to a second thermodynamic quantity to the second expansion device, where the first and second thermodynamic quantities are different, and therefore allow the first and second expansion device to independently control two different system properties (e.g., the vapor quality of the refrigerant fluid and the heat load temperature, respectively).

In some embodiments, one or more of the sensors shown in system are connected directly to control or expansion devices 18*a*, 18*b*. The first and second expansion devices can be configured to adaptively respond directly to the transmitted signals from the sensors, thereby providing for automatic adjustment of the system's operating parameters. In certain embodiments, the first and/or second expansion devices can include processing hardware and/or software components that receive transmitted signals from the sensors, optionally perform computational operations, and activate elements of the first and/or second expansion devices to adjust the expansion device in response to the sensor signals.

In addition, controller 17 is optionally connected to control (e.g., expansion) devices 18*a*, 18*b*. In embodiments where expansion devices 18*a*, 18*b* are implemented as a device controllable via an electrical control signal, controller 17 is configured to transmit suitable control signals to the first and/or second control device to adjust the configuration of these components. In particular, controller 17 is configured to adjust one or more of the expansion device 18*a* to control the vapor quality of the refrigerant fluid in the system 10.

During operation of the system 10, controller 17 typically receives measurement signals from one or more sensors. The measurements can be received periodically (e.g., at consistent, recurring intervals) or irregularly, depending upon the nature of the measurements and the manner in which the measurement information is used by controller 17. In some embodiments, certain measurements are performed by controller 17 after particular conditions—such as a measured parameter value exceeding or falling below an associated set point value—are reached. By way of example, Table 1 summarizes various examples of combinations of types of information (e.g., system properties and thermodynamic quantities) that can be measured by the sensors of system and transmitted to controller 17, to allow controller 17 to generate and transmit suitable control signals to expansion devices 18*a*, 18*b* and/or other control devices. The types of information shown in Table 1 can generally be measured using any suitable device (including combination of one or more of the sensors discussed herein) to provide measurement information to controller 17.

TABLE 1

| | | Measurement Information Used to Adjust Control Device(s), e.g., first control device 18a | | | | | | | |
|---|---|---|---|---|---|---|---|---|---|
| | | FCM Press Drop | Evap Press Drop | Rec Pres | VQ | SH | Evap VQ | Evap P/T | HL Temp |
| Measurement Information Used to Adjust Second Control Device | FCM Press Drop | | | | | | | x | x |
| | Evap Press Drop | | | | | | | x | x |
| | Rec Press | | | | | | | x | x |
| | VQ | | | | | | | x | x |
| | SH | | | | | | | x | x |
| | Evap VQ | | | | | | | x | x |
| | Evap P/T | x | x | x | x | x | x | | x |
| | HL Temp | x | x | x | x | x | x | x | |

FCM Press Drop = refrigerant fluid pressure drop across first control device
Evap Press Drop = refrigerant fluid pressure drop across evaporator
Rec Press = refrigerant fluid pressure in receiver
VQ = vapor quality of refrigerant fluid
SH = superheat of refrigerant fluid
Evap VQ = vapor quality of refrigerant fluid at evaporator outlet
Evap P/T = evaporation pressure or temperature
HL Temp = heat load temperature For example, in some embodiments, expansion device 18*a* is adjusted (e.g., automatically or by controller 17) based on a measurement of the evaporation pressure ($p_e$) of the refrigerant fluid and/or a measurement of the evaporation temperature of the refrigerant fluid. In certain embodiments, expansion device 18*a* is adjusted (e.g., automatically or by controller 17) based on a measurement of the temperature of high heat load 49*b*.

To adjust either of the expansion devices 18*a*, 18*b*, compressor 32, or pump 70 based on a particular value of a measured system parameter value, controller 17 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 17 adjusts expansion device 18*a* to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 17 adjusts expansion device 18, etc. to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 17 adjusts expansion device 18, etc. to adjust the operating state of the system, so that the system parameter value more closely matches the set point value.

Measured parameter values are assessed in relative terms based on set point values (i.e., as a percentage of set point values). Alternatively, in some embodiments, measured parameter values can be accessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 17 adjusts expansion device 18, etc. to adjust the operating state of the system, so that the measured system parameter value more closely matches the set point value.

In the foregoing examples, measured parameter values are assessed in relative terms based on set point values (i.e., as a percentage of set point values). Alternatively, in some embodiments, measured parameter values can be in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 17 adjusts expansion device 18, etc. to adjust the operating state of the system, so that the measured system parameter value more closely matches the set point value.

In certain embodiments, refrigerant fluid emerging from evaporator 24 can be used to cool one or more additional heat loads. In addition, systems can include a second heat load connected to a heat exchanger. A variety of mechanical connections can be used to attach second heat load to heat exchanger, including (but not limited to) brazing, clamping, welding, and any of the other connection types discussed herein.

Heat exchanger includes one or more flow channels through which high vapor quality refrigerant fluid flows after leaving evaporator 24. During operation, as the refrigerant fluid vapor phases through the flow channels, it absorbs heat energy from second heat load, cooling second heat load. Typically, second heat load is not as sensitive as high heat load 49*b* to fluctuations in temperature. Accordingly, while second heat load is generally not cooled as precisely relative to a particular temperature set point value as high heat load 49*b*, the refrigerant fluid vapor provides cooling that adequately matches the temperature constraints for second heat load.

In general the systems disclosed herein can include more than one (e.g., two or more, three or more, four or more, five or more, or even more) heat loads in addition to heat loads depicted. Each of the additional heat loads can have an associated heat exchanger; in some embodiments, multiple additional heat loads are connected to a single heat exchanger, and in certain embodiments, each additional heat load has its own heat exchanger. Moreover, each of the additional heat loads can be cooled by the superheated refrigerant fluid vapor after a heat exchanger attached to the second load or cooled by the high vapor quality fluid stream that emerges from evaporator 24.

Although evaporator 24 and heat exchanger are implemented as separate components, in certain embodiments, these components can be integrated to form a single heat exchanger, with heat load and second heat load both connected to the single heat exchanger. The refrigerant fluid vapor that is discharged from the evaporator portion of the single heat exchanger is used to cool second heat load, which is connected to a second portion of the single heat exchanger.

The vapor quality of the refrigerant fluid after passing through evaporator 24 can be controlled either directly or indirectly with respect to a vapor quality set point by controller 17. In some embodiments, the system includes a vapor quality sensor that provides a direct measurement of vapor quality, which is transmitted to controller 17. Controller 17 adjusts control device depending on configuration to control the vapor quality relative to the vapor quality set point value.

In certain embodiments, the system includes a sensor that measures superheat and indirectly, vapor quality. For example, a combination of temperature and pressure sensors measure the refrigerant fluid superheat downstream from a second heat load, and transmit the measurements to controller 17. Controller 17 adjusts control device according to the configuration based on the measured superheat relative to a superheat set point value. By doing so, controller 17 indirectly adjusts the vapor quality of the refrigerant fluid emerging from evaporator 24.

As the two refrigerant fluid streams flow in opposite directions within recuperative heat exchanger, heat is transferred from the refrigerant fluid emerging from evaporator 24 to the refrigerant fluid entering expansion device 18. Heat transfer between the refrigerant fluid streams can have a number of advantages. For example, recuperative heat transfer can increase the refrigeration effect in evaporator 24, reducing the refrigerant mass transfer rate implemented to handle the heat load presented by high heat load 49*b*. Further, by reducing the refrigerant mass transfer rate through evaporator 24, the amount of refrigerant used to provide cooling duty in a given period of time is reduced. As a result, for a given initial quantity of refrigerant fluid introduced into receiver 15, the operational time over which the system can operate before an additional refrigerant fluid charge is needed can be extended. Alternatively, for the system to effectively cool high heat load 49*b* for a given period of time, a smaller initial charge of refrigerant fluid into receiver 15 can be used.

Because the liquid and vapor phases of the two-phase mixture of refrigerant fluid generated following expansion of the refrigerant fluid in expansion device 18*a* can be used for different cooling applications, in some embodiments, the system can include a phase separator to separate the liquid and vapor phases into separate refrigerant streams that follow different flow paths within the TMS 10.

Further, eliminating (or nearly eliminating) the refrigerant vapor from the refrigerant fluid stream entering evaporator 24 can help to reduce the cross-section of the evaporator and improve film boiling in the refrigerant channels. In film boiling, the liquid phase (in the form of a film) is physically separated from the walls of the refrigerant channels by a layer of refrigerant vapor, leading to poor thermal contact and heat transfer between the refrigerant liquid and the refrigerant channels. Reducing film boiling improves the efficiency of heat transfer and the cooling performance of evaporator 24.

In addition, by eliminating (or nearly eliminating) the refrigerant vapor from the refrigerant fluid stream entering evaporator 24, distribution of the liquid refrigerant within the channels of evaporator 24 can be made easier. In certain embodiments, vapor present in the refrigerant channels of evaporator 24 can oppose the flow of liquid refrigerant into the channels. Diverting the vapor phase of the refrigerant fluid before the fluid enters evaporator 24 can help to reduce this difficulty.

In addition to phase separator, or as an alternative to phase separator, in some embodiments the systems disclosed herein can include a phase separator downstream from evaporator 24. Such a configuration can be used when the refrigerant fluid emerging from evaporator is not entirely in the vapor phase, and still includes liquid refrigerant fluid.

VIII. Additional Features of Thermal Management Systems

The foregoing examples of thermal management systems illustrate a number of features that can be included in any of the systems within the scope of this disclosure. In addition, a variety of other features can be present in such systems.

In certain embodiments, refrigerant fluid that is discharged from evaporator 24 and passes through conduit can be directly discharged as exhaust from conduit without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight can be important.

In some embodiments, however, refrigerant fluid vapor can be further processed before it is discharged. Further processing may be desirable depending upon the nature of the refrigerant fluid that is used, as direct discharge of unprocessed refrigerant fluid vapor may be hazardous to humans and/or may be deleterious to mechanical and/or electronic devices in the vicinity of the TMS 10. For example, the unprocessed refrigerant fluid vapor may be flammable or toxic, or may corrode metallic device components. In situations such as these, additional processing of the refrigerant fluid vapor may be desirable.

In general, refrigerant processing apparatus can be implemented in various ways. In some embodiments, refrigerant processing apparatus is a chemical scrubber or water-based scrubber. Within apparatus, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor can be exposed to one or more chemical agents that neutralize the vapor and yield a less basic or acidic product that can be collected for disposal or discharged from apparatus.

As another example, where the refrigerant fluid vapor is highly chemically reactive, the refrigerant fluid vapor can be exposed to one or more chemical agents that oxidize, reduce, or otherwise react with the refrigerant fluid vapor to yield a less reactive product that can be collected for disposal or discharged from apparatus.

In certain embodiments, refrigerant processing apparatus can be implemented as an adsorptive sink for the refrigerant fluid. Apparatus can include, for example, an adsorbent material bed that binds particles of the refrigerant fluid vapor, trapping the refrigerant fluid within apparatus and preventing discharge. The adsorptive process can sequester the refrigerant fluid particles within the adsorbent material bed, which can then be removed from apparatus and sent for disposal.

In some embodiments, where the refrigerant fluid is flammable, refrigerant processing apparatus can be implemented as an incinerator. Incoming refrigerant fluid vapor can be mixed with oxygen or another oxidizing agent and ignited to combust the refrigerant fluid. The combustion products can be discharged from the incinerator or collected (e.g., via an adsorbent material bed) for later disposal.

As an alternative, refrigerant processing apparatus can also be implemented as a combustor of an engine or another mechanical power-generating device. Refrigerant fluid vapor from conduit can be mixed with oxygen, for example, and combusted in a piston-based engine or turbine to perform mechanical work, such as providing drive power for a vehicle or driving a generator to produce electricity. In certain embodiments, the generated electricity can be used to provide electrical operating power for one or more devices, including heat load 49*b*. For example, heat load 49*b* can include one or more electronic devices that are powered, at least in part, by electrical energy generated from combustion of refrigerant fluid vapor in refrigerant processing apparatus.

The thermal management systems disclosed herein can optionally include a phase separator upstream from the refrigerant processing apparatus.

Particularly during start-up of the systems disclosed herein, liquid refrigerant may be present in conduits because the systems generally begin operation before heat load 49*b* and/or heat loads 49*a*, 49*b* are activated. Accordingly, phase separator functions in a manner similar to phase separators to separate liquid refrigerant fluid from refrigerant vapor. The separated liquid refrigerant fluid can be re-directed to another portion of the system, or retained within phase separator until it is converted to refrigerant vapor. By using phase separator, liquid refrigerant fluid can be prevented from entering refrigerant processing apparatus.

IX. Integration with Power Systems

In some embodiments, the refrigeration systems disclosed herein can be combined with power systems to form integrated power and thermal systems, in which certain components of the integrated systems are responsible for providing refrigeration functions and certain components of the integrated systems are responsible for generating operating power.

Figure 16:
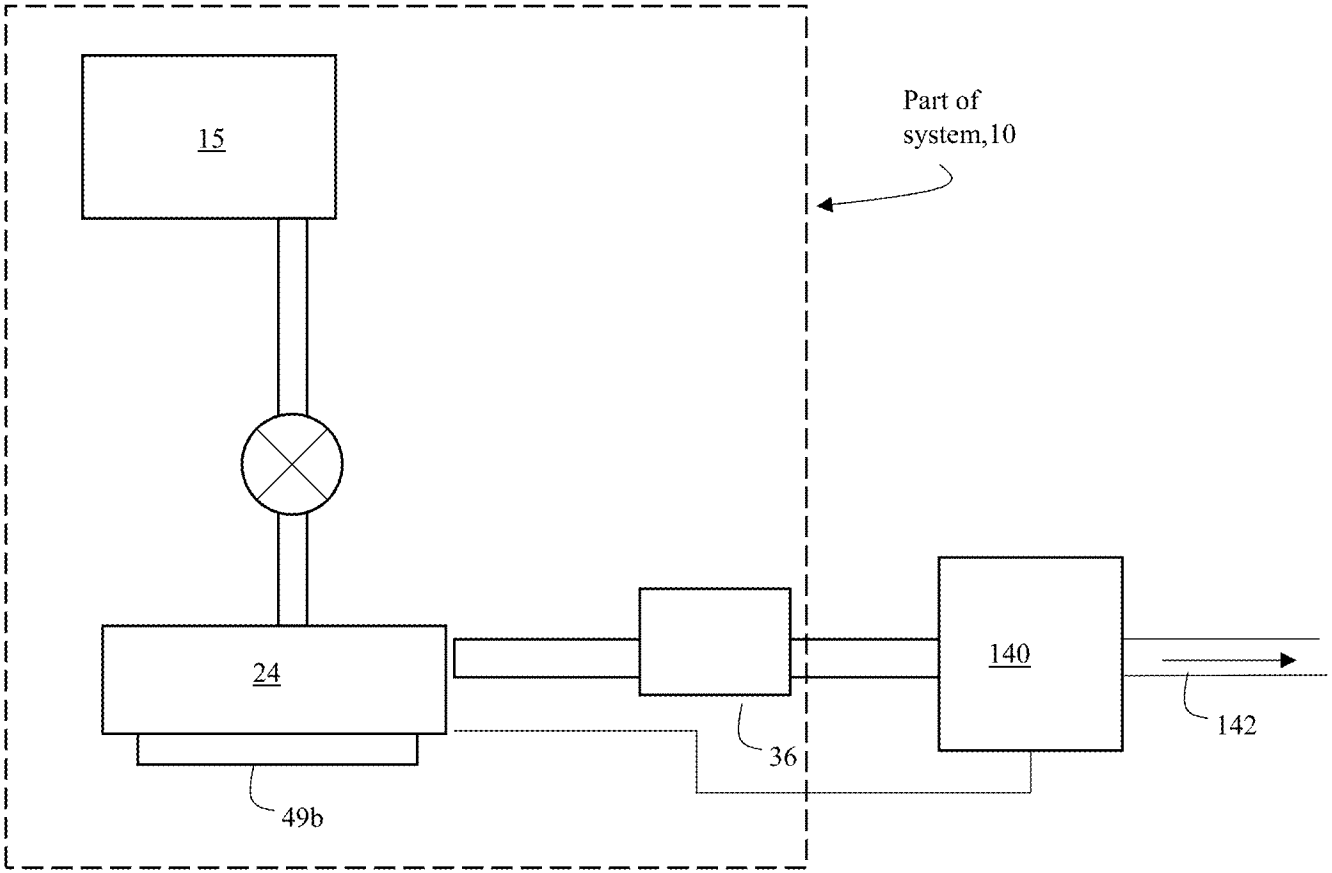
FIG. 16 is a schematic diagram of an example of a thermal management system that includes a power generation apparatus.

FIG. 16 shows an integrated power and TMS 10 that includes many features similar to those discussed above (e.g., see FIG. 1) with only aspects of the open-circuit portion 11*a* shown. In addition, TMS 10 is coupled to or is part of an engine 140 with an inlet that receives the stream of waste refrigerant fluid. Engine 140 can combust the waste refrigerant fluid directly, or alternatively, can mix the waste refrigerant fluid with one or more additives (such as oxidizers) before combustion. Where ammonia is used as the refrigerant fluid in system 10, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 140 to generate electrical power, e.g., by using the energy to drive a generator. The electrical power can be delivered via electrical connection to heat load 49*b* to provide operating power for the load. For example, in certain embodiments, heat load 49*b* includes one or more electrical circuits and/or electronic devices, and engine 140 provides operating power to the circuits/devices via combustion of refrigerant fluid. Byproducts 142 of the combustion process can be discharged from engine 140 via exhaust conduit, as shown in FIG. 16.

Various types of engines and power-generating devices can be implemented as engine 140 in TMS 10. In some embodiments, for example, engine 140 is a conventional four-cycle piston-based engine, and the waste refrigerant fluid is introduced into a combustor of the engine. In certain embodiments, engine 140 is a gas turbine engine, and the waste refrigerant fluid is introduced via the engine inlet to the afterburner of the gas turbine engine. As discussed above, in some embodiments, TMS 10 can include phase separator (not shown) positioned upstream from engine 140. Phase separator functions to prevent liquid refrigerant fluid from entering engine 140, which may reduce the efficiency of electrical power generation by engine 140.

X. Start-Up and Temporary Operation

In certain embodiments, the thermal management systems disclosed herein operate differently at, and immediately following, system start-up, compared to the manner in which the systems operate after an extended running period. Upon start-up, the compressor 32 and a device (usually a fan) moving a cooling fluid (usually ambient air) through the condenser 34 are powered. The compressor 32 discharges compressed refrigerant into the condenser 34. The refrigerant is condensed and subcooled in the condenser 34. Liquid refrigerant fluid enters receiver 15 at a pressure and temperature generated by operation of the compressor 32 and condenser 34.

XI. Integration with Directed Energy Systems

The thermal management systems and methods disclosed herein can be implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 17:
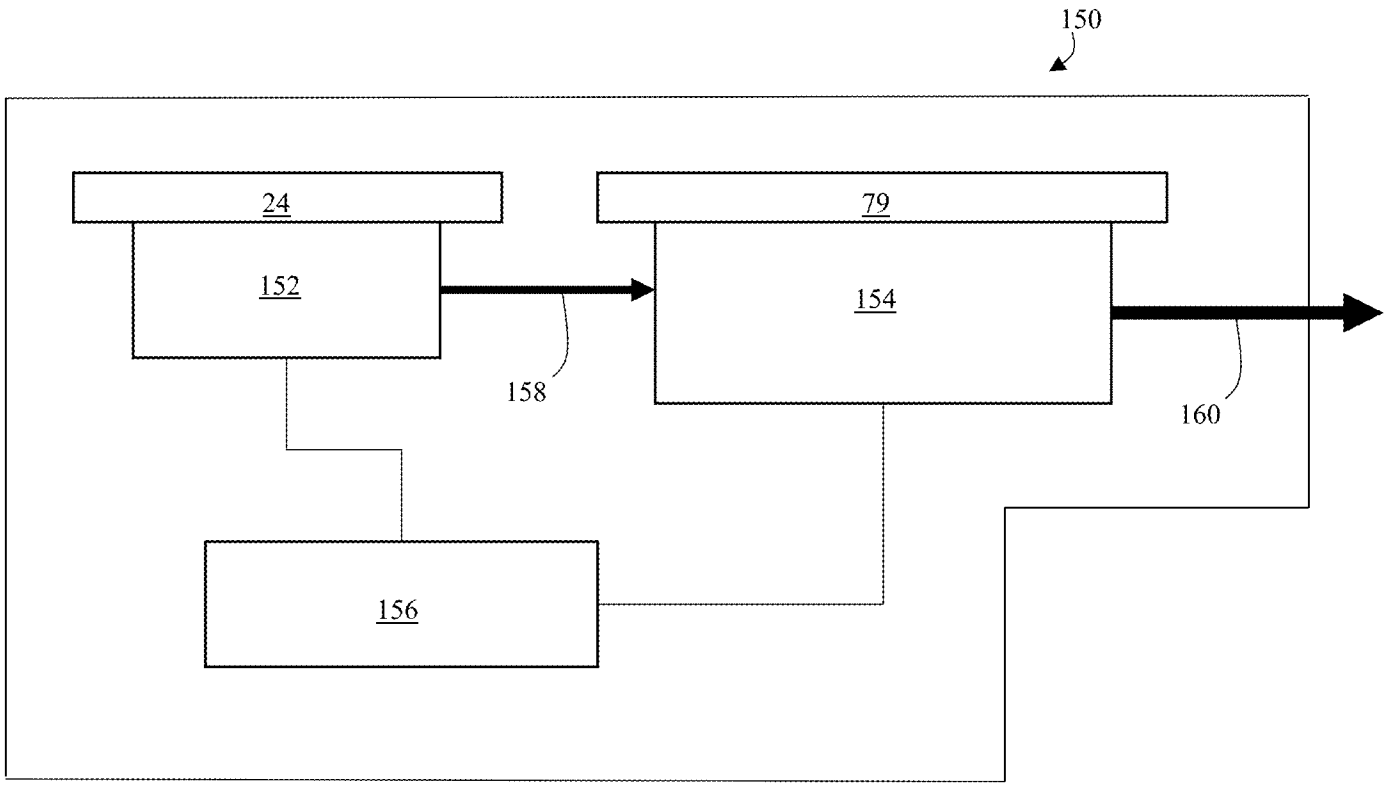
FIG. 17 is a schematic diagram of an example of directed energy system that includes a thermal management system.

FIG. 17 shows one example of a directed energy system, specifically, a high energy laser system 150. System 150 includes a bank of one or more laser diodes 152 and an amplifier 154 both connected to a power source 156. During operation, laser diodes 152 generate an output radiation beam 158 that is amplified by amplifier 154 and directed as an output beam 160 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes.

To regulate the temperatures of various components of directed energy systems such as diodes 152 and amplifier 154, such systems can include components and features of the thermal management systems disclosed herein. In FIG. 17, evaporator 24 (FIGS. 1, etc.) is coupled to diodes 152 and amplifier 154. The other components of the thermal management systems disclosed herein are not shown for clarity. However, it should be understood that any of the features and components discussed above can optionally be included in directed energy systems. Diodes 152, due to their temperature-sensitive nature, effectively function as high heat load 49*b* in system 150, while amplifier 154 functions as low heat load 49*a*.

System 150 is one example of a directed energy system that can include various features and components of the thermal management systems and methods described herein. However, it should be appreciated that the thermal management systems and methods are general in nature, and can be applied to cool a variety of different heat loads under a wide range of operating conditions.

XII. Hardware and Software Implementations

Controller 17 can generally be implemented as any one of a variety of different electrical or electronic computing or processing devices, and can perform any combination of the various steps discussed above to control various components of the disclosed thermal management systems.

Controller 17 can generally, and optionally, include any one or more of a processor (or multiple processors), a memory, a storage device, and input/output device. Some or all of these components can be interconnected using a system bus. The processor is capable of processing instructions for execution. In some embodiments, the processor is a single-threaded processor. In certain embodiments, the processor is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory stores information within the system, and can be a computer-readable medium, such as a volatile or non-volatile memory. The storage device can be capable of providing mass storage for the controller 17. In general, the storage device can include any non-transitory tangible media configured to store computer readable instructions. For example, the storage device can include a computer-readable medium and associated components, including: magnetic disks, such as internal hard disks and removable disks; magneto-optical disks; and optical disks. Storage devices suitable for tangibly embodying computer program instructions and data include all forms of non-volatile memory including by way of example, semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device provides input/output operations for controller 17, and can include a keyboard and/or pointing device. In some embodiments, the input/output device includes a display unit for displaying graphical user interfaces and system related information.

The features described herein, including components for performing various measurement, monitoring, control, and communication functions, can be implemented in digital electronic circuitry, or in computer hardware, firmware, or in combinations of them. Methods steps can be implemented in a computer program product tangibly embodied in an information carrier, e.g., in a machine-readable storage device, for execution by a programmable processor (e.g., of controller 17), and features can be performed by a programmable processor executing such a program of instructions to perform any of the steps and functions described above. Computer programs suitable for execution by one or more system processors include a set of instructions that can be used directly or indirectly, to cause a processor or other computing device executing the instructions to perform certain activities, including the various steps discussed above.

Computer programs suitable for use with the systems and methods disclosed herein can be written in any form of programming language, including compiled or interpreted languages, and can be deployed in any form, including as stand-alone programs or as modules, components, subroutines, or other units suitable for use in a computing environment.

In addition to one or more processors and/or computing components implemented as part of controller 17, the systems disclosed herein can include additional processors and/or computing components within any of the control device (e.g., control device 18) and any of the sensors discussed above. Processors and/or computing components of the control devices and sensors, and software programs and instructions that are executed by such processors and/or computing components, can generally have any of the features discussed above in connection with controller 17.

OTHER EMBODIMENTS

A number of embodiments have been described. Nevertheless, it will be understood that various modifications may be made without departing from the spirit and scope of the disclosure.

Accordingly, other embodiments are within the scope of the following claims.

What is claimed is:

1. A thermal management system comprising:

a receiver that comprises a first receiver port and a second receiver port and is configured to store a refrigerant fluid;

a first ejector comprising a primary inlet, a secondary inlet and an outlet;

a second ejector comprising a primary inlet, a secondary inlet, and an outlet;

an evaporator comprising a first evaporator port and a second evaporator port;

a condenser device comprising a condenser inlet and a condenser outlet;

a compressor comprising a compressor inlet and a compressor outlet;

a heat pump circuit comprising the receiver, the ejector, the evaporator, the condenser, and the compressor fluidly coupled within a closed-circuit fluid path that further includes the second ejector; and an open-circuit refrigeration system configured to receive the refrigerant fluid from the receiver, with the open-circuit refrigeration system comprising the receiver, the ejector, the condenser, the compressor, and the evaporator fluidly coupled within an open-circuit fluid path.

2. The thermal management system of claim 1, wherein a refrigerant pressure in the evaporator depends at least in part on a secondary refrigerant flow that is entrained by a primary refrigerant flow through the ejector.

3. The thermal management system of claim 1, wherein the ejector is configured to pump the secondary refrigerant flow using energy of the primary refrigerant flow.

4. The thermal management system of claim 1, further comprising:

a liquid separator comprising an inlet, a vapor-side outlet and a liquid-side outlet, with the liquid-side outlet coupled to the secondary inlet port of the ejector, and with the ejector secondary inlet port configured to receive a refrigerant liquid from the liquid-side outlet of the liquid separator.

5. The thermal management system of claim 4, further comprising:

a check valve disposed between the liquid-side outlet and the secondary inlet port of the ejector.

6. The thermal management system of claim 1, further comprising:

a first by-passable expansion device that couples the first receiver port to the ejector; and a second by-passable expansion device that couples the second receiver port to the condenser device.

7. The thermal management system of claim 6, wherein the first and second by-passable expansion devices each comprise:

an expansion valve device; and a check valve coupled in shunt with the expansion valve device.

8. The thermal management system of claim 6, wherein the first by-passable expansion device is configured to expand a liquid phase of the refrigerant fluid from the receiver to produce a mixed liquid-vapor refrigerant flow into the evaporator for a cooling mode of operation.

9. The thermal management system of claim 6, wherein the liquid phase of the refrigerant fluid fed to the secondary inlet is expanded at a constant entropy in the ejector and mixes with the mixed liquid-vapor refrigerant flow from the first by-passable expansion device to form a combined mixed liquid-vapor refrigerant that provides cooling duty to at least one heat load thermally coupled to the evaporator, and which combined mixed liquid-vapor refrigerant is discharged from the evaporator in a two-phase state having an exit vapor quality below a unit vapor quality.

10. The thermal management system of claim 1, wherein the heat pump circuit further comprises:

a four-way valve disposed in both the closed-circuit fluid path and the open-circuit fluid path.

11. The thermal management system of claim 10, wherein the heat pump circuit further comprises:

a by-passable expansion device that couples the condenser device to the second receiver port.

12. The thermal management system of claim 11, wherein the condenser device is a condenser and the by-passable expansion device is configured to expand a liquid phase of the refrigerant fluid to produce a mixed liquid-vapor refrigerant flow into the condenser for a heating mode of operation.

13. The thermal management system of claim 11, wherein the by-passable expansion device is a first by-passable expansion device and the system further comprises:

a second by-passable expansion device that is configured to expand the liquid phase of the refrigerant fluid to produce a mixed liquid-vapor refrigerant flow into the evaporator for a cooling mode of operation.

14. The thermal management system of claim 10, wherein the open-circuit fluid path comprises:

a by-passable expansion device configured to expand the liquid refrigerant from the receiver to produce a mixed liquid-vapor refrigerant flow into the evaporator for a cooling mode of operation; and a back-pressure regulator that is disposed in exhaust line of the open-circuit fluid path, with the open-circuit fluid path configured to discharge the refrigerant vapor such that the discharged refrigerant vapor does not return to the receiver.

15. The thermal management system of claim 14, further comprising:

a controller configured to control operation of the thermal management system, with the controller comprising:

one or more processor devices; and at least one memory operatively coupled to the one or more processor devices, the at least one memory comprising storage configured to store executable computer instructions that cause the controller to perform operations in response to one or more control signals.

16. The thermal management system of claim 15, wherein the operation comprise:

operating the back-pressure regulator to adjust to a closed position to turn off the open-circuit refrigeration system; and operating the heat pump circuit in a cooling mode to transfer heat from at least one heat load thermally coupled to the evaporator.

17. The thermal management system of claim 15, wherein the operations comprise:

operating the back-pressure regulator to adjust to a closed position to turn off the open-circuit refrigeration system; and operating the heat pump circuit in a heating mode to transfer heat to at least one heat load thermally coupled to the evaporator.

18. The thermal management system of claim 15, wherein the operations comprise:

operating the back-pressure regulator to adjust to an open position to turn on the open-circuit refrigeration system.

19. The thermal management system of claim 1, wherein the thermal management system is configured to operate the heat pump circuit in a closed-circuit cooling mode to cool at least one heat load thermally coupled to the evaporator, a closed-circuit heating mode to heat the at least one heat load, or an open-circuit cooling mode to cool the at least one heat load.

20. The thermal management system of claim 1, further comprising:

a liquid separator having an inlet, a vapor-side outlet and a liquid-side outlet, with the liquid-side outlet; and a check valve that inhibits refrigerant flow in a first direction and allows refrigerant flow in a second direction, with the valve coupled between the secondary inlet of the first ejector and the liquid-side outlet of the liquid separator, with the secondary inlet of the first ejector configured to receive refrigerant liquid from the liquid-side outlet of the liquid separator through the check valve during a cooling mode.

21. The thermal management system of claim 1, further comprising:

a first by-passable expansion device that couples the first receiver port to the first ejector; and a second by-passable expansion device that couples the second receiver port to the primary inlet of the second ejector.

22. The thermal management system of claim 20, wherein when operating in the closed-circuit heating mode, the second ejector pumps a secondary refrigerant flow from the liquid separator using energy of a primary refrigerant flow from the receiver.

23. The thermal management system of claim 22, wherein refrigerant pressure in the condenser device is dependent, at least in part, on a secondary recirculation refrigerant flow that is entrained by a primary refrigerant flow through the second ejector in the closed-circuit heating mode.

24. The thermal management system of claim 21, wherein the thermal management system is configured to operate in a closed-circuit heating mode to apply heat to at least one heat load thermally coupled to the evaporator.

25. The thermal management system of claim 24, wherein the second by-passable expansion device is configured to expand a liquid phase of the refrigerant fluid from the receiver to produce a mixed liquid-vapor refrigerant flow into the second ejector during the heating mode of operation.

26. The thermal management system of claim 24, wherein the second by-passable expansion device couples the second receiver port to the second port of the condenser device when operating in the closed-circuit heating mode to deliver the liquid phase of the refrigerant fluid from the receiver to the primary inlet of the second ejector.

27. The thermal management system of claim 20, wherein the heat pump circuit further comprises:

a four-way valve disposed in both the closed-circuit fluid path and the open-circuit fluid path.

28. The thermal management system of claim 27, further comprising:

a first flow-control valve coupled to the secondary inlet of the first ejector; and a second flow-control valve coupled to the secondary inlet of the second ejector.

29. The thermal management system of claim 28, wherein the inlet of the liquid separator is coupled to a first port of the four-way valve, the vapor side outlet of the liquid separator is coupled to a second port of the four-way valve, and the liquid-side outlet of the liquid separator is in fluid flow paths with inlet ports of the first and the second flow-control valves.

30. The thermal management system of claim 20, wherein the liquid refrigerant fed to the secondary inlet of the first ejector is expanded at a constant entropy in the first ejector and mixes with the mixed liquid-vapor refrigerant flow from the first by-passable expansion device to form a combined mixed liquid-vapor refrigerant that provides cooling duty to a heat load coupled to the evaporator, and which combined mixed refrigerant is discharged from the evaporator in a two-phase state having an exit vapor quality below a unit vapor quality.

31. The thermal management system of claim 20, further comprising:

a controller to control operation of the thermal management system with the controller comprising:

one or more processor devices;

memory operatively coupled to the one or more processor devices; and storage, storing computer instructions to configure the controller.

32. The thermal management system of claim 31, further comprising:

a four-way valve disposed in both the closed-circuit fluid path and the open-circuit fluid path.

33. The thermal management system of claim 32, wherein the controller configures the thermal management system to operate in:

a first mode that is a closed-circuit heating mode; or a second mode that is a closed-circuit cooling mode; or a third mode that is a closed-circuit and open-circuit cooling mode.

34. The thermal management system of claim 33, wherein the controller selects one mode from the first and second modes and causes the thermal management system to operate in the selected mode by configuring the four-way valve.

35. The thermal management system of claim 34, further comprising a back-pressure regulator, and wherein the controller configures the thermal management system to:

turn off the open-circuit refrigeration system by closing the back-pressure regulator; and configures the heat pump circuit to operate in a cooling mode to transfer heat from an applied heat load.

36. The thermal management system of claim 34, further comprising a back-pressure regulator, and wherein the controller configures the thermal management system to:

turn off the open-circuit refrigeration system by closing the back-pressure regulator; and configures the heat pump circuit to operate in a heating mode to transfer heat to an applied heat load.

37. The thermal management system of claim 34, further comprising a back-pressure regulator, and wherein the controller configures the thermal management system to:

turn on the open-circuit refrigeration system by opening the back-pressure regulator.

38. The thermal management system of claim 1, wherein the refrigerant comprises ammonia.

39. The thermal management system of claim 20, wherein the refrigerant is ammonia.

40. A thermal management system comprising:

a receiver that comprises a first receiver port and a second receiver port and is configured to store a refrigerant fluid;

an ejector comprising a primary inlet, a secondary inlet, and an outlet;

an evaporator comprising a first evaporator port and a second evaporator port;

a condenser device comprising a condenser inlet and a condenser outlet;

a compressor comprising a compressor inlet and a compressor outlet;

a heat pump circuit comprising the receiver, the ejector, the evaporator, the condenser, and the compressor fluidly coupled within a closed-circuit fluid path;

an open-circuit refrigeration system configured to receive the refrigerant fluid from the receiver, with the open-circuit refrigeration system comprising the receiver, the ejector, the condenser, the compressor, and the evaporator fluidly coupled within an open-circuit fluid path;

a first by-passable expansion device that couples the first receiver port to the ejector; and a second by-passable expansion device that couples the second receiver port to the condenser device.

41. The thermal management system of claim 40, wherein a refrigerant pressure in the evaporator depends at least in part on a secondary refrigerant flow that is entrained by a primary refrigerant flow through the ejector.

42. The thermal management system of claim 40, wherein the ejector is configured to pump the secondary refrigerant flow using energy of the primary refrigerant flow.

43. The thermal management system of claim 40, further comprising a liquid separator comprising an inlet, a vapor-side outlet and a liquid-side outlet, with the liquid-side outlet coupled to the secondary inlet port of the ejector, and with the ejector secondary inlet port configured to receive a refrigerant liquid from the liquid-side outlet of the liquid separator.

44. The thermal management system of claim 40, wherein the first and second by-passable expansion devices each comprise:

an expansion valve device; and a check valve coupled in shunt with the expansion valve device.

45. The thermal management system of claim 40, wherein the first by-passable expansion device is configured to expand a liquid phase of the refrigerant fluid from the receiver to produce a mixed liquid-vapor refrigerant flow into the evaporator for a cooling mode of operation.

46. The thermal management system of claim 40, wherein the liquid phase of the refrigerant fluid fed to the secondary inlet is expanded at a constant entropy in the ejector and mixes with the mixed liquid-vapor refrigerant flow from the first by-passable expansion device to form a combined mixed liquid-vapor refrigerant that provides cooling duty to at least one heat load thermally coupled to the evaporator, and which combined mixed liquid-vapor refrigerant is discharged from the evaporator in a two-phase state having an exit vapor quality below a unit vapor quality.

47. The thermal management system of claim 40, wherein the heat pump circuit further comprises:

a four-way valve disposed in both the closed-circuit fluid path and the open-circuit fluid path.

48. The thermal management system of claim 47, wherein the condenser device is a condenser.

49. The thermal management system of claim 40, wherein the open-circuit fluid path comprises a back-pressure regulator that is disposed in an exhaust line of the open-circuit fluid path, with the open-circuit fluid path configured to discharge the refrigerant vapor such that the discharged refrigerant vapor does not return to the receiver.

50. The thermal management system of claim 49, further comprising:

a controller configured to control operation of the thermal management system, with the controller comprising:

one or more processor devices; and at least one memory operatively coupled to the one or more processor devices, the at least one memory comprising storage configured to store executable computer instructions that cause the controller to perform operations in response to one or more control signals, the operations comprising:

operating the back-pressure regulator to adjust to a closed position to turn off the open-circuit refrigeration system; and operating the heat pump circuit in a cooling mode to transfer heat from at least one heat load thermally coupled to the evaporator.

51. The thermal management system of claim 50, wherein the operations comprise:

operating the back-pressure regulator to adjust to a closed position to turn off the open-circuit refrigeration system; and operating the heat pump circuit in a heating mode to transfer heat to at least one heat load thermally coupled to the evaporator.

52. The thermal management system of claim 50, wherein the operations comprise operating the back-pressure regulator to adjust to an open position to turn on the open-circuit refrigeration system.

53. The thermal management system of claim 40, wherein the ejector is a first ejector, and the thermal management system further comprises a second ejector comprising a primary inlet, a secondary inlet, and an outlet, with the closed-circuit fluid path further comprising the second ejector.

54. A thermal management system comprising:

a receiver that comprises a first receiver port and a second receiver port and is configured to store a refrigerant fluid;

an ejector comprising a primary inlet, a secondary inlet, and an outlet;

an evaporator comprising a first evaporator port and a second evaporator port;

a condenser device comprising a condenser inlet and a condenser outlet;

a compressor comprising a compressor inlet and a compressor outlet;

a heat pump circuit comprising the receiver, the ejector, the evaporator, the condenser, and the compressor fluidly coupled within a closed-circuit fluid path;

an open-circuit refrigeration system configured to receive the refrigerant fluid from the receiver, with the open-circuit refrigeration system comprising the receiver, the ejector, the condenser, the compressor, and the evaporator fluidly coupled within an open-circuit fluid path; and a four-way valve disposed in both the closed-circuit fluid path and the open-circuit fluid path.

55. The thermal management system of claim 54, wherein a refrigerant pressure in the evaporator depends at least in part on a secondary refrigerant flow that is entrained by a primary refrigerant flow through the ejector.

56. The thermal management system of claim 54, wherein the ejector is configured to pump the secondary refrigerant flow using energy of the primary refrigerant flow.

57. The thermal management system of claim 54, further comprising a liquid separator comprising an inlet, a vapor-side outlet and a liquid-side outlet, with the liquid-side outlet coupled to the secondary inlet port of the ejector, and with the ejector secondary inlet port configured to receive a refrigerant liquid from the liquid-side outlet of the liquid separator.

58. The thermal management system of claim 54, further comprising:

a first by-passable expansion device that couples the first receiver port to the ejector; and a second by-passable expansion device that couples the second receiver port to the condenser device, each of the first and second by-passable expansion devices comprising:

an expansion valve device; and a check valve coupled in shunt with the expansion valve device.

59. The thermal management system of claim 58, wherein the first by-passable expansion device is configured to expand a liquid phase of the refrigerant fluid from the receiver to produce a mixed liquid-vapor refrigerant flow into the evaporator for a cooling mode of operation.

60. The thermal management system of claim 58, wherein the liquid phase of the refrigerant fluid fed to the secondary inlet is expanded at a constant entropy in the ejector and mixes with the mixed liquid-vapor refrigerant flow from the first by-passable expansion device to form a combined mixed liquid-vapor refrigerant that provides cooling duty to at least one heat load thermally coupled to the evaporator, and which combined mixed liquid-vapor refrigerant is discharged from the evaporator in a two-phase state having an exit vapor quality below a unit vapor quality.

61. The thermal management system of claim 54, wherein the heat pump circuit further comprises a by-passable expansion device that couples the condenser device to the second receiver port.

62. The thermal management system of claim 61, wherein the condenser device is a condenser and the by-passable expansion device is configured to expand a liquid phase of the refrigerant fluid to produce a mixed liquid-vapor refrigerant flow into the condenser for a heating mode of operation.

63. The thermal management system of claim 61, wherein the by-passable expansion device is a first by-passable expansion device and the system further comprises a second by-passable expansion device that is configured to expand the liquid phase of the refrigerant fluid to produce a mixed liquid-vapor refrigerant flow into the evaporator for a cooling mode of operation.

64. The thermal management system of claim 54, wherein the open-circuit fluid path comprises:

a by-passable expansion device configured to expand the liquid refrigerant from the receiver to produce a mixed liquid-vapor refrigerant flow into the evaporator for a cooling mode of operation; and a back-pressure regulator that is disposed in exhaust line of the open-circuit fluid path, with the open-circuit fluid path configured to discharge the refrigerant vapor such that the discharged refrigerant vapor does not return to the receiver.

65. The thermal management system of claim 64, further comprising:

a controller configured to control operation of the thermal management system, with the controller comprising:

one or more processor devices; and at least one memory operatively coupled to the one or more processor devices, the at least one memory comprising storage configured to store executable computer instructions that cause the controller to perform operations in response to one or more control signals, the operations comprising:

operating the back-pressure regulator to adjust to a closed position to turn off the open-circuit refrigeration system; and operating the heat pump circuit in a cooling mode to transfer heat from at least one heat load thermally coupled to the evaporator.

66. The thermal management system of claim 65, wherein the operations comprise:

operating the back-pressure regulator to adjust to a closed position to turn off the open-circuit refrigeration system; and operating the heat pump circuit in a heating mode to transfer heat to at least one heat load thermally coupled to the evaporator.

67. The thermal management system of claim 65, wherein the operations comprise operating the back-pressure regulator to adjust to an open position to turn on the open-circuit refrigeration system.

68. The thermal management system of claim 54, wherein the ejector is a first ejector, and the thermal management system further comprises a second ejector comprising a primary inlet, a secondary inlet, and an outlet, with the closed-circuit fluid path further comprising the second ejector.

* * * * *